US007553211B1

(12) United States Patent
DeAngelis

(10) Patent No.: US 7,553,211 B1
(45) Date of Patent: Jun. 30, 2009

(54) SYSTEM AND METHOD FOR CONTROLLING THE OPERATION OF TOYS

(76) Inventor: Peter C. DeAngelis, 2430 Torrejon Pl., Carlsbad, CA (US) 92009

( * ) Notice: Subject to any disclaimer, the term of this patent is extended or adjusted under 35 U.S.C. 154(b) by 0 days.

(21) Appl. No.: 08/797,188

(22) Filed: Feb. 11, 1997

(51) Int. Cl.
*A63H 30/00* (2006.01)

(52) U.S. Cl. ..... 446/454; 463/37

(58) Field of Classification Search ..... None
See application file for complete search history.

(56) References Cited

U.S. PATENT DOCUMENTS

| | | | |
|---|---|---|---|
| 3,303,821 | A | 2/1967 | Harris |
| 3,400,488 | A | 9/1968 | Phillpott et al. |
| 3,482,046 | A | 12/1969 | Hughson et al. |
| 3,596,400 | A | 8/1971 | Cheng |
| 3,639,755 | A | 2/1972 | Wrege |
| 3,782,031 | A | 1/1974 | Byron |
| 3,926,434 | A | 12/1975 | Cannon, Jr. |
| 4,080,602 | A | 3/1978 | Hattori et al. |
| 4,087,799 | A | 5/1978 | Bouwer |
| 4,135,181 | A | 1/1979 | Bogacki et al. |
| 4,141,553 | A | 2/1979 | Beny et al. |
| 4,171,468 | A | 10/1979 | Reiner |
| 4,197,672 | A | 4/1980 | Mabuchi et al. |
| 4,213,270 | A | 7/1980 | Oda |
| 4,226,292 | A | 10/1980 | Monte et al. |
| 4,334,221 | A | 6/1982 | Rosenhagen et al. |
| 4,563,626 | A | 1/1986 | Ohtake |
| 4,817,948 | A | 4/1989 | Simonelli |

(Continued)

*Primary Examiner*—Robert E Pezzuto
*Assistant Examiner*—Alex Rada
(74) *Attorney, Agent, or Firm*—Fulwider Patton, et al.; Ellsworth R. Roston

(57) ABSTRACT

A system and method for controlling toy vehicles has a plurality of pads coupled to a central station. Switches in the pads may be closed to select toy vehicles and the operation of motors for moving the vehicles forwardly, rearwardly, to the left and to the right and moving upwardly and downwardly a receptacle or bin for holding transportable elements (e.g. marbles). The pads may be set in a mode to allow sharing of a vehicle by more than one pad. The pads are connected by wires to the central station, and may be interrogated selectively, sequentially or simultaneously by the central station. The central station forms packets of signals representative of the switch closures of the interrogated pads, and transmits the packets over a modulated carrier frequency to receivers in the vehicles. Each of the packets includes a binary signal addressing the vehicle selected by the pad whose switch closures are represented by the packet of data. The central station prioritizes the transmission of the packets to improve vehicle control. An accessory, or a second central station, may be coupled to a smart port of the first central station. When the pads are interrogated by the central station, the signals from the pads may be routed to the accessory or second central station for processing, then sent back to the first central station for transmission to the vehicles. The pads include a flashback feature that automatically selects a previously selected vehicle. The motors of the vehicles may be energized using pulse width modulation to control the speed of the motor. Signals received by the vehicle are asserted to the motors in the first part of a duty cycle. The vehicles monitor all packets, and decode packets addressed to the vehicle to execute the commands represented by signals contained within the packet. When a packet is determined to be invalid, the vehicle ignores the packet.

126 Claims, 9 Drawing Sheets

U.S. PATENT DOCUMENTS 5,073,750 A 12/1991 Coron
5,098,110 A 3/1992 Yang
5,135,427 A 8/1992 Suto et al.
5,148,159 A 9/1992 Clark et al.
5,364,108 A 11/1994 Esnouf
5,429,543 A 7/1995 Tilbor et al.
5,435,553 A 7/1995 Arima et al.
5,435,768 A 7/1995 Dunleavy
5,452,901 A 9/1995 Nakada et al.
5,471,668 A 11/1995 Soenen et al.
5,474,486 A 12/1995 Chilton et al.
5,888,135 A * 3/1999 Barton, Jr. et al. ..... 463/39
5,944,609 A * 8/1999 Crane et al. ..... 463/62

* cited by examiner

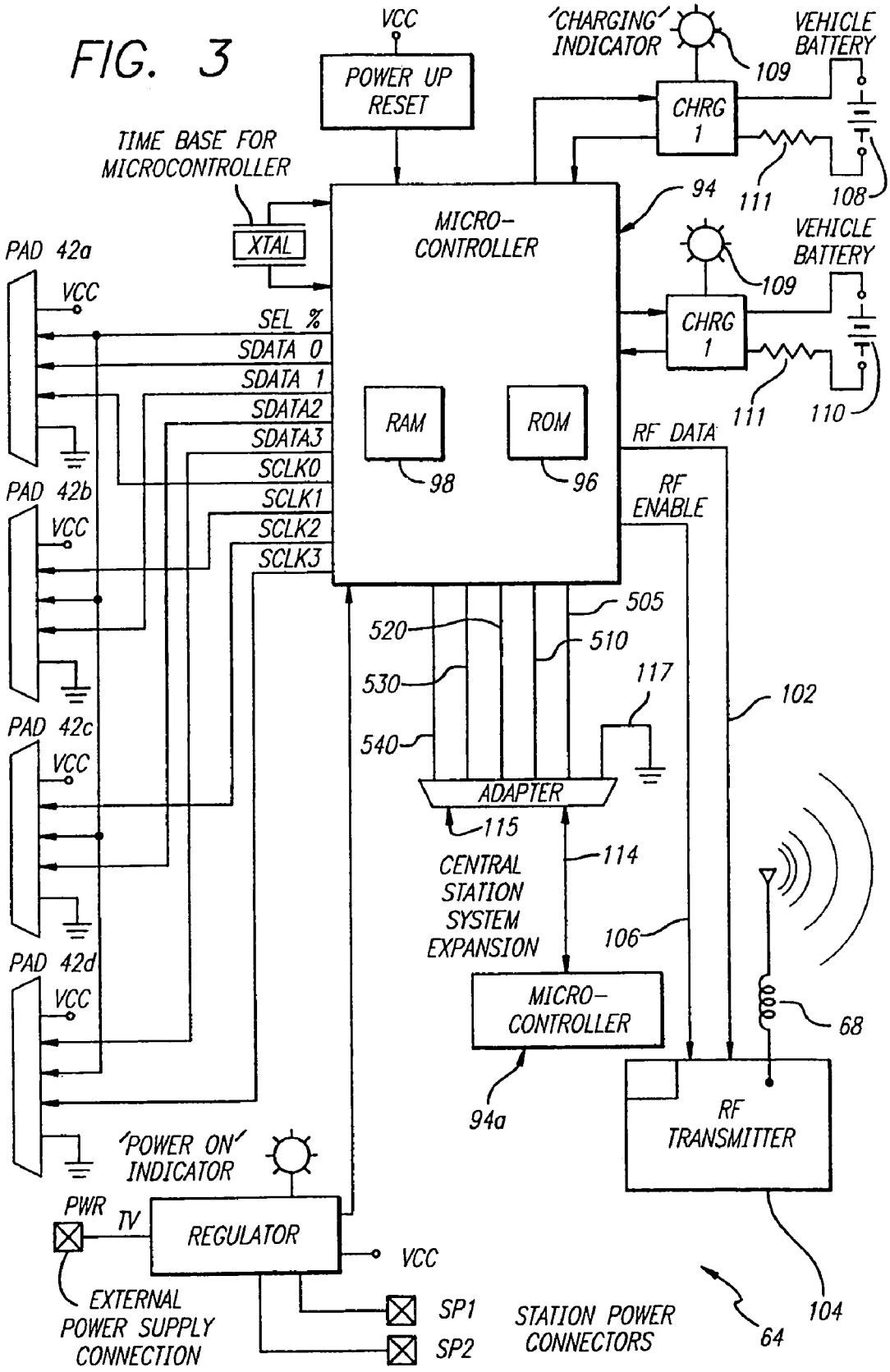
FIG. 3
VCC
POWER UP RESET
'CHARGING' INDICATOR
VEHICLE BATTERY
109
CHRG 1
TIME BASE FOR MICROCONTROLLER
XTAL
MICRO-CONTROLLER
94
111
108
VEHICLE BATTERY
109
CHRG 1
111
110
PAD 42a
VCC
SEL %
SDATA 0
SDATA 1
SDATA2
SDATA3
SCLK0
SCLK1
SCLK2
SCLK3
RAM
ROM
98
96
RF DATA
RF ENABLE
PAD 42b
VCC
505
520
510
530
117
102
PAD 42c
VCC
540
ADAPTER
115
114
CENTRAL STATION SYSTEM EXPANSION
106
PAD 42d
VCC
MICRO-CONTROLLER
68
94a
RF TRANSMITTER
'POWER ON' INDICATOR
PWR
TV
REGULATOR
VCC
EXTERNAL POWER SUPPLY CONNECTION
SP1
SP2
STATION POWER CONNECTORS
104
64

VCC
POWER UP RESET
VCC
122
12
134
TIME BASE FOR MICROCONTROLLER
XTAL
MICRO-CONTROLLER
RAM
ROM
126
124
VEHICLE ADDRESS SELECT
128
130
132
MOTOR 1
28
TRANSISTOR DRIVER
4
120
MOTOR 2
30
TRANSISTOR DRIVER
4
120
MOTOR 3
32
TRANSISTOR DRIVER
4
120
MOTOR 4
33
TRANSISTOR DRIVER
4
120
POWER ON
69
RF POWER MANAGEMENT
RF RECEIVER
121
BATTERY
VCC
4.5V
GND

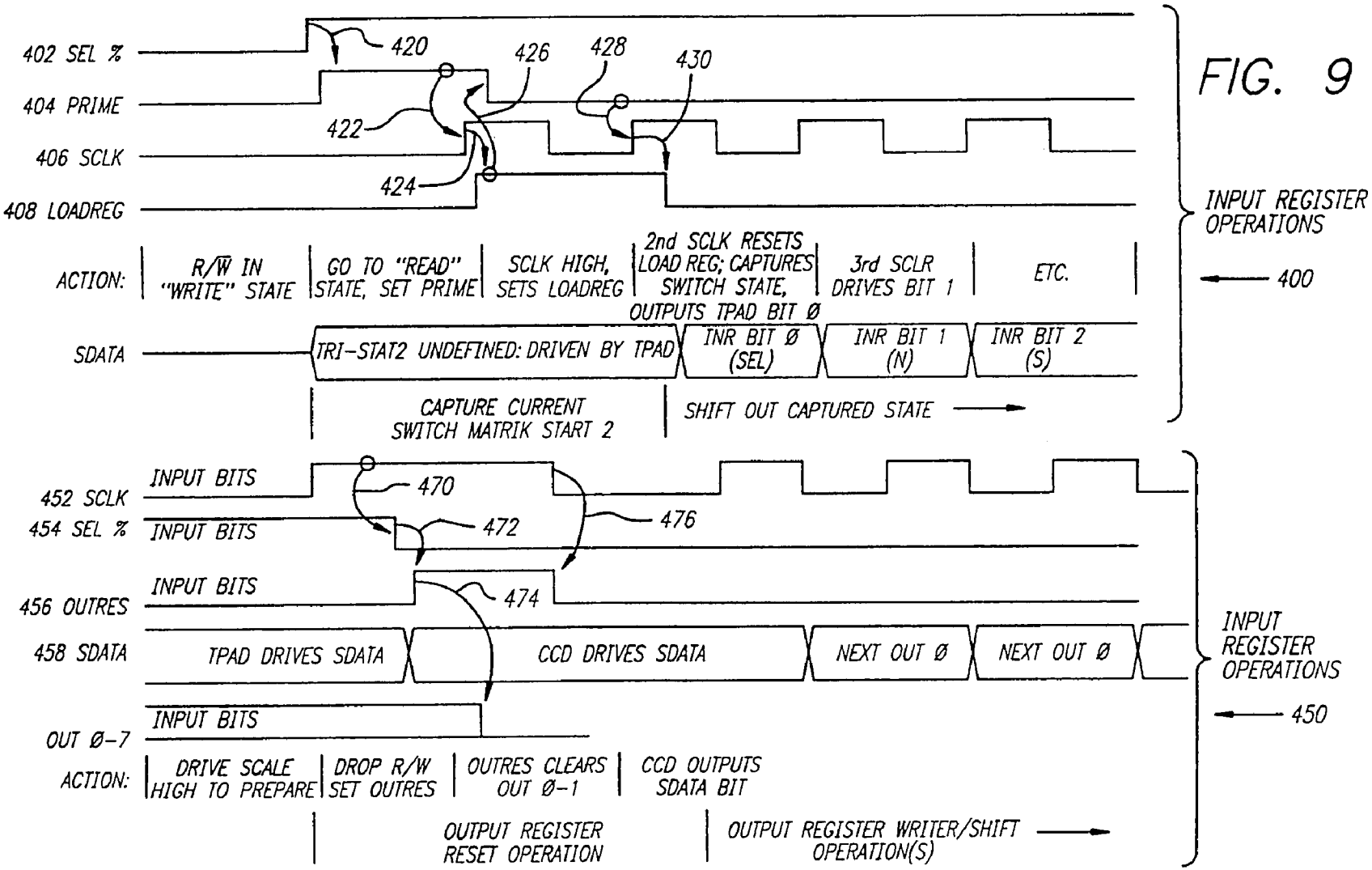
FIG. 9
INPUT REGISTER OPERATIONS
400
402 SEL %
404 PRIME
406 SCLK
408 LOADREG
ACTION:
SDATA
R/W IN "WRITE" STATE
GO TO "READ" STATE, SET PRIME
SCLK HIGH, SETS LOADREG
2nd SCLK RESETS LOAD REG; CAPTURES SWITCH STATE, OUTPUTS TPAD BIT Ø
3rd SCLR DRIVES BIT 1
ETC.
TRI-STAT2 UNDEFINED: DRIVEN BY TPAD
INR BIT Ø (SEL)
INR BIT 1 (N)
INR BIT 2 (S)
CAPTURE CURRENT SWITCH MATRIX START 2
SHIFT OUT CAPTURED STATE
420
422
424
426
428
430
INPUT REGISTER OPERATIONS
450
452 SCLK
454 SEL %
456 OUTRES
458 SDATA
OUT Ø-7
ACTION:
INPUT BITS
INPUT BITS
INPUT BITS
TPAD DRIVES SDATA
INPUT BITS
DRIVE SCALE HIGH TO PREPARE
DROP R/W SET OUTRES
OUTRES CLEARS OUT Ø-1
OUTPUT REGISTER RESET OPERATION
CCD DRIVES SDATA
CCD OUTPUTS SDATA BIT
NEXT OUT Ø
NEXT OUT Ø
OUTPUT REGISTER WRITER/SHIFT OPERATION(S)
470
472
474
476

SYSTEM AND METHOD FOR CONTROLLING THE OPERATION OF TOYS

BACKGROUND OF THE INVENTION

1. Field of the Invention

The invention relates generally to a system for pleasurable use by people of all ages with youthful minds in operating remotely controlled vehicles simultaneously in a somewhat confined area. More specifically, this invention relates to remotely controlled vehicles such as toy dump trucks that can be operated to mimic the operation of similar full-size vehicles having accessories for scooping up material, transferring the material to a hopper, and then automatically activating the hopper to dump the material. In addition, the system also includes a trailer hitch that can be remotely engaged or disengaged by controlling the position of the scooper.

2. Description of the Related Art

Various types of play systems exist, and have existed for some time, in which vehicles are moved on a remotely controlled basis. Examples of a vehicle in such a system are an automobile, airplane, truck or construction vehicle. In most such systems, however, the functions and activities that the vehicle is capable of are limited to moving along a floor or along the ground or in the air.

Other types of play systems involve the use of blocks for building structures. These blocks often include structure for providing an interlocking relation-ship between abutting blocks. In this way, elaborate structures can be created by users with creative minds. Such structures are generally built by hand.

Tests have indicated that there is a desirability, and even a need, for play systems in which vehicles are remotely operated to perform functions other than to move aimlessly along a floor or along the ground For example, tests have indicated there is a desirability, and even a need, for a play system in which the remotely controlled vehicles can transport elements such as blocks to construct creative structures. There is also a desirability, and even a need for play systems in which a plurality of vehicles can be remotely controlled by switches in hand-held pads to compete against one another in performing a first task or to cooperate in performing a second task such as building a miniature community through the transport of miniature blocks or other suitably sized material.

Co-pending application Ser. No. 08/580,753 filed by John J. Crane on Dec. 29, 1995, for a "Remote Control System for Operating Toys" and assigned of record to the assignee of record of this application discloses and claims a play system for use by people of all ages with youthful minds. It provides for a simultaneous control by each player of an individual one of a plurality of remotely controlled vehicles. This control is provided by the operation by each such player of switches in a hand-held unit or pad, the operation of each switch in such hand-held unit or pad providing a control of a different function in the individual one of the remotely controlled vehicles. Each of the remotely controlled vehicles in the system disclosed an claimed in application 08/580,753 can be operated in a competitive relationship with others of the remotely controlled vehicles or in a co-operative relationship with others of the remotely controlled vehicles. The vehicles can be constructed to pick up and transport elements such as blocks or marbles and to deposit such elements at displaced positions.

When manually closed in one embodiment of the system disclosed and claimed in application Ser. No. 08/580,753, switches in pads control the selection of toy vehicles and the operation of motors for moving the vehicles forwardly, rearwardly, to the left and to the right and moving upwardly and downwardly (and rightwardly and leftwardly) a receptacle for holding transportable elements (e.g. marbles) or blocks.

When sequentially and cyclically interrogated by a central station, each pad in the system disclosed and claimed in application Ser. No. 08/580,753 sends through wires to the central station signals indicating the switch closures in such pad. Such station produces first binary signals addressing the vehicle selected by such pad and second binary signals identifying the control operations in such vehicle. Thereafter the switches identifying in such pad the control operations in such selected vehicle can be closed without closing the switches identifying such vehicle.

The first and second signals for each vehicle in the system disclosed and claimed in application Ser. No. 08/580,753 are transmitted by wireless by the central station to all of the vehicles at a common carrier frequency modulated by the first and second binary signals. The vehicle identified by the transmitted address demodulates the modulating signal and operates its motors in accordance with such demodulation. When the station fails to receive signals from a pad for a particular period of time, the vehicle selected by such pad becomes available for selection by another pad and such pad can select that vehicle or another vehicle.

A cable may couple two (2) central stations (one as a master and the other as a slave) in the system disclosed and claimed in application Ser. No. 08/580,753 so as to increase the number of pads controlling the vehicles. Stationary accessories (e.g. elevator) connected by wires to the central station become operative when selected by the pads.

Co-pending application Ser. No. 08/763,678, filed by William M. Barton, Jr., Peter C. DeAngelis and Paul Eichen on Dec. 11, 1996 for a "System For And Method Of Selectively Providing The Operation Of Toy Vehicles" and assigned of record to the assignee of record of this application discloses and claims a system wherein a key in a vehicle socket closes contacts to reset a vehicle microcontroller to a neutral state. Ribs disposed in a particular pattern in the key operate switches in a particular pattern in the vehicle to provide an address for the vehicle with the vehicle inactive but powered. When the vehicle receives such individual address from an individual one of the pads in a plurality within a first particular time period thereafter, the vehicle is operated by commands from such pad. Such individual pad operates such vehicle as long as such vehicle receives commands from such individual pad within the first particular period after the previous command from such individual pad. During this period, the vehicle has a first illumination to indicate that it is being operated.

When the individual pad of the system disclosed and claimed in application Ser. No. 08/763,678 fails to provide commands to such vehicle within such first particular time period, the vehicle becomes inactive but powered and provides a second illumination. While inactive but powered, the vehicle can be addressed and subsequently commanded by any pad including the individual pad, which thereafter commands the vehicle. The vehicle becomes de-activated and not illuminated if (a) the vehicle is not selected by any of the pads during a second particular time period after becoming inactivated but powered or, alternatively, (b) all of the vehicles become inactivated but powered and none is selected during the second particular period. The vehicle becomes deactivated and not illuminated. The key can thereafter be actuated to operate the vehicle to the inactive but powered state.

Co-pending application Ser. No. 08/696,263, filed by Peter C. DeAngelis on Aug. 13, 1996 for a "System And Method Of Controlling The Operation Of Toys" and assigned of record to the assignee of record of this application discloses and claims a system wherein individual ones of pads remotely control the operation of selective ones of vehicles. In each pad, (a) at least a first control provides for the selection of one of the vehicles, (b) second controls provide for the movement of the selected vehicle and (c) third controls provide for the operation of working members (e.g. pivotable bins) in the selected vehicle. Each pad provides a carrier signal, preferably common with the carrier signals from the other pads. Each pad modulates the carrier signal in accordance with the operation of the pad controls. The first control in each pad provides an address distinctive to the selected one of the vehicles and modulates the carrier signal in accordance with such address.

Each pad of the system disclosed and claimed in application 08/696,263 sends the modulated carrier signals to the vehicles in a pseudo random pattern, different for each pad, with respect to time. Each vehicle demodulates the carrier signals to recover the address distinctive to such vehicle. Each vehicle then provides a movement of such vehicle and an operation of the working members in such vehicle in accordance with the modulations provided in the carrier signal by the operation of the second and third controls in the pads selecting such vehicle. Each vehicle is controlled by an individual one of the pads for the time period that such pad sends control signals to such vehicle within a particular period of time from the last transmission of such control signals to such vehicle. Thereafter such vehicle can be selected by such pad or by another pad.

What has been needed, and heretofore unavailable, is a play system including vehicles that are capable of being remotely operated to accomplish tasks such as lifting, scooping, dumping, leveling and hauling suitably sized materials such as marbles or small blocks, thus providing a person having a youthful mind with opportunities for realistic play and enjoyment.

SUMMARY OF THE INVENTION

Briefly and in general terms, the present invention provides a new and improved play system for use by people of all ages with youthful minds. It provides for simultaneous control by each player of an individual one of a plurality of remotely controlled vehicles. This control is provided by the operation by each such player of switches in a hand-held unit or pad, the operation of each switch in such hand-held unit providing a control of a different function in the individual one of the remotely controlled vehicles. Each of the remotely controlled vehicles in the system of this invention can be operated in a competitive relationship with others of the remotely controlled vehicles or in a co-operative relationship with others of the remotely controlled vehicles. The vehicles can be constructed to pick up and transport elements such as blocks or marbles and to deposit such elements at displaced positions.

More specifically, when manually closed in one embodiment of the invention, switches in pads control the selection of toy vehicles and the operation of motors for moving the vehicles forwardly, rearwardly, to the left and to the right, and moving upwardly and downwardly a receptacle or bin for holding transportable elements (e.g. marbles).

The pads may be interrogated by a central station in either a sequential or parallel manner, the pads sending signals representative of switch closures in the pad to the central station over wires. The central station receives the signals from the pad, and forms packets of data to be transmitted over radio frequencies to receivers in the toy vehicles. The central station forms the packet to have a first binary signal addressing the vehicle selected by such pad and a second binary signal identifying the control operation in such vehicle.

The packets of data formed by the central station are transmitted by wireless to all of the vehicles at a common carrier frequency modulated by the first and second binary signals. The vehicle identified by the transmitted address demodulates the modulating signals and operates its motors in accordance with such demodulation. When the station fails to receive signals from a pad for a particular period of time, the vehicle selected by such pad becomes available for selection by another pad and such pad can select that vehicle or another vehicle.

The pads also include a switch to set the pad into a mode wherein a second pad may also select and control the vehicle selected by the first pad. Another novel aspect of the present invention is the inclusion of a flashback capability that may also be sensitive to the setting of the mode of a pad. When a pad has been de-selected because the central station has failed to receive commands from the pad for a particular period of time, pushing any button on the de-selected pad will cause the central station to attempt to select the last vehicle controlled by the pad. If this attempt fails because the vehicle is already selected by another pad, and that pad's mode is not set to allowing sharing of control of the vehicle, the central station attempts to select the second to last vehicle controlled by the de-selected pad. If this second attempt fails, the central station may automatically to attempt to select each of the toy vehicles in sequence until one such vehicle has been selected. When the mode switch of the pad of a vehicle that is already selected is set in the control sharing mode, the vehicle may be automatically selected by the de-selected pad.

When a vehicle has received no packets of data addressed to it for a particular time, the vehicle may enter a powered, but inactive state. The receiver of the vehicle may remain in the powered, but inactive state until it receives at least two identical commands addressed to the particular vehicle.

A novel aspect of the present invention is the wiring and programmable logic device used to couple the pad to the central station. All of the signals transmitted by the pads and central station between the pads and central station are transmitted over only three wires. The particular arrangement of wires allows all of the pads connected to the central station to be interrogated either simultaneously or sequentially, and for signals to be sent to the pads by the central station selectively. The programmable logic in the pads includes shift registers for shifting the status of switch closures to the central station over the three wires, and also for shifting signals received from the central station to a bank of light emitting diodes to update the status of the light emitting diodes.

In another aspect of the invention, the central station includes a smart port. In this arrangement, all of the signals from the pads may be routed through the smart port to an accessory connected to the smart port by a cable. In one embodiment, this accessory may be another central station, such that the second central station is a slave to the first central station to increase the number of pads controlling the vehicles. In another embodiment, this accessory may operate upon the signals received through the smart port before returning the altered signals to the central station to be transmitted to the vehicles. In this manner, the actions of one or more, and also all, of the switches of the pads may be reprogrammed to cause the vehicle or other toy selected by the pad to carry out actions different from the actions normally controlled by the pads. This allows for future upgrading of the toy vehicles or the use of other radio controlled toys, including changing the game environment to include other types of competitive or co-operative play, such as a hockey game without replacing the central station.

In another aspect of the invention, when one of the switches controlling the motion of one or more of the motors of a selected vehicle is actuated for a particular time, the motor will be controlled at a first speed upon actuation of the switch, and then at a second speed if the actuation exceeds the particular time. Actuating the switch even longer may energize the motor to run at a third speed. If another of the motors of the vehicle are energized by actuating a switch on the pad, the other motor will start up at the same speed as the motor that is already energized.

In another aspect of the present invention, the motors of the vehicle may be driven by pulse wave modulated signals for a particular duty cycle. When such a motor is first energized, the pulse width modulation signal is asserted during a first portion of the duty cycle. This ensures that switch actuations on the pad to control the motion of the vehicle selected by the pad will be effectuated as rapidly as possible, thus enhancing the ability of a user to control the vehicle in tight positions.

In still another aspect of the present invention, the central station prioritizes the transmission of packets to the vehicles to reduce lag time between switch actuation and vehicle motion. In this aspect, the central station continuously and sequentially transmits packets to all of the vehicles, including packets having no signals. This stream of packets is interpreted by the receivers of the vehicle as representing a powered on state for the central station, even if no signals to control any of the motors of any of the vehicles is included in the packets. When a switch is actuated on a pad, the central station forms a packet of data to be transmitted to the vehicle representative of the state of the switch closures of such pad. This packet is inserted into the stream of continuously transmitted packets at the earliest possible time, even if the packet is inserted out of sequential order.

These and other features and advantages of the invention will become apparent from the following detailed description when taken in conjunction with the accompanying exemplary drawings.

BRIEF DESCRIPTION OF THE DRAWINGS

FIG. 3 is a schematic diagram, primarily in block form of the different features included in a central station included in the system shown in FIG. 1;

FIG. 9 is a schematic diagram illustrating timing and transition of signals within the programmable logic device of FIG. 8;

DESCRIPTION OF THE PREFERRED EMBODIMENTS

The drawings will now be described in more detail, wherein like referenced numerals refer to like or corresponding elements among the several drawings. Moreover, reference may be made to United States patent applications Ser. No. 08/580,753, Ser. No. 08/763,678 and Ser. No. 08/696,263, which are hereby incorporated in their entirety.

Figure 1:
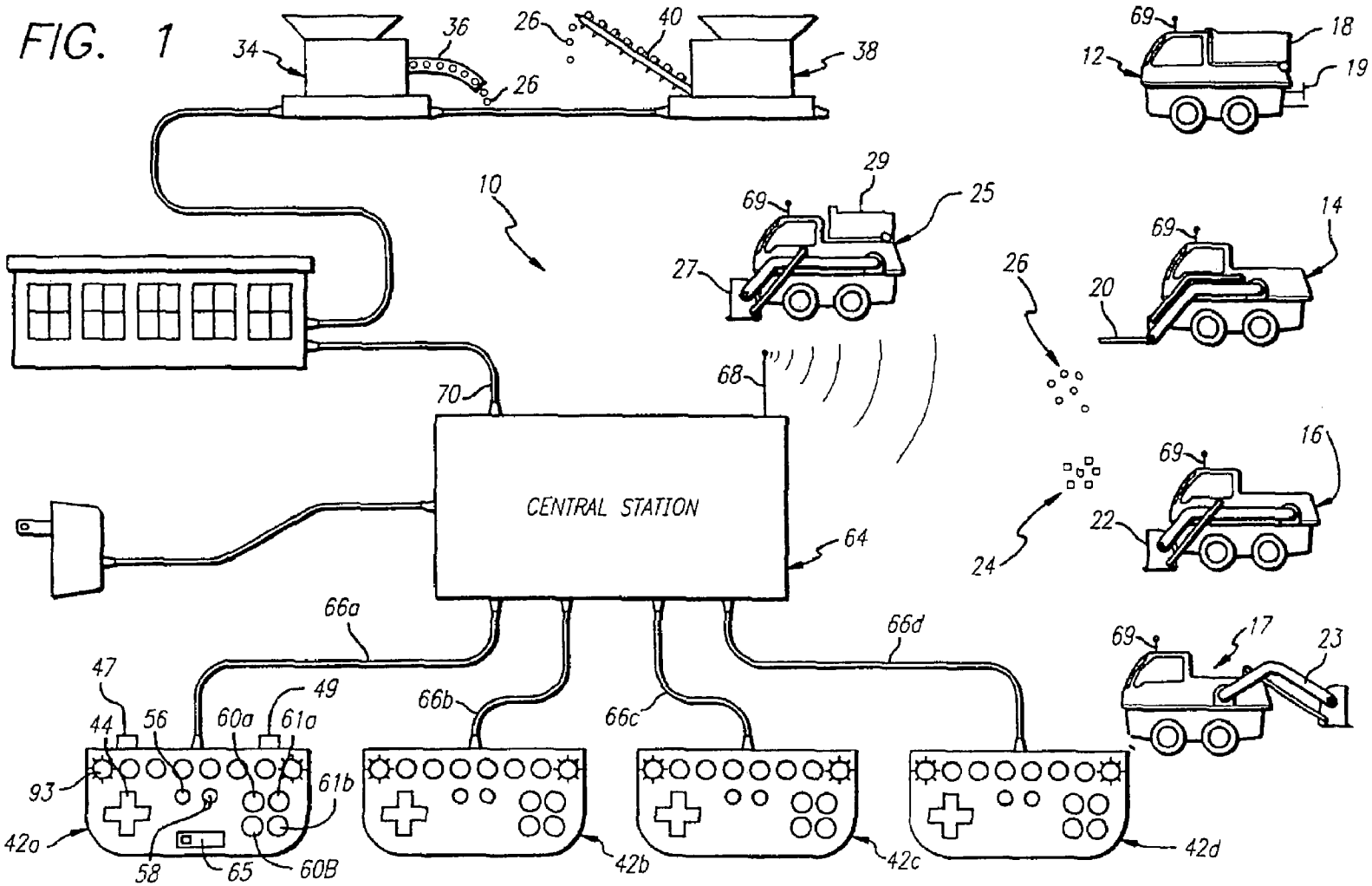
FIG. 1 is a schematic diagram, primarily in block form, of a system constituting one embodiment of the invention.

Referring now to FIG. 1, one embodiment of a system 10 is generally depicted for controlling the selection and operation of a plurality of toy vehicles. Illustrative examples of toy vehicles constitute a dump truck generally indicated at 12, a fork lift generally indicated at 14, a skip loader generally indicated at 16 and another form of skip loader generally indicated at 17. The toy vehicles such as the dump truck 12, the fork lift 14 and the skip loaders 16 and 17 are simplified versions of commercial units performing function similar to those performed by the toy vehicles 12, 14, 16 and 17. For example, the dump truck 12 may include a working or transport member such as a pivotable bin or container 18; the fork lift 14 may include a working or transport member such as a pivotable platform or grasping arm 20; the skip loader 16 may include a working or transport member such as a pivotable bin or container 22 disposed at the front end of the skip loader; and the skip loader 17 may include a working or transport member such as a pivotable bin or container 23 disposed at the rear end of the skip loader. The working or transport members such as the pivotable bin or container 18, the pivotable platform 20 and the pivotable bins or containers 22 and 23 are constructed to carry storable and/or transportable elements such as blocks 24 or marbles 26 shown schematically in FIG. 1.

It will be understood that the toy vehicles 12, 14, 16 and 17 are for illustration purposes only, and a variety of alternative forms are possible. Such alternative forms may be, for example only, and not limited to, various combinations of features. For example, a transport member such as the pivotable bin or container 22, here shown as a scoop 27, such as is disposed at the front end of the skip loader 16 may alternatively be disposed at the front end of a dump truck 25 such that the transport member or scoop 27 may pick up and/or transport storable and/or transportable elements and/or drop the storable and/or transportable elements into the pivotable bin or container 29 of the dump truck 25.

Each of the toy vehicles 12, 14, 16, 17 and 25 may also have a trailer hitch 19 mounted on the front or rear of the vehicle for hooking a hitch member of another vehicle, such as a trailer (not shown) to the hitch 19 of the vehicles 12, 14, 16, 17 and 25. The trailer hitch 19 may be remotely controlled in similar fashion to the working or transport member of the toy vehicle. Alternatively, the trailer hitch may be mechanically interconnected with the working or transport member such that remote control of the working or transport member also controls the trailer hitch 19.

Each of the dump trucks 12 and 25, the fork lift 14 and the skip loaders 16 and 17 may include a plurality of motors. For example, the dump truck 12 may include a pair of reversible motors 28 and 30 (FIG. 4) operable to move the dump truck forwardly, rearwardly, to the right and to the left. The motor 28 controls the movement of the front and rear left wheels and the motor 30 controls the movement of the front and rear right wheels.

When the motors 28 and 30 are simultaneously operated in one direction, the dump truck 12 moves forwardly. The vehicle 12 moves rearwardly when the motors 28 and 30 are moved in the opposite direction. The vehicle 12 turns toward the right when the motor 30 is operated without simultaneous operation of the motor 28. The vehicle 12 turns toward the right when the motor 28 is operated without a simultaneous operation of the motor 30.

The vehicle 12 spins to the right when the motor 30 operates to move the vehicle forwardly at the same time that the motor 28 operates to move the vehicle rearwardly. The vehicle 12 spins to the left when the motors 28, 30 are operated in directions opposite to the operations of the motors in spinning the vehicle to the right.

Another reversible motor 32 in the dump truck 12 operates in one direction to pivot the bin 18 upwardly and in the other direction to pivot the bin downwardly. Alternatively, in the embodiment of the dump truck having a scoop 27 disposed at the front of the dump truck 25, the reversible motor 32 operates to lift the scoop 27 upwardly and then rearwardly to lift, transport, and then spill the contents of the scoop 27 into the pivotable bin or container 29 of the dump truck 25. Continued rotation of the motor 32 may also operate to then pivot the bin 29 upwardly to spill the contents of the bin 29 out of the rear of the bin 29. In yet another embodiment, continued rotation of the motor 32 may cause the trailer hitch 19 to open. When the motor 32 is operated in the other direction, the trailer hitch 19 closes, the bin 29 pivots downwardly, and the scoop 27 pivots forwardly and downwardly. An additional motor 33 may operate in one direction to turn the bin 29 to the left and in the other direction to turn the bin 29 to the right.

The construction of the motors 28, 30 32 and 33 and the disposition of the motors in the dump trucks 12 and 25 to operate the dump trucks are considered to be well known in the art. The fork lift 14 and the skip loaders 16 and 17 may include motors corresponding to those described above for the dump trucks 12 and 25.

The system 10 may also include stationary plants or accessories. For example, the system 10 may include a pumping station generally indicated at 34 (FIG. 1) for pumping elements such as the marbles 26 through a conduit 36. The system may also include a conveyor generally indicated at 38 for moving the elements such as the marbles 26 upwardly on a ramp 40. When the marbles 26 reach the top of the ramp 40, the elements such as the marbles 26 may fall into the bin 18 in the dump truck 12 or into the bin 22 in the skip loader 16. For the purposes of this application, the construction of the pumping station 34 and the conveyor 38 may be considered to be within the purview of a person of ordinary skill in the art.

The system 10 may also include a plurality of hand-held pads generally indicated at 42*a*, 42*b*, 42*c* and 42*d* (FIG. 1). Each of the pads 42*a*, 42*b*, 42*c* and 42*d* may have substantially identical construction. Each of the pads may include a plurality of actuatable buttons. For example, each of the pads may include a 4-way button 44 in the shape of a cross. Each of the different segments in the button 44 is connected to an individual one of a plurality of switches 46, 48, 50 and 52 in FIG. 2.

When the button 44 is depressed at the segment at the top of the button, the switch 46 is closed to obtain the operation of motor 28 and 30 (FIG. 4) in moving the selected one of the vehicle 12 forwardly. Similarly, when the segment at the bottom of the button 44 is depressed, the switch 48 is closed to obtain the operation of motors 28 and 30 (FIG. 4) in moving the vehicle 12 rearwardly. The selective depression of the right and left segments of the button 44 cause the motors 28 and 30 to operate in tuning the selected vehicle toward the right and the left.

It will be appreciated that pairs of segments of the button 44 may be simultaneously depressed. For example, the top and left portions of the button 44 may be simultaneously depressed to obtain a simultaneous movement of the vehicle 12 forwardly and to the left. However, a simultaneous actuation of the top and bottom segments of the button 44 will not have any effect since they represent contradictory commands This is also true of a simultaneous depression of the left and right segments of the button 44.

Figure 2:
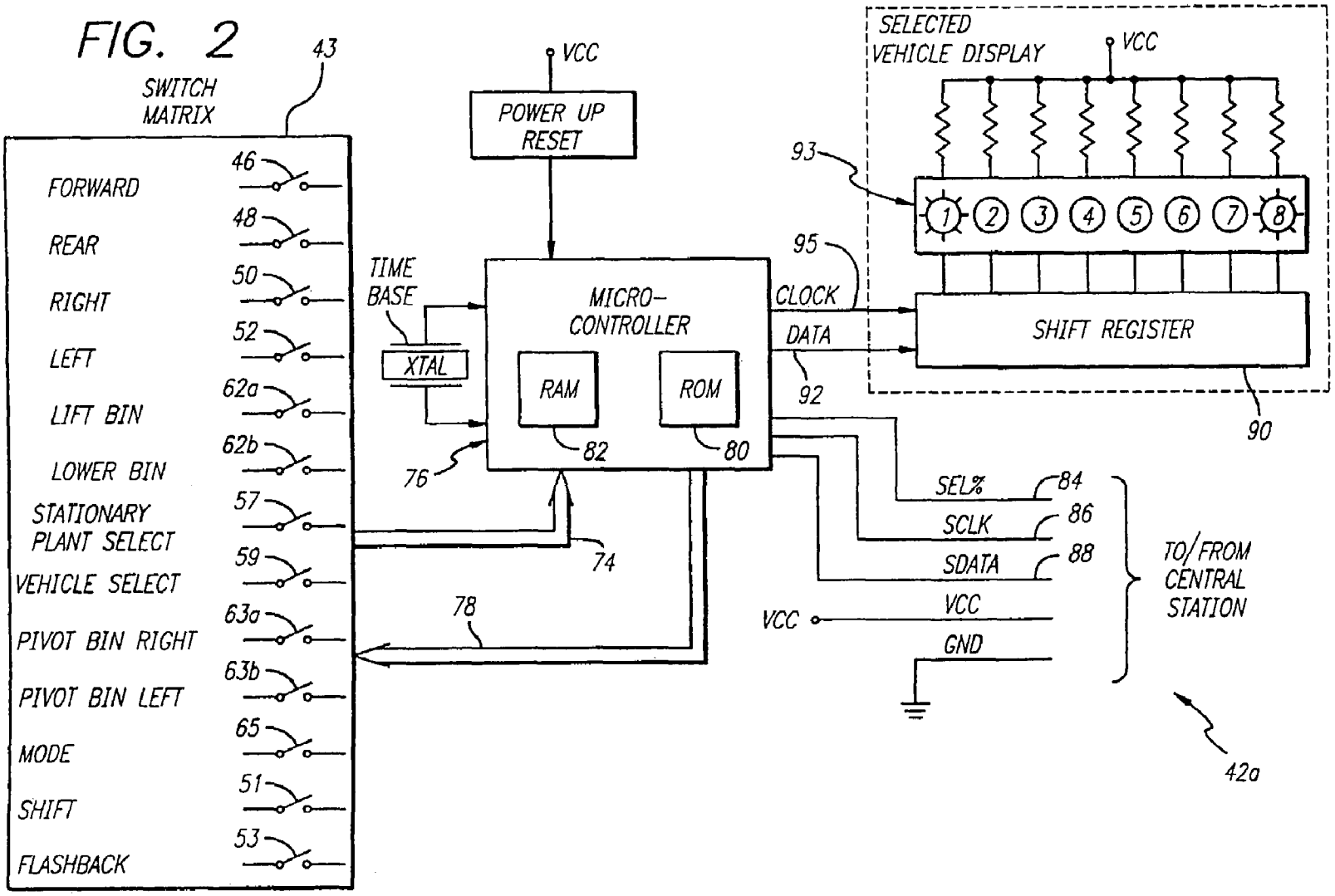
FIG. 2 is a schematic diagram, primarily in block form, of the different features in a pad included in the system shown in FIG. 1.

Each of the pads 42*a*, 42*b*, 42*c* and 42*d* may include a button 56 (FIG. 1) which is connected to a switch 57 (FIG. 2). Successive depressions of the button 56 on one of the pads within a particular period of time cause different ones of the stationary accessories or plants such as the pumping station 34 and the conveyor 38 to be energized. For example, a first depression of the button 56 in one of the pads 42*a*, 42*b*, 42*c* and 42*d* may cause the pumping station 34 to be energized and a second depression of the button 56 within the particular period of time in such pad may cause the conveyor 38 to be energized. When other stationary accessories are include in the system 10, each may be individually energized by depressing the button 56 a selective number of times within the particular period of time. When the button 56 is depressed twice within the particular period of time, the energizing of the pumping station 34 is released and the conveyor 38 is energy. This energizing of a selective one of the stationary accessories occurs at the end of the particular period of time.

A button 58 is provided in each of the pads 42*a*, 42*b*, 42*c* and 42*d* to select one of the vehicles 12, 14, 16 and 17. The individual one of the vehicles 12, 14, 16 and 17 selected at any instant by each of the pads 42*a*, 42*b*, 42*c* and 42*d* is dependent upon the number of times that the button is depressed in that pad within a particular period of time. For example, one depression of the button 58 may cause the dump truck 12 to be selected and two sequential selections of the button 58 within the particular period of time may cause the fork lift 14 to be selected.

Every time that the button 58 is actuated or depressed within the particular period of time, a switch 59 (in FIG. 2) is closed. The particular period of time for depressing the button 58 may have the same duration as, or a different time than, the particular period of time for depressing the button 56. An adder is included in the pad 42 to count the number of depressions of the button 58 within the particular period of time. This count is converted into a plurality of binary signals indicating the count. The count is provided at the end of the particular period of time. Each individual count provides for a selection of a different one of the vehicles 12, 14, 16, 17 and 25. The count representative of the selection of one of the vehicles 12, 14, 16, 17 and 25 may be maintained in a memory, which may be located either in the pads 42*a*, 42*b*, 42*c* and 42*d*, or in the central station 64.

Buttons 60*a* and 60*b* are also included on each of the pads 42*a*, 42*b*, 42*c* and 42*d*. When depressed, the buttons 60*a* and 60*b* respectively close switches 62*a* and 62*b* in FIG. 2. The closure of the switch 62*a* is instrumental in producing an operation of the motor 32 in a direction to lift the bin 18 in the dump truck 12 when the dump truck has been selected by the proper number of depressions of the button 58. In like manner, when the dump truck has been selected by the proper number of depressions of the switch 58, the closure of the switch 62*b* causes the selective one of the bin 18 in the dump truck 12, the platform 20 in the fork lift 14 and the bin 22 in the skip loader 16 and the bin 23 in the skip loader 17 to move downwardly as a result of the operation of the motor 32 in the reverse direction. Similarly, where the dump 25 includes a scoop 27, actuation of switch 62*a* operates motor 32 in a direction to lift the scoop 27 upwardly and then rearwardly, and, where the scoop 27 and the bin 29 are interconnected, cases the bin 29 to pivot upwardly. In like manner, actuation of the switch 62*b* causes the bin 29 to move downwardly, and the scoop 27 to move forwardly and downwardly as a result of the operation of the motor 32 in the reverse direction.

It will be appreciated that other controls may be included in each of the pads 42*a*, 42*b*, 42*c* and 42*d*. For example, buttons 61*a* and 61*b* may be included in each of the pads 42*a*, 42*b*, 42*c* and 42*d* to pivot the bin 18 to the right or left when the vehicle 12 has been selected. Such movements facilitate the ability of the bin 18 to scoop elements such as blocks 24 and marbles 26 upwardly from the floor or ground or from any other position and to subsequently deposit such elements on the floor or ground or any other position. It will be appreciated that different combinations of buttons may be actuated simultaneously to produce different combinations of motions. For example, a bin in a selected one of the vehicles may be moved at the same time that the selected one of the vehicles is moved.

Switch 65 is provided in the pads 42*a*, 42*b*, 42*c* and 42*d* to select the mode of control sharing among the pads 42*a*, 42*b*, 42*c* and 42*d*. As will be described more fully below, when switch 65 is positioned in a first position to set, for example, pad 42*a* in a first mode, the toy vehicle that is selected and energized by the pad 42*a* may be controlled only by actuating the buttons on the pad 42*a*. No other pad, such as pads 42*b*, 42*c* or 42*d* may control the operation of the vehicle selected by pad 42*a*. If, however, the operator of pad 42*a* sets pad 42*a* in a second mode by switching switch 65 to a second position, the toy vehicle, for example dump truck 12 controlled by pad 42*a* may also be controlled by any or all of pads 42*b*, 42*c* or 42*d*. In this manner, the operator using pad 42*a* may grant the operators of any or all of pads 42*b*, 42*c* or 42*b* the ability to control the toy vehicle selected by 42*a*. The operator of pad 42*a*, however, may not control any toy vehicle selected by any other of pads 42*b*, 42*c* or 42*d* unless such other one, or all, of those pads is also set in the second mode by positioning the switch 65 of a particular pad in the second position.

Buttons 47 and 49 are also included on each of the pads 42*a*, 42*b*, 42*c* and 42*d*. When depressed, the button 47 closes switch 53 and button 49 closes switch 51. The functions of switches 51 and 53 will be described more fully below.

A central station generally indicated at 64 in the FIG. 1 processes the signals from the individual ones of the pads 42*a*, 42*b*, 42*c* and 42*d* and sends the processed signals to the vehicles 12, 14, 16, 17 and 25 when the button 58 on an individual one of the pads has been depressed to indicate that the information from the individual ones of the pads is to be sent to the vehicles. The transmission may be on a wireless basis from an antenna 68 (FIG. 1) in the central station to antennas 69 on the vehicles.

The transmission may be in packets of signals. This transmission causes the selected ones of the vehicles 12, 14, 16, 17 and 25 to perform individual ones of the functions directed by the depression of the different buttons on the individual ones of the pads. When the commands from the individual ones of the pads 42*a*, 42*b*, 42*c* and 42*d* are to pass to the stationary accessories 34 and 38 as a result of the depression of the buttons 56 on the individual ones of the pads, the central station processes the commands and sends signals through cables 70 to the selected ones of the stationary accessories.

FIG. 2 shows the construction of the pad 42*a* in additional detail. It will be appreciated that each of the pads 42*b*, 42*c* and 42*d* may be constructed in a substantially identical manner to that shown in FIG. 2. As shown in FIG. 2, the pad 42*a* includes the switches 46, 48, 50 and 52 and the switches 51, 53, 57, 59, 62*a*, 62*b*, 63*a*, 63*b* and 65. Buses 74 are shown as directing indications from the switches 46, 48, 50, 51, 52, 53, 57, 59, 62*a*, 62*b*, 63*a*, 63*b* and 65 to a microcontroller generally indicated at 76 in FIG. 2. Buses 78 are shown for directing signals from the microcontroller 76 to the switches.

The microcontroller 76 is shown as including a read only memory (ROM) 80 and a random access memory (RAM) 82. Such a microcontroller may be considered to be standard in the computing industry. However, the programming in the microcontroller and the information stored in the read only memory 80 and the random access memory 82 are individual to his invention.

The read only memory 80 stores permanent information and the random access memory stores volatile (or impermanent) information. For example, the read only memory 80 may store the sequence in which the different switches in the pad 42*a* provide indications of whether or not they have been closed. The random access memory 82 may receive this sequence from the read only memory 80 and may store indications of whether or not the switches in the particular sequence have been closed for each individual one of the pads 42*a*, 42*b*, 42*c* and 42*d*.

The pads 42*a*, 42*b*, 42*c* and 42*d* are respectively connected to the central station 64 by cables 66*a*, 66*b*, 66*c* and 66*d* (FIG. 1). These cables have, for example, five conductors or lines encased within an exterior protective sheath. It will be apparent that the structure of cables 66*a*, 66*b*, 66*c* and 66*d*, and the functions of that structure, are identical for each of the cables 66*a*, 66*b*, 66*c* and 66*d*. Thus, only the cable 66*a*, and its operation in conjunction with pad 42*a* and the central station 64, will be described.

The central station provides a clock signal, SCLK to the pad 42*a* over line 86 of cable 66*a*. A second line, line 84, in cable 66*a*, carries interrogation signals from the central station 64 to the pad 42*a*. The pad 42*a* transmits signals over line 88 (SDATA) of cable 66*a* to the central station 64 in response to a combination of the interrogation signal transmitted by the central station 64 to the pad 42*a* over line 84 and the clock signal transmitted to the pad 42*a* by the central station 64 over line 86. Thus, only three lines in each one of cables 66*a*, 66*b*, 66*c* and 66*c* are used for interrogation of the pad 42*a* and communication of data by the pad 42*a* to the central station 64. A more detailed description of the interrogation and data transmission process will be provided below.

A fourth line in cable 66*a* provides electrical power to the pad 42*a* from the central station 64. A fifth line in cable 66*a* serves as a common ground connection between the pad 42*a* and the central station 64.

The pad 42*a* in FIG. 2 receives the interrogating signals from the central station 64 through line 84. These interrogating signals are not synchronized by clock signals on line 86. Each of the interrogating signals intended for the pad 42*a* may be identified by an address individual to such pad. When the pad 42*a* receives such interrogating signals, it sends to the central station 64 through line 88 a sequence of signals indicating the status of the successive ones of the switches 46 48, 50 and 52 and the switches 51, 53, 57, 59 62*a*, 62*b*, 63*a*, 63*b* and 65. These signals are synchronized by the clock signals on the line 86. It will be appreciated that the status of each of the switches 57 and 59 probably is the first to be provided in the sequence since these signals indicate the selection of the stationary accessories 34 and 38 and the selection of the vehicles 12, 14, 16, 17 and 25.

The pads 42*a*, 42*b*, 42*c* and 42*d* include an array of a plurality of light emitting diodes (LED) generally indicated at 93. These light emitting diodes 93 provide a visual indication of which one of the vehicles 12, 14, 16, 17 and 25 has been selected by the operator of a particular pad. The pads 42*a*, 42*b*, 42*c* and 42*d* may be connected to the central station 64 by plugging the end of the respective one of cables 66*a*, 66*b*, 66*c* and 66*d* into one of the ports on the central station 64 provided for that purpose. When the power is provided to the central station 64 and the system 10 is turned on, the start up state of the system 10 is such that none of the vehicles 12, 14, 16, 17 and 25 is selected by any of the pads 42*a*, 42*b*, 42*c* and 42*d*. Accordingly, the array of light emitting diodes 93 on each of the pads 42*a*, 42*b*, 42*c* and 42*d* may provide an indication on each pad that no vehicle has been selected by the operator of that pad. Such an indication may be, for example, providing a signal to the first individual light emitting diode 93 in the array for a predetermined period of time to light the light emitting diode 93, removing the signal, causing the lighted light emitting diode to be extinguished, and then providing the signal to the next individual light emitting diode 93 in the array. This process is continued, lighting each of the individual light emitting diodes 93 in turn until all of the light emitting diodes have been illuminated or until button 58 has been depressed, actuating switch 59 to select one of the vehicles 12, 14, 16, 17 and 25. If all of the light emitting diodes 93 in the array have been illuminated, and the button 58 has not been depressed by the operator, the first light emitting diode 93 in the array will again be illuminated, followed by the second light emitting diode, and so on as described above.

It may also happen that the system 10 is in use by one or more operators at the time an additional operator desires to also use, the system, but not all of the pads 42*a*, 42*b*, 42*c* and 42*d* are connected to the central station 64. Thus, one of the pads 42*a*, 42*b*, 42*c* and 42*d* may need to be second to the central station while the system 10 is in use to accommodate the additional operator. One advantage of the present invention is that an additional one or more of the pads 42*a*, 42*b*, 42*c* and 42*d* may be connected to the central station 64 while the system 10 is in use without powering down the system 10. The central station 64 is capable of detecting the additional one or more of the pads 42*a*, 42*b*, 42*c* and 42*d* when it is connected to the central station 64, initialize the newly connected one or more of the pads 42*a*, 42*b*, 42*c* and 42*d*, and cause the light emitting diodes 93 of the newly connected pad to indicate that none of the vehicles 12, 14, 16, 17 and 25 have been selected by the newly connected pad.

Alternatively, an operator may disconnect one of the pads 42*a*, 42*b*, 42*c* and 42*d* from the central station 64 while the system 10 is in use and others of the pads 42*a*, 42*b*, 42*c* and 42*d* are being used. When the pad is disconnected, the central station 64 automatically detects that the pad is disconnected and transmits a signal to the vehicle selected by the disconnected pad causing the vehicle to indicate that it is now available for selection by another one of the pads 42*a*, 42*b*, 42*c* and 42*d* that remain connected to the central station 64. When a vehicle is being controlled by more than one pad, such as when one of the pads controlling the vehicle is in the second mode as described previously, disconnection of one of the pads will not affect the control of the vehicle by the remaining, connected pad.

As previously indicated, the pad 42*a* selects one of the vehicles 12, 14, 16, 17 and 25 in accordance with the number of closings of the switch 59. As the user of the pad 42*a* provides successive actuations or depressions of the button 58, signals are introduced to a shift register 90 through a line 92 to indicate which one of the vehicles 12, 14, 16, 17 and 25 would be selected if there were no further depressions of the button. Each one of the depressions of the button 58 causes the indication to be shifted to the right in the shift register 90. Such an indication is provided on an individual one of the plurality of light emitting diodes (LED) 93. The shifting of the indication in the shift register 90 may be synchronized with a clock signal on a line 95. Thus, the illuminated one of the light emitting diodes 93 at each instant indicates at that instant the individual one of the vehicles 12, 14, 16, 17 and 25 that the pad 42*a* has selected at such instant The central station 64 is shown in additional detail in FIG. 3. It includes a microcontroller generally indicated at 94 having a read only memory (ROM) 96 and a random access memory (RAM) 98. As with the memories in the microcontroller 76 in the pad 42*a*, the read only memory 96 stores permanent information and the random access memory 98 stores volatile (or impermanent) information. For example, the read only memory 96 sequentially selects successive ones of the pads 42*a*, 42*b*, 42*c* and 42*d* to be interrogated on a cyclic basis. The read only memory 96 also stores a plurality of addresses each individual to a different one of the vehicles 12, 14, 16, 17 and 25.

Since the read only memory 96 knows which one of the pads 42*a*, 42*b*, 42*c* and 42*d* is being interrogated at each instant, it knows the individual one of the pads responding at that instant to such interrogation. The read only memory 96 can provide this information to the microcontroller 94 when the microcontroller provides for the transmittal of information to the vehicles 12, 14, 16, 17 and 25. Alternatively, the microcontroller 76 in the pad 42*a* can provide an address indicating the pad 42*a* when the microcontroller sends the binary signals relating to the status of the switches 46, 48, 50 and 52 and the switches 51, 53, 57, 59, 62*a*, 62*b*, 63*a*, 63*b* and 65 to the central station 64.

As an example of the information stored in the random access memory 98 in FIG. 3, the memory stores information relating to each pairing between an individual one of the pads 42*a*, 42*b*, 42*c* and 42*d* and a selective one of the vehicles 12, 14, 16, 17 and 25 in FIG. 1 and between each individual one of such pads and a selective one of the stationary accessories 34 and 38. The random access memory 98 also stores the status of the operation of the switches 46, 48, 50 and 52 for each pad and the operation of the switches 51, 53, 57, 59, 62*a*, 62*b*, 63*a*, 63*b* and 65 for each pad.

When the central station 64 receives from the pad 42*a* the signals indicating the closure (or the lack of closure) of the switches 46, 48, 50 and 52 and the switches 51, 53, 57, 59, 62*a*, 62*b*, 63*a*, 63*b* and 65, the central station retrieves from the read only memory 96 the address of the individual one of the vehicles indicated by the closures of the switch 59 in the pad. The central station may also retrieve the address of the pad 42*a* from the read only memory 96.

The central station 64 then formulates in binary form a composite address identifying the pad 42*a* and the selected one of the vehicles 12, 14, 16, 17 and 25 and stores this composite address in the random access memory 98. The central station 64 then provides a packet or sequence of signals in binary form including the composite address and including the status of the opening and closing of each of the switches in the pad 42*a* This packet or sequence indicates in binary form the status of the closure of each of the switches 46, 48, 50 and 52 and the switches 51, 53, 57, 59, 62*a*, 62*b*, 63*a*, 63*b* and 65.

Each packet of information including the composite addresses and the switch closure information for the pad 42*a* is introduced through a line 102 (FIG. 3) to a radio frequency transmitter 104 in the central station 64. The radio frequency transmitter 104 is enabled by a signal passing through a line 106 from the microcontroller 94.

When the radio frequency transmitter 104 receives the enabling signal on the line 106 and the address and data signals on the line 102, the antenna 68 (also shown in FIG. 1) transmits signals to all of the vehicles 12, 14, 16, 17 and 25. The signals are transmitted to the vehicles 12, 14, 16, 17 and 25 at the same frequency. In a preferred embodiment, the microcontroller 94 provides enabling signals to the radio frequency transmitter 104 causing the radio frequency transmitter 104 to transit a continuous stream of packets 200 through the antenna 68 at all times that the central station 64 is powered up, including when none of the pads 42*a*, 42*b*, 42*c* and 42*d* has selected any of the vehicles 12, 14, 16, 17 and 25. However, the individual one of the vehicles 12, 14, 16, 17 and 25 will only respond to packets of signals from the central station 64 having the address associated with that vehicle.

Figure 5:
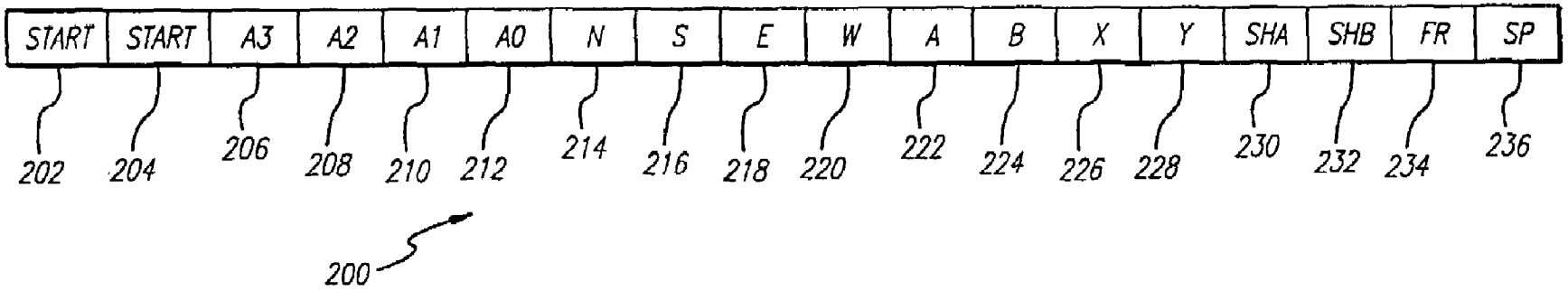
FIG. 5 is a block diagram illustrating an arrangement of binary bits within a packet transmitted by the radio frequency transmitter of FIG. 2.

Referring now to FIG. 5, a typical packet or sequence 200 is described. As will described more fully below, the packet 200 is a sequence of signals in binary form that are transmitted by the central station 64 using radio frequencies to receivers included in each of the vehicles 12, 14, 16, 17 and 25. Each packet 200 of signals transmitted by the central station 64 includes a pair of start bits or signals 202, 204. These start bits 202, 204 are a signal that the following 16 bits of information contain commands in binary form representative of the status of the closure of each of the switches 46, 48, 50 and 52 and the switches 51, 53, 59, 62*a*, 62*b*, 63*a*, and 63*b*. Each packet 200 is thus defined by the start bits 202, 204, and includes all of the bits beginning with the first start bit 202 and terminating with the sixteenth and last data bit. The packet thus contains a total of eighteen bits. The packets are transmitted continuously by the radio frequency transmitter 104 while the central station is tuned on. The first start bit 202 is transmitted immediately after the transmission of the sixteenth data bit. There is no time interval between the end of one packet and the beginning of the next packet transmitted.

One possible sequencing of the binary signals comprising the packet 200 is depicted in FIG. 5. The first four bits of binary information following the start bits 202 and 204, bits 206, 208, 210 and 212, form a composite address identifying the selected one of the vehicles 12, 14, 16, 17 and 25. The four bits of binary information may be either a binary 1 or a binary 0. Thus, in the embodiment of the invention using four bits 206, 208, 210 and 212 to compose unique vehicle addresses, sixteen unique combinations of binary information that may be used to identify as many as sixteen individual vehicles are possible.

Following the identification bits 206, 208, 210 and 212 are 11 bits of binary information that reflect the status of switch closures on the pad 42*a* For example, when switch 46 is closed by an operator depressing button 44 to control the selected one of the vehicles 12, 14, 16, 17 and 25 to move forward, bit 214 will be a binary 1. If the operator has released button 44, or depressed button 44 in such a manner that switch 46 is no longer closed, bit 214 will be a binary 0. Similarly, actuating button 44 to close switch 48 results in bit 216 to be a binary 1; actuating switch 50 causes bit 218 to be a binary 1; actuating switch 52 causes bit 220 to be a binary 1. Actuating button 60*a* to lift a bin, for example bin 18, closes switch 62*a* and causes the value of bit 222 to be a binary 1. Similarly, actuating button 60*b* to lower bin 18 closes switch 62*b* and causes the value of bit 224 to be a binary 1. Actuating button 61*a* to pivot bin 8 to the right, or close the grip of the fork lift 14 closes switch 63*a* and causes the value of bit 226 to be a binary 1. Actuating button 61*b* to pivot bin 18 to the left, or to open the grip of the fork lift 14 closes switch 63*b* and causes the value of bit 228 to be a binary 1.

One unique capability of the system of the present invention is the incorporation of a shift button 49. When the "shift" button 49 is depressed, actuating switch 51, in conjunction with the simultaneous depression of one of buttons 60*a*, 60*b*, 61*a* and 61*b*, the microcontroller 94 may interpret the simultaneous depressions of shift button 49 and one of the other buttons as a shifted command, and cause the value of bit 230 to be a binary 1. Similarly, simultaneous depression of button 47, closing switch 53, and any one of buttons 60*a*, 60*b*, 61*a* and 61*b* will be interpreted by the microcontroller 94 of the central station 64 as a second shifted command. The microcontroller will then set the value of bit 232 to a binary 1.

The final bit of the packet 200 is bit 236. Unlike the other data bits in the packet 200, bit 236 is reserved for use by an accessory connected to the smart port 115. This bit may be set by the microcontroller in an accessory connected to the smart port 115 to control the microcontroller 94 of the central station 64 to cause an action to take place, such as energizing a sound board to simulate, for example, the firing of a gun or the sounding of a train whistle or a truck horn. As will be more fully described below, various accessories or another central station 64*b* may be connected to the central station 64 through the smart port or adaptor 115. These accessories or additional central station may alter the processing of the signals received from the pad 42*a* by the microcontroller 94 of the central station 64, such that the binary values of the bits of the packet 200 may be representative of commands to carry out different functions for the buttons of the pad 42*a* than have been described previously.

In its simplest embodiment, the packet 200 comprises a pair of start bits 202, 204 followed by sixteen data bits, each data bit having a value of binary 0, that are repeatedly transmitted by the radio frequency transmitter at a predetermined frequency or rate. The interval of time between successive pairs of start bits 202, 204 also determines the duration of the sixteen data bits within the packet Thus, the bit duration of each of the sixteen data bits following the start bits 202, 204 is a value equal to the interval of time between pairs of start bits 202, 204 in the stream of packets 200 divided by sixteen, the number of data bits in each packet 200.

Figure 6A:
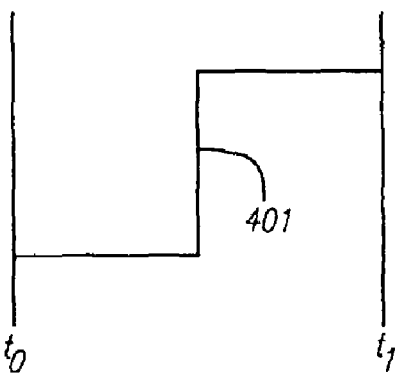
FIG. 6 is a schematic diagram illustrating a representative timing of a signal transition in (a) a bit having a value of binary 0 and (b) a bit having a value of binary 1 of bits in the packet shown in FIG. 5.
Figure 6B:
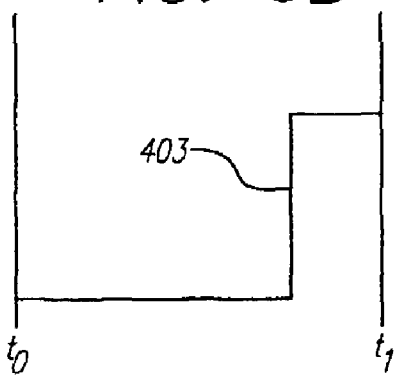

Because the output of the radio frequency transmitter 104 is RF energy, it is necessary to encode the packet of energy comprising an individual packet 200 accordingly to represent the binary values of each of the individual ones of the bits comprising the packet 200. In one encoding scheme, a binary 0 may be represented by a transition from low to high at a particular time within the bit duration. This is illustrated at 401 in FIG. 6. A binary 1 may be represented by causing the transition from high to low to take place at a different time within the bit duration. This is illustrated at 403 in FIG. 6. Similarly, the start bits 202, 204 may a transition from high to low that occurs at a specific time within the bit duration that is different from any other bit that may be transmitted by the radio frequency transmitter 104 of the central station 64. Thus, the tier 104 may form packets 200 by simply transmitting a repetitive series of high to low transitions, substituting a pair of start bits 202, 204 for the high to low transitions at a frequency equal to the packet duration.

The microcontroller 94 stores in the random access memory 98 the individual ones of the vehicles such as the vehicles 12, 14, 16, 17 and 25 being energized at each instant by the individual ones of the pads 42*a*, 42*b*, 42*c* and 42*d*.

Because of this, the central station 64 is able to prevent the interrogated one of the pads 42*a*, 42*b*, 42*c* and 42*d* from selecting one of the energized vehicles when the pad 42 that had previously selected the energized vehicle has been placed in the first mode by the operator by placing switch 65 in the first position. Thus, for example, if the vehicle 14 is being energized by one of the pads 42*a*, 42*b*, 42*c* and 42*d* at a particular instant, a first depression of the button 58 in the pad being interrogated at that instant will cause the vehicle 12 to be initially selected and a second depression of the button by such pad will cause the vehicle 14 to be skipped and the vehicle 16 to be selected. It however, the operator of the pad 42 energizing a particular vehicle at a particular instant has been placed in the second mode by placing the switch 65 in the second position, a first depression of the button 58 in another pad being interrogated at that instant will cause the vehicle 12 to be initially selected, and the second depression of the button by such pad will not skip vehicle 14, but will allow the pad to control vehicle 14 in concert with the pad that first energized vehicle 14.

Furthermore, in the example above where the pad 42*a* has previously selected the vehicle 14, the microcontroller 94 in the central station 64 will cause the vehicle 14 to be released when the pad 42*a* selects any of the vehicles 12, 16, 17 and 25. Thus, while a single vehicle may be controlled by more than one of pads 42*a*, 42*b*, 42*c* and 42*d* at a particular instant, each one of pads 42*a*, 42*b*, 42*c* and 42*d* may only control one of the vehicles 12, 14, 16, 17 and 25 at a single instant. When the vehicle 14 becomes released, it becomes available immediately thereafter to be selected by any one of the pads 42*a*, 42*b*, 42*c* and 42*d*. The release of the vehicle 14 by the pad 42*a* and the coupling between the pad 42*a* and a selected one of the vehicles 12, 14, 16, 17 and 25 are recorded in the random access memory 98 in the microcontroller 94.

It is advantageous to optimize the packets transmitted by the central station 64 so that each transmitted packet contains sufficient information to provide control of the vehicles and accessories in a pleasing manner, but not so much information that troublesome lag times adversely affecting the smooth control of the vehicles are introduced. To prevent such troublesome lag times, the central station 64 uses a variety of methods to prioritize interrogation of the pads 42*a*, 42*b*, 42*c* and 42*d*, data processing and transmission of the data in packets to the vehicles 12, 14, 16 17 and 25.

In one approach, the microcontroller 94 provides packets of data for transmission to each vehicle in operation in a sequential, round-robin, fashion. In this approach, four packets of commands, each packet being associated with the binary address of each of the vehicles being controlled by individual pads 42*a*, 42*b*, 42*c* and 42*d*, are transmitted one after another until all four packets are transmitted. Thus the packet of commands addressed to a vehicle controlled by pad 42*a* may be transmitted first, followed by a packet of commands intended for the vehicle controlled by pad 42*b*, followed by a packet of commands intended for the vehicle controlled by pad 42*c* and followed by a packet of commands intended for the vehicle controlled by pad 42*d*. The sequence of packets would then be repeated. It is evident that this is just one possible sequencing of packets that may be transmitted; other sequences of packet transmission are possible, depending on the program commands stored in the read only memory 96 of the microcontroller 94.

This round-robin transmission method may require, for example, 48 milliseconds to transmit for all four packets. In the case where eight vehicles are being controlled, a transmission cycle would require, for example, 96 milliseconds, or almost 1/10th of a second for all eight packets of command data to be transmitted. Even if the vehicles are traveling at the minimum speed the motors are capable of, the first vehicle may travel perhaps several inches between transmission of packets of commands by the central station 64.

Another embodiment of the invention transits packets of data only for vehicles that have been selected by users by pressing button 58 the required number of times within the predetermined time. In this manner, only data for vehicles actually under control of a user is transmitted.

In a preferred embodiment, the random access memory 98 maintains a record of the state of each of the pads 42*a*, 42*b*, 42*c* and 42*d* and the time since the state of the pads changed. One skilled in the art will understand that the actuation of any of the buttons 44, 47, 49 56, 58 60*a*, 60*b*, 61*a*, 61*b* or 65 of the pad 42*a* results in a change in the state of the pad 42*a*. If none of the buttons of the pad 42*a* is actuated by the operator during the time between interrogations of the pad 42*a* by the central processor 64, then the state of the pad 42*a* will not have changed.

Since the state of each of the pads 42*a*, 42*b*, 42*c* and 42*d* is maintained in the random access memory 98 of the central station 64, the microcontroller 94 may further process the signals received from each of the pads 42*a*, 42*b*, 42*c* and 42*d* to determine if the state of the pad has changed even if an operator has actuated one of the buttons on the pad. For example, if an operator presses button 44 to command the vehicle energized by that pad to move forward, additional actuations of the button 44 without actuating any other of the buttons of the pad will not result in a change in the state of the pad, and a packet of commands need not be transmitted by the microcontroller 94.

As described previously, the microcontroller 94 of the central station 64 may transmit a continuous stream of packets of commands in a sequential, round-robin, fashion to the vehicles controlled by the pads 42*a*, 42*b*, 42*c* and 42*d*. The microcontroller continues to transmit this sequential stream of packets even when none of the buttons on pads 42*a*, 42*b*, 42*c* and 42*d* has been actuated.

When, however, the microcontroller 94 of the central station 64 determines that the state of one of the pads 42*a*, 42*b*, 42*c* and 42*d* has changed, it responds by forming a packet of commands representative of the state of the pad and inserting the newly formed packet of commands into the stream of packets being continuously transmitted, even if the newly formed packet is inserted at a position in the sequence of packets different from the position a packet associated with that particular pad would normally have in the round-robin sequence of packets. If buttons on two or more of the pads 42*a*, 42*b*, 42*c* and 42*d* are actuated simultaneously, the microcontroller 94 may form packets of commands representative of the state of those pads and insert the packets in the stream of packets. In this case, the microcontroller 94 may insert the newly formed packets in the order in which they would have been sent in the round-robin sequence, except that the string of newly formed packets may be inserted in the continuous round-robin sequence out of order. For example, buttons on pads 42*a* and 42*c* may be actuated simultaneously and the microcontroller may form a string of packets representative of the state of the pads 42*a* and 42*c* such that the packet associated with pad 42*a* is transmitted before the packet associated with pad 42*c*. The microcontroller 94 may then insert this string of packets in the stream of packets at the next available instance, for example, after a packet associated with pad 42*c* but which is not representative of the change of state of pad 42*c* has been transmitted. In this manner, the microcontroller 94 employs an intelligent funneling of the data provided by each of the pads 42*a*, 42*b*, 42*c* and 42*d* during the interrogation process to form packets of commands to be transmitted to each of the vehicles energized by the pads 42*a*, 42*b*, 42*c* and 42*d*.

The vehicles 12, 14, 16 and 17 are battery powered. As a result, the energy in the batteries in the vehicles 12, 14, 16 and 17 tends to become depleted as the batteries provide the energy for operating the vehicles. The batteries in the vehicles 12 and 14 are respectively indicated at 108 and 110 in FIG. 3. The batteries 108 and 110 are chargeable by the central station 64 because the central station may receive AC power from a wall socket. The batteries are charged only for a particular period of time. This particular period of time is preset in the read only memory 96. When each battery is being charged for the particular period of theme, a light 109 in a circuit with the battery becomes illuminated. The charging current to each of the batteries 108 and 110 may be limited by a resistor 111. The light 109 becomes extinguished when the battery has been charged.

The central station 64 of the present invention, as mentioned previously, includes a microcontroller 94, random access memory 98 and read only memory 96. The central station 64 also includes a smart port 115 that is connected to the microcontroller 94 by lines 505, 510, 520, 530 and 540. The signals transmitted and received by the microcontroller 94 over the SDATA0, SDATA1, SDATA2 and the SDATA3 lines to the pads 42*a*, 42*b*, 42*c* and 42*d* may be provided to an accessory connected to the smart port 115 over a cable 114. Using this configuration, all of the signals from the pads 42*a*, 42*b*, 42*c* and 42*d* may be rerouted through the smart port 115 before being processed by the microcontroller 94. One principal advantage of this configuration of the central station 64 is that various accessories, including additional central stations, may be connected to the smart port 115 and alter signals received from the pads 42*a*, 42*b*, 42*c* and 42*d* and process the signals in a different manner than they would normally be processed by the microcontroller 94. Accessories that may be attached to the smart port 115 may include additional microcontrollers 94*a* that may, for example, have information stored in a separate read only memory and random access memory that allow the second processor to remap the functions of the buttons 44, 47, 49, 56, 58, 60*a*, 60*b*, 61*a*, 61*b* and 65 on the pads 42*a*, 42*b*, 42*c* and 42*d*. For example, a signal from pad 42*a* representative of the closure of switch 46 could be routed through the smart port 115 and over the cable 114 to be processed by the accessory microcontroller 94*a*. All signals rerouted to accessories connected to the smart port 115 are returned after processing by the accessory over the cable 114 to the microcontroller 94. The microcontroller 94 then forms a packet 200 comprising data bits commanding the appropriate receiver to take action. For example, a signal from a pad may be interpreted by microcontroller 94*a* as a command to a toy hockey player to raise its arm, rather than the usual meaning for the command, such as to command a toy vehicle to move forward. The microcontroller 94*a* would then provide a signal over cable 114 to the microcontroller 94. In this manner, each of the keys of the pads 42*a*, 42*b*, 42*c* and 42*d* may be reprogrammed to have different functions. This approach is particularly advantageous in that it allows for increased flexibility and future expansion of the capabilities of the central station. Thus, the central station could control a wide variety of games and activities without the need for costly changes in hardware or reprogramming the information stored in the read only memory 96.

A particularly illustrative example of the advantages of the smart port 115 is where an additional central station 64 is connected to the first central station 64. Each central station 64 may have the capabilities of servicing only a limited number of pads. For example, each central station 64 may have the capabilities of servicing only the four (4) pads 42*a*, 42*b*, 42*c* and 42*d*. It may sometimes happen that the users of the system may wish to be able to service more than four (4) pads. Under such circumstances, the microcontroller 94 in the central station 64 and a microcontroller, generally indicated at 94*a*, in the second central station corresponding to the central station 64 may be connected by cable 114 to the smart port 115.

One end of the cable 114 may be constructed so as to connect to a ground 117 in the smart port 115. This ground operates upon the central station to which it is connected so that such central station is a slave to, or subservient to, the other central station. For example, the ground 117 in the smart port 115 may be connected to the microcomputer 94*a* so that the central station including the microcontroller 94*a* is a slave to the central station 64. When this occurs, the microcontroller 94 in the central station 64 serves as the master for processing the information relating to the four (4) pads and the four (4) vehicles in its system and the four (4) pads and the four (4) vehicles in the other system. The expanded system including the microcontrollers 94 and 94*a* may be adapted so that the address and data signals generated in the microcontroller 94*a* may be transmitted by the antenna 68 in the central station 64 when the central station 64 serves as the master station. The operation of the central station 64*a* may be clocked by the signals extending through a line 118 from the central station 64 to the adaptor 115 and through a corresponding line from the other central station to the adaptor.

Figure 10:
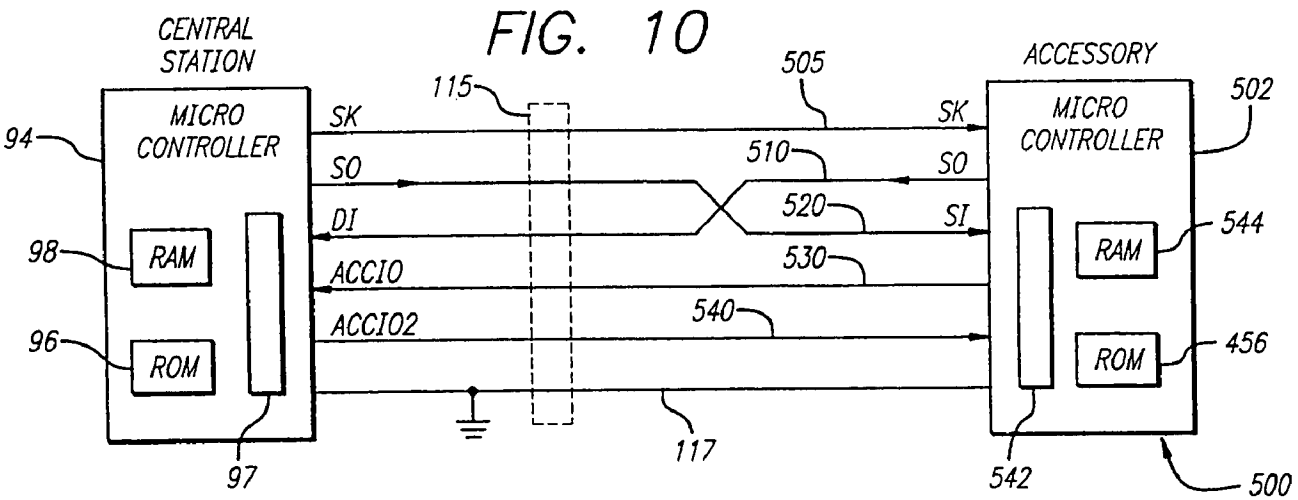
FIG. 10 is a schematic diagram, primarily in block form, of a serial interface connecting an accessory to the central station of FIG. 1.

Referring now to FIG. 10, the interface of the smart port 115 will be described in more detail. As described above, an accessory generally indicated at numeral 500 may be connected to the smart port 115 of the central station 64. The accessory 500 may include a microcontroller 502. The microcontroller 502 of the accessory 500 may also include a random access memory 544 and a read only memory 546. As with the memories in the microcontroller 94 in the central station 64, the random access memory 544 stores volatile or impermanent information and the read only memory 96 stores permanent information.

As shown in FIG. 3, the microcontroller 94 of the central station is connected to the smart port 115 using five signal lines, lines SK line 505, SO line 510, SI line 520, ACCIO line 530 and ACCIO2 line 540 and a ground line 117. The ground line 117 provides a common electrical reference for the microcontroller 94 of the central station 64 and the microcontroller 502 of the accessory 500. These lines are similarly shown in FIG. 10, but the lines are shown directly connected to the accessory 500, with the smart port 115 indicated in dashed form. It will be apparent that the smart port 115 may be only a connector mounted on the central station 64 allowing the connection of the cable 114 (FIG. 3). The cable 114 has one end connected to the accessory 500, either directly or through an appropriate connector, and the other end terminating in a connector compatible with a corresponding connector forming the smart port 115 of the central station 64.

In a preferred embodiment, each of the microcontrollers 94 and 502 includes a serial interface comprising inputs and outputs for connecting the lines 505, 510, 520, 530 and 540 and various logical elements, such as shift register 97 in the microcontroller 94 of the central station 64 and shift register 542 in the microcontroller 542 of the accessory 500. These serial interfaces enable the transfer of data between the microcontroller 94 of the central station 64 and the microcontroller 502 of the accessory 500. As used in the present invention, the serial interface of the microcontroller 94 of the central station 64 is configured as a master and provides a shift clock signal over the SK line 505 to the SK input of the microcontroller 502 in the accessory 500. Thus, the transfer of data over the serial interface to the microcontroller 502 is controlled by the microcontroller 94 of the central station.

In the present invention, as depicted in FIG. 10, the SO output of the smart port 115 is connected to the SI input of the microcontroller 502 by line 520. Similarly, the SO output from the microcontroller 502 of the accessory 500 is connected to the SI input of the microcontroller 94 of the central station 64 by line 510. In this manner, data may be shifted out of the shift register 97 of the microcontroller 94 of the central station 64 over the SO line 520 into the SI input of the microcontroller 502 into the shift register 542 of the accessory 500. Similarly, since the data transfer over the serial interface is bidirectional, as will be more fully described below, data may be shifted out of the shift register 542 of the microcontroller 502 over the SI line 510 into the SI input of the microcontroller 94 and into the shift register 97 of the central station 64. Two additional lines, ACCIO line 530 and ACCIO2 line 540 carry handshaking signals output by the microcontrollers 502 and 94 respectively, the ACCIO2 line 540 carrying signals from the microcontroller 94 to the microcontroller 502, and the ACCIO line 530 carrying signals from the microcontroller 502 to the microcontroller 94.

Figure 11:
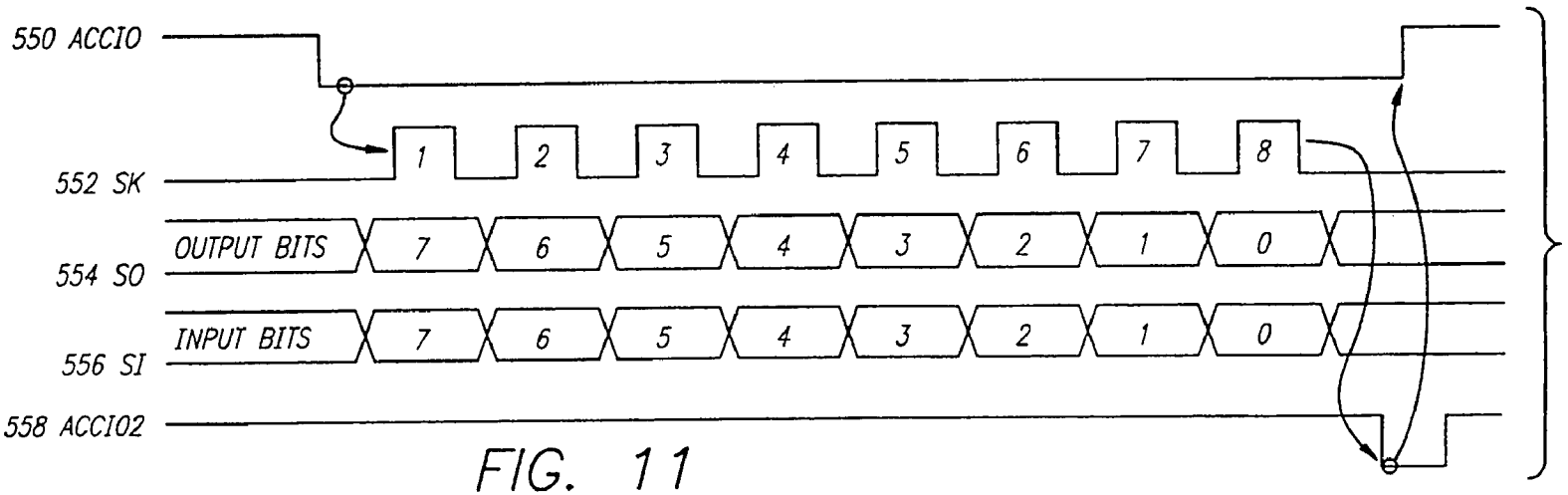
FIG. 11 is a schematic diagram illustrating timing and transition of signals within the serial interface of the FIG. 10.

Referring now to FIGS. 10 and 11, a typical timing sequence of data flow across the serial interface of the smart port 115 will be described. The microcontroller 94 in the central station 64 continuously provides the smart port 115 with signals representing the current state of the central station 64. Such signals may be, for example, signals indicating the status of switch closures in the pads 42*a*, 42*b*, 42*c*, and 42*d*, signals representative of the values of various timing function carried out by the microcontroller 94 of the central station 64, such as signals indicating how much time remains before a vehicle will be provided with a signal to enter the powered, but inactive state because there has been no thumb pad activity, or signals indicating that a vehicle will be released from particular one of the pads 42*a*, 42*b*, 42*c* and 42*d* because no switch on the particular pad has been activated for a prolonged period of time.

The microcontroller 94 monitors the state of the signal on line ACCIO 530. When the signal on line 530 is high, which may be the normal state of the signal on the line 530, the central station 64 assumes that either no accessory is connected to the smart port 115, or that the accessory 500 is a "dumb" accessory which is incapable of modifying the signals provided by the microcontroller 64 through the smart port 115. Examples of such "dumb" accessories may include devices that react to the signals provided by the central station, but do not process the signals, such as a sound device that produces a sound in response to a signal from the central station. When a "dumb" accessory, or no accessory at all, is connected to the smart port 115, the microcontroller 94 of the central station continues to process data, for example, data received from the pads 42*a*, 42*b*, 42*c* and 42*d*, in a normal mode, acting upon the data stored in the random access memory 98 and causing signals to be sent to the receivers of the various vehicles through the radio frequency transmitter 104 (FIG. 3).

The accessory may also be a so called "smart" accessory possessing the ability to process and modify the signals received from the smart port 115, and then return the modified signals to the microcontroller 94 of the central station 64 through the smart port 115. When a "smart" accessory is connected to the smart port 115, the microcontroller 94 of the central station enters a second operating mode. In this operating mode, the microcontroller is configured to receive modified data from the microcontroller 502 of the accessory 500 and store that modified data in its random access memory 98. Depending on the programmable capabilities of the microcontroller 502 of the accessory 500, all, or a selected portion, of the data stored in the random access memory 98 of the microcontroller 94 may be modified by the microcontroller 502 of the accessory 500. Additionally, when a "smart" accessory is connected to the smart port 115, the microcontroller 94 of the central station may not process any of the signals received from the pads 42*a*, 42*b*, 42*c* and 42*d*, but instead provide the signals unchanged to the at port 115 for transmission to the microcontroller 502 of the accessory 500.

The microcontroller 94 of the central station 64 detects when a smart accessory 500 is attached to the smart port 115 because the signal on line ACCIO 530 will be periodically driven low by the microcontroller 502 of the accessory 500, indicating that the accessory is ready to receive data from the microcontroller 94 of the central station 64. Once the signal on line 520 goes low, the microcontroller 94 will begin sending data to the microcontroller 502 through the smart port 115 over the SO line 520 when the microcontroller determines it has data to send to the accessory. It will be apparent that since the microcontroller 94 of the central station 64 is the master, as described above, it is the microcontroller 94 that controls the flow of data over the serial interface to the accessory 500. The microcontroller 502 of the accessory 500 may only be enabled to indicate that it is ready to receive data from the microcontroller 94 by driving the line ACCIO line low. Thus, if the microcontroller 94 has no data to send to the microcontroller 502 because, for example, no buttons on the pads 42*a*, 42*b*, 42*c* and 42*d* have been pushed, the microcontroller 502 simply waits for data to be sent.

As indicated by the timing diagram line 550 of FIG. 11, the transition of the signal level on ACCIO line 530 from high to low causes the shift register 97 of the microcontroller 94 of the central station 64 to begin shifting data bits (assuming there is data to send) out of the shift register 97 onto the SO line 520. Because the SO line 520 is connected to the shift input of the shift register 542 of the microcontroller 502 of the accessory 500, each bit shifted from the microcontroller 94 is shifted into the shift register 542 of the microcontroller 502. Because the shift registers 97 and 542 are serial input/output registers, shifting a bit of data out of the shift register 97 into the shift register 542 over the SO line 520 causes a bit to be shifted out of the shift register 542 of the microcontroller 502 onto line 530 and into the shift input of the shift register 97 of the microcontroller 94 of the central station 64.

The microcontroller 94 generates a shift clock signal, indicated as line 552 in FIG. 11. Bits are shifted out of, and thus into, the shift registers 97 and 542 in response to the transition of the shift clock signal from high to low on the SK line 505. The microcontroller 94 may be programmed to maintain a count of the number of shift clock signals provided since the first shift clock signal. When the count equals, for example, eight, indicating that eight shift clock signals have been provided to shift a total of eight bits out of the shift registers 97 and 542, the microcontroller 94 may pulse the signal on the ACCIO2 line 540 low for a brief period of time, indicating to the microcontroller 502 of the accessory 500 that the microcontroller 94 has completed sending eight bits of data over the SO line 520. When the signal on line ACCIO2 goes low, the microcontroller 502 resets the signal on the ACCIO line 540 to high, indicating to the microcontroller 94 of the central station that the microcontroller 502 is processing the data sent to it over the SO line 520 by the microcontroller 94 and is not ready at that instant to receive any additional data.

When the microcontroller 502 is again ready to receive data from the microcontroller 94, such as, for example, when microcontroller 502 has completed processing the data received from the microcontroller 94 during the previous shift cycle, the microcontroller 502 drives the signal on line ACCIO 530 low, indicating its state of readiness to the microcontroller 94 of the central station 64. At this time, if the microcontroller 94 of the central station has data to send to the microcontroller 502 of the accessory 500, the shift cycle is repeated. One advantage of this interface is that data flows to and from the microcontroller 94 of the central station 64 and to and from the microcontroller 502 of the accessory 500 simultaneously. This feature is particularly important since the routing of the signals from the central station 64 to the accessory 500, and subsequent processing of those signals by the microcontroller 502 and retransmission back to the central station 64 requires additional time, and thus may impart unacceptable delay in the response of the vehicles 12, 14, 16, 17 and 25 to actuations of buttons on the pads 42*a*, 42*b*, 42*c* and 42*d*.

Figure 4:
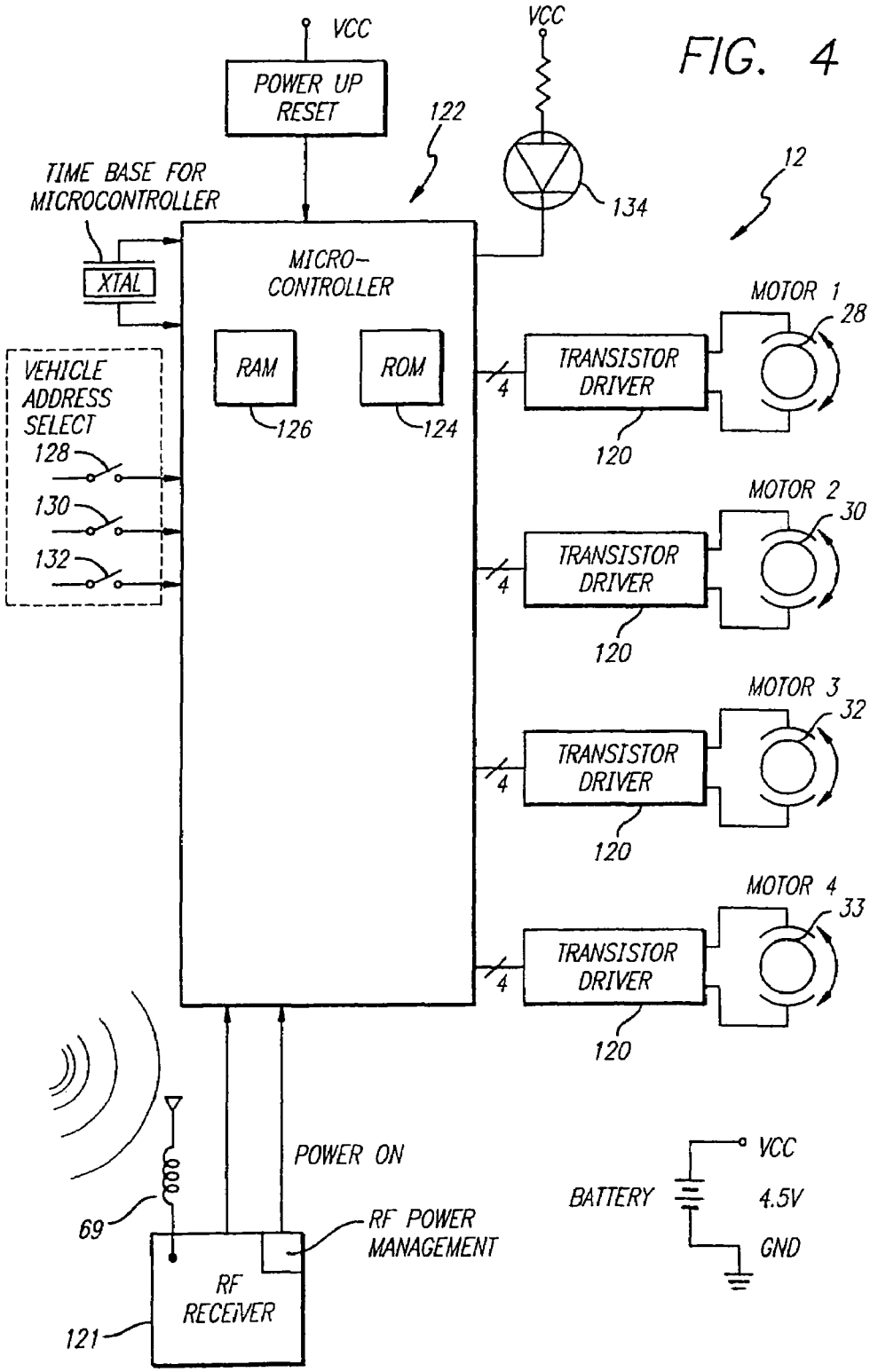
FIG. 4 is a schematic diagram, primarily in block form, of the different features in a vehicle included in the system shown in FIG. 1.

The vehicle 12 is shown in additional detail in FIG. 4. Substantially identical arrangements may be provided for the vehicles 14, 16, 17 and 25. The vehicle 12 includes the antenna 69 for receiving from the central station 64 signals with the address of the vehicle and also includes a receiver 121 for processing the received signals. The vehicle 12 also includes the motors 28, 30, 32 and 33. Each of the motors 28, 30, 32, and 33 receives signals from an individual one of the transistor drivers 120 connected to a microcontroller generally indicated at 122.

The microcontroller 122 includes a read only memory (ROM) 124 and a random access memory (RAM) 126. As with the memories in the pad 42*a* and the central station 64, the read only memory 124 may store permanent information and the random access memory 126 may store volatile (or impermanent) information. For example, the read only memory 124 may store information indicating the sequence of the successive bits of information in each packet for controlling the operation of the motors 28, 30, 32 and 33 in the vehicle 12. The random access memory 126 stores information indicating whether there is a binary 1 or a binary 0 at each successive bit in the packet.

The vehicle 12 includes a plurality of switches 128, 130 and 132. These switches are generally pre-set at the factory to indicate a particular Arabian number such as the number "5". However, the number can be modified by the user to indicate a different number if two central stations are connected together as discussed above and if both stations have vehicles identified by the numeral "5". The number can be modified by the user by changing the pattern of closure of the switches 128, 130, and 132. The pattern of closure of the switches 128, 130 and 132 controls the selection of an individual one of the vehicles such as the vehicles 12, 14, 16, 17 and 25.

The pattern of closure of the switches 128, 130, and 132 in one of the vehicles can be changed when there is only a single central station. For example, the pattern of closure of the switches 128, 130 and 132 can be changed when there is only a single central station with a vehicle identified by the numeral "5" and when another user brings to the central station, from such other user's system, another vehicle identified by the numeral "5".

The vehicle 12 also includes a light such as a light emitting diode 134. This diode is illuminated when the vehicle 12 is selected by one of the pads 42*a*, 42*b*, 42*c* and 42*d*. In this way, the other users can see that the vehicle 12 has been selected by one of the pads 42*a*, 42*b*, 42*c* and 42*d* in case one of the users (other than the one who selected the vehicle 12) wishes to select such vehicle. It will be appreciated that each of the vehicles 12, 14, 16, 17 and 25 may be generally different from the others so each vehicle may be able to perform functions different from the other vehicles. This is another way for each user to identify the individual one of the vehicles that the user has selected.

When the RF receiver 121 receives a stream of packets 200 that have been transmitted by the radio frequency transmitter 104, the microcontroller 124 must decode the received packets to determine the values of each of the bits included in the packet 200. The microcontroller 122 begins the decoding process by determining the duration between pairs of start bits 202, 204 that have been received. If the duration between pairs of start bits 202, 204 is not within a range of values stored in the read only memory 124, or if the microcontroller 122 detects only one start bit 204, the microcontroller 122 may determine that the packet 200 has been corrupted or is otherwise undecodable. The microcontroller continues to analyze the pairs of start bits 202, 204 until the duration between successive pairs of the start bits 202, 204 is within the range of values stored in the read only memory 124.

The microcontroller determines a bit duration for each of the bits contained within the packet 200 by dividing the interval of time measured between two successive pairs of start bits by six, the number of data bits in a valid packet 200. In this manner, the microcontroller 122 determines the bit duration during processing, allowing for variation in bit duration that may be caused by variations in the transmitted stream of packets, and allowing the microcontroller 122 to synchronize the analysis of the values of the bits contained within the packet 200. One advantage of determining the bit duration on the fly in this manner by analyzing the duration between pairs of start bits 202, 204 is that the microcontroller may recover from a loss of synchronization caused by corrupted packets 200 having fewer or more than sixteen bits within one packet cycle. This rapid recovery of synchronization is advantageous in that it promotes efficient use of the radio frequency bandwidth by not requiring an excessive number of packet cycles for recovery, thus preventing annoying lags in the response of the vehicle to switch closures on the pads 42*a*, 42*b*, 42*c* and 42*d*.

The capability of the microcontroller 122 to adapt to variations in the timing of the bits in the packets 200 provides the potential for future upgrades in the rate of transmission of the signals from the central station 64 while maintaining the usefulness of the microcontroller 122 in the vehicles. For example, future developments in the central station 64 may include increasing the transmission rate of the packets 200, resulting in decreased packet and bit durations. The microcontroller 122 in the vehicles 12, 14, 16, 17 and 25 may adapt to the decreased packet and bit durations because the microcontroller 122 synchronizes and decodes the packets 200 on the fly, thus ensuring that older vehicles continue to work with the upgraded central station 64.

When the received packet 200 has been decoded by the microcontroller 122, the microcontroller 122 enables a signal to the motors 28, 30, 32 and 33 according to the values of the bits in the packet 200. The microcontroller may continue to enable the signal until the signal has been enabled for a period of time equal to a value stored in the read only memory 124. For example, each motor enabling signal provided by the microcontroller 122 may be continued for 0.25 seconds, unless the microcontroller receives a command from a later received packet 200 to discontinue the motor enabling signal. One advantage of such a continuation of the enabling signal is that it promotes smooth movement of the vehicle where radio frequency noise in the operating environment results in the reception of spurious or corrupted packets 200 by the RF receiver 69. Reception of such spurious or corrupted packets 200 without the continuation of the enabling signal may result in undesired discontinuous or jerky motion of the vehicle, or a degradation of the fine control of the vehicle necessary to allow the vehicle to maneuver in close quarters. Additionally, the continuation of the enabling signal allows the microcontroller 122 to overcome periods of lower than normal operating voltage caused when one of the motors 28, 30, 32 and 33 start up and the battery charge is low. The motors 28, 30, 32 and 33 require, for example, 80 milliamperes of current to operate when they are operating at full speed. These same motors, however, may require as much as 200 milliamperes to start up when they have not been operating. Thus current requirement may cause as much as a 0.5 volt voltage drop in the operating voltage of the vehicle for a period of up to 0.1 seconds. When the battery charge is low, which may occur after prolonged use of the vehicle or when the vehicle has been idle, but the battery has not been recharged for an extended period of time, this voltage drop may be sufficient to cause the operating voltage available to power the vehicle to fall below the minimum voltage required to power the RF receiver thus momentarily preventing the reception and decoding of packets 200 of data. Continuing the enabling signal provided to the motors 28, 30, 32 and 33 by the microcontroller 122 overcomes this problem by allowing the vehicle to continue to operate until the operating voltage increases as the motor comes up to speed and the RF receiver 121 recovers.

As previously indicated, the user of one of the pads such as the pad 42*a* selects the vehicle 12 by successively depressing the button 58 a particular number of times within a particular time period. This causes the central station 64 to produce an address identifying the vehicle 12. When this occurs, the central station 64 stores information in its random access memory 98 that the pad 42*a* has selected the vehicle 12. Because of this, the user of the pad 42*a* does not thereafter have to depress the button 58 during the time that the pad 42*a* is directing commands through the station 64 to the vehicle 12. As long as the buttons on the pad 42*a* are depressed within a particular period of time to command the vehicle 12 to perform individual functions, the microcontroller 94 in the central station 64 will direct the address of the vehicle 12 to be retrieved from the read only memory 96 and to be included in the packet of the signals transmitted by the central station to the vehicle 12.

The read only memory 96 in the microcontroller 94 at the central station 64 stores information indicating a particular period of time in which the vehicle 12 has to be addressed by the pad 42*a* in order for the selective coupling between the pad and the vehicle to be maintained. The random access memory 98 in the microcontroller 94 stores the period of time from the last time that the pad 42*a* has issued a command through the central station 64 to the vehicle 12. When the period of time in the random access memory 98 equals the period of time in the read only memory 96, the microcontroller 94 will no longer direct commands from the pad 42*a* to the vehicle 12 unless the user of the pad 42*a* again depresses the button 58 the correct number of times within the particular period of time to select the vehicle 12.

The vehicle 12 also stores in the read only memory 124 indications of the particular period of time in which the vehicle 12 has to be addressed by the pad 42*a* in order for the selective coupling between the vehicle and the pad to be maintained. This period of time is the same as the period of time specified in the previous paragraph. The random access memory 126 in the microcontroller 122 stores the period of time from the last time that the pad 42*a* has issued a command to the vehicle 12.

As previously indicated, the button 58 in the pad 42*a* does not have to be actuated or depressed to issue the command after the pad 42*a* has initially issued the command by the appropriate number of depressions of the button. When the period of time stored in the random access memory 126 of the microcontroller 122 in the vehicle equals the period of time in the read only memory 124, the microcontroller 122 issues a command to extinguish the light emitting diode 134. This indicates to the different users of the system, including the user previously controlling the operation of the vehicle 12 that the vehicle is available to be selected by one of the users including the user previously directing the operation of the vehicle.

When one of the vehicles such as the vehicle 12 is being moved in the forward direction, the random access memory 126 records the period of time during which such forward movement of the vehicle 12 is continuously occurring. This period of time is continuously compared in the microcontroller 122 with a fixed period of time recorded in the read only memory 124. When the period of time recorded in the random access memory 126 becomes equal to the fixed period of time recorded in the read only memory 124, the microcontroller 122 provides a signal for increasing the speed of the movement of the vehicle 12 in the forward direction. If the vehicle continues to be commanded to be moved forward, the period of time since the speed was increased may again be recorded in the random access memory 126 and is again continuously compared in the microcontroller 122 with a fixed period of time recorded in the read only memory 124. When the period of time recorded in the random access memory 126 becomes equal to the fixed period of time recorded in the read only memory 124, the microcontroller 122 provides a signal to further increase the speed of the movement of the vehicle 12. The microcontroller may continue the cycle of monitoring the time of movement and providing signals to increase the speed of movement of the vehicle up to a predetermined number of cycles, the number of which may be stored in the read only memory 124. Similar arrangements are provided for each of the vehicles 14, 16 and 17. This increased speed may illustratively be twice, three times or more than that of the original speed.

As described above, each of the vehicles 12, 14, 16, 17 and 25 has a plurality of motors 28, 30, 32 and 33. When one of these motors is energized by the microcontroller 122 as described in the previous paragraph, the microcontroller 122 records a value representative of the speed of the motor in the random access memory 126. If the microcontroller 122 receives a packet 200 of data from the central station 64 commanding the energization of a second or third one of the motors 28, 30, 32 and 33, the microcontroller 122 provides a signal to the transistor driver 120 associated with that second or third one of the motors 28, 30, 32 and 33 to start and run that motor at the speed recorded in the random access memory 126 representative of the current operating speed of the first of the motors 28, 30, 32 and 33 to be energized. If both motors continue to be energized for a period of time exceeding the period of time stored in the read only memory 124 as described previously, the transistor drivers 120 associated with all of the motors energized at that instant receive signals from the microcontroller 122 to increase the speed of the motors to the next level.

The microcontroller 122 continuously monitors the RF receiver 121 for RF packets 200 transmitted by the central station 64. While the central station is turned on, the RF transmitter 104 continuously transmits packets 200 of information regarding the status of the switch closures of the pads 42*a*, 42*b*, 42*c* and 42*d*, as well as any special commands that are required. The RF receiver of each of the vehicles 12, 14, 16, 17 and 25 is responsive to the presence of RF packets 200 that carry the unique combination of identifier bits 206, 208, 210 and 212 assigned to a particular vehicle as described above. If the RF receiver 69 of a particular one of the vehicles does not receive a command for a predetermined period of time, the value of which is stored in the read only memory 124, the microcontroller 124 infers that the vehicle is not being used by an operator, and places the vehicle in a powered, but inactive state.

When a vehicle is in the powered, but inactive state and the microcontroller 122 determines that a packet 200 addressed to the particular vehicle has been received, it stores the values of bits of the packet 200 in the random access memory 126, and continues to monitor the output of the RF receiver 121. If the microcontroller 122 detects another packet 200 addressed to it, it compares the newly received packet 200 with the stored packet. If the received and stored packets are identical, and the received packet has been detected within a predetermined period of time stored within the read only memory 124, the microcontroller 122 recognizes that its vehicle has been selected by the operator of one of the pads 42*a*, 42*b*, 42*c* and 42*d*. The microcontroller 122 then enters a "powered and selected" state and causes the light emitting diode 134 to change from a blinking light to a constant light. The requirement that the microcontroller 122 detect two identical packets 200 addressed to it is advantageous in eliminating spurious "glitching" of the RF system of the vehicle. This is necessary because of the amount of RF "noise" present under even routine operating conditions, which can adversely impact the precise control of the vehicles necessary.

As will be discussed in more detail below, the microcontroller 122 also continuously monitors the received packets to determine if the packets are valid. For example, the microcontroller 122 may determine whether the packets comprise the correct number of non-conflicting data bits, with each bit having an allowed value. Once the microcontroller 122 has entered the powered and selected state, each valid packet of information received by RF receiver 121 and addressed to the vehicle is considered by the microcontroller 122 to be a valid command, and is acted on accordingly by the microcontroller 122 to control the motors 28, 30, 32 and 33 of the vehicle.

The identities of the last two vehicles selected by a pad are stored in a flashback queue stored in the random access memory 82 (FIG. 2). If the pad is automatically deselected as described above because no buttons on the pad have been pushed during the predetermined interval stored in the read only memory 80, the first actuation of any button on the deselected pad causes the central station 64 to attempt to automatically log onto the last vehicle selected by that pad. When the selected vehicle is already selected by another one of the pads 42*a*, 42*b*, 42*c* and 42*d*, the automatic log onto the vehicle will succeed only if switch 65 on the pad currently controlling the vehicle has been set in the second position to enable the second mode allowing control of the vehicle to be shared by other pads.

When the first automatic log on attempt is unsuccessful because the last vehicle controlled by the pad is already selected by another pad that is not set in the second mode, the central station attempts to log on to the second to last vehicle controlled by the pad. This second automatic log on attempt is also sensitive to the state of the mode setting of another pad already controlling the vehicle. If this second automatic log on attempt is unsuccessful, then the central station attempts to log on to each of the vehicles 12, 14, 16, 17 and 25 in turn, beginning with the vehicle identified by the Arabian number "1" until a log on attempt is successful.

In order to optimize the transmission of packets, and also to conserve battery energy in vehicles that are in the powered, but inactive state, the microcontroller 94 of the central station may only execute the automatic log on attempt when a command signal is provided by the pad 42*a*, 42*b*, 42*c* and 42*d*. In other words, the automatic log on may only be attempted when one of the buttons 44, 47, 49, 56, 58, 60*a*, 60*b*, 61*a* and 61*b* are actuated to command the movement of a vehicle. Actuation of button 65, however, since button 65 does not control any of the motors 28, 30, 32 and 33 of the vehicles, may not initiate the automatic log on attempt.

An additional feature of the system of the present invention that utilizes the flashback queue may be activated when an operator presses button 47 on a pad 42*a*, 42*b*, 42*c* and 42*d*. Actuation of button 47 closes switch 53 and causes the pad to deselect the vehicle currently controlled by the pad, and attempt to log on to the last vehicle controlled by the pad before the current vehicle was selected by pressing button 58 the required number of times. This feature may also be sensitive to the state of the mode select switch 65 on a pad controlling the vehicle on which the automatic log on is attempted. If the vehicle is currently controlled by another of the pads 42*a*, 42*b*, 42*c* and 42*d*, then the automatic log on attempt after pressing button 47 will be successful only if the switch 65 on the other pad is set to enable the second, shared control, mode. As before, if the automatic log on attempt caused by pressing button 47 is unsuccessful, then an attempt will be made to log on to the second to last vehicle controlled by the pad. One difference between the automatic log on attempts made when the pad has been deselected and the attempts enabled by pressing button 47 is that the latter may make no further attempts to log on to any other vehicles if the second automatic log on attempt is unsuccessful.

One advantage of the arrangement of bits in the packet 200 is that the bits 214, 216, 218 and 220 are representative of switch actuations of the pads 42*a*, 42*b*, 42*c* and 42*d* that may be mutually exclusive. The bits 214, 216, 218 and 220 may be given values by the microcontroller 94 of the central station 64 that would normally be interpreted by the microcontroller 122 of the vehicles 12, 14, 16, 17 and 25 as illegal commands. For example, the case where the value of bits 214 and 216 are both binary 1, representing switch actuations on one of the pads 42*a*, 42*b*, 42*c* and 42*d* to command a vehicle to simultaneously move in a forward and a backward direction would be interpreted by the microcontroller 122 as an illegal command, and would be ignored by the microcontroller 122. This may occur, for example, where the vehicle identified by bits 206, 208, 210 and 212 is being controlled by two or more pads, as described previously. In such a case, the operator of one of the pads may push button 44, for example, to actuate switch 46 to command the vehicle to move forward (FIG. 2). At the same instant, the operator of the other pad controlling the vehicle may push button 44 to actuate switch 48 to command the vehicle to move backwards. The microcontroller 94 would form a packet 200 in response to these commands directed to the selected vehicle having a value of binary 1 in each of the bits 214 and 216. As stated, the microcontroller 122 of the vehicle would interpret such a packet 200 as an illegal packet, and would not provide signals to the transistor drivers 120 of the motors 28, 30, 32 and 33 (FIG. 4) in accordance with the values of the bits 214 and 216 of the packet 200. In one embodiment of the invention, such illegal commands could instead be used to signal the microcontroller 122 that the bits following the illegal command bits contain instructions to carry out a special command.

A particular sequence of otherwise illegal combinations of values of the bits 214, 216, 218 and 220 associated with a special command may be stored in the read only memory 124. It will be understood that more than one illegal sequence of bits 214, 216, 218 and 220 is possible; thus the read only memory 126 may contain as many sequences representing special commands as there are illegal sequences of bits 214, 216, 218 and 220. When the RF receiver 121 receives a transmitted packet 200, the sequence of bits comprising the packet 200 is stored in the random access memory 126. The microcontroller 122 compares the sequence of bits 214, 216, 218 and 220 stored in the random access memory to the sequences stored in the read only memory 126, and if there is a match, the microcontroller 122 executes the special command associated with the sequence of bits 214, 216, 218 and 220. Such special commands may include, by way of illustration and not limitation, commands to power down the vehicle, reset the microcontroller 122 or to immediately cause the microcontroller 122 to enter the "powered, but inactive" state.

If the microcontroller 122 determines that none of the sequences of bits 214, 216, 218 and 220 stored in the read only memory 124 matches the sequence of bits stored in the random access memory 126, the microcontroller determines that the sequence of bits 214, 216, 218 and 220 stored in the random access memory 126 is an illegal sequence of bits not associated with any special command. The microcontroller 122 may then ignore the entire packet 200 or the microcontroller 122 may interpret and execute commands associated only with bits whose values represent legal commands.

Accessories connected to the smart port 115 of the central station 64 may also provide signals to the microcontroller 94 of the central station 64 to be transmitted to the vehicles 12, 14, 16, 17 and 25. While bit 236 of the packet 200 is normally used by the microcontroller in an accessory to instruct the microcontroller 94 of the central station 64 to perform some activity, such as sounding a horn, bit 236 may also be used to indicate that the values of the bits in the packet 200 should be interpreted as special commands, rather than their usual meanings. For example, where the accessory connected to the smart port 115 instructs the microcontroller 94 of the central station 64 to transmit a special command, the microcontroller of the accessory may set the value of bit 236 to a binary 1. When the packet containing this bit is received by the desired vehicle, the packet 200 of bits is stored in the random access memory 126 and the value of bit 236 instructs the microcontroller 122 of the vehicle to compare the values of the data bits 214, 216, 218, 220, 222, 224, 226 228, 230, 232 and 234 to sequences of bits stored in the read only memory 124 associated with special commands generated by the accessory connected to the smart port 115 of the central station 64. The microcontroller 122 then executes the special commands to control the motors 28, 30, 32 and 34, or other auxiliary equipment or devices that may be in use that is associated with the vehicle or device identified by the bits 206, 208, 210 and 212 of the packet 200.

Since the vehicle 12 is battery powered, various systems and processes are incorporated within the programming of the microcontroller 122 and the read only memory 124 to optimize the power utilization of the vehicle. For example, when the microcontroller 122 has not detected any packets addressed to the vehicle for the predetermined period of time stored in the read only memory 124, the microcontroller automatically places the vehicle in the powered, but inactive state.

As described above, the central station 64 transmits a continuous stream of packets 200 when the central station is powered. If the central station is turned off, the microcontroller 94 of the central station 64 may, as it powers down the central station 64, send a special command to the vehicles to enter a powered down state. Alternatively, the microcontroller 122 in the vehicle may cause the vehicle to automatically enter the powered down state if no RF packets 200 transmitted by the central station 64 are received for a predetermined period of time stored within the read only memory 124. As mentioned previously, the normal operating environment may contain a high level of random RF "noise" that may be detected by the microcontroller 122. Accordingly, the microcontroller may be programmed with the capability of filtering the signals received by the RF receiver 121 to eliminate spurious packets. The microcontroller 122 may determine that RF packets are being transmitted by the central station 64 only if a percentage of the packets received during a predetermined time are determined to be valid packets 200. For example, fifty percent of the packets received during one second may be determined by the microcontroller 122 to be valid or the microcontroller will begin powering down the vehicle. Such a determination by the microcontroller 122 may, for example, include determining whether the received packet 200 contains the correct number of data bits.

If the microcontroller 122 determines that the vehicle should be powered down, it may provide a visual signal to the operators of the system by causing the light emitting diode 134 to blink at a rate obviously different from the blink rate identifying the powered, but inactive state. For example, the light emitting diode may blink at twice the rate for one minute. At the end of the predetermined time, if the microcontroller 122 has still not detected any valid RF packets, the microcontroller causes the vehicle to be completely powered down, and removes the power from the light emitting diode 134, causing it to go dark.

Further energy optimization may be achieved by utilizing pulse width modulation techniques to energize the motors 28, 30, 32 and 33. For example, the speed of the motors 28, 30, 32 and 33 may be controlled at three different levels by applying power to the motor for one third of a power cycle to achieve a first speed, for two thirds of power cycle to achieve a second speed, and continuously throughout the power cycle to achieve a third, maximum speed. Thus, a power cycle may typically have three time slices.

The microcontroller 122 may select which of the three time slices to apply power to the selected one of the motors 28, 30, 32 and 33 to achieve the desired speed. For example, the first speed may be achieved by applying power to the selected motor during any one of the three time slices, and the second speed may be achieved by applying power during any two of the three time slices, while the third speed is achieved by applying power during all three of the time slices.

In a preferred embodiment, the microcontroller 122 applies power to the selected one of the motors 28, 30, 32 and 33 in the first time slice available after the packet 200 of data containing the command to energize the motor is received and decoded. Selecting the first available time slice in this manner to provide power to the selected motor provides improved response of the vehicle to switch actuations on the pads 42*a*, 42*b*, 42*c* and 42*d* to enhance control and maneuverability of the vehicles 12, 14, 16, 17 and 25 by the operator.

Figure 7:
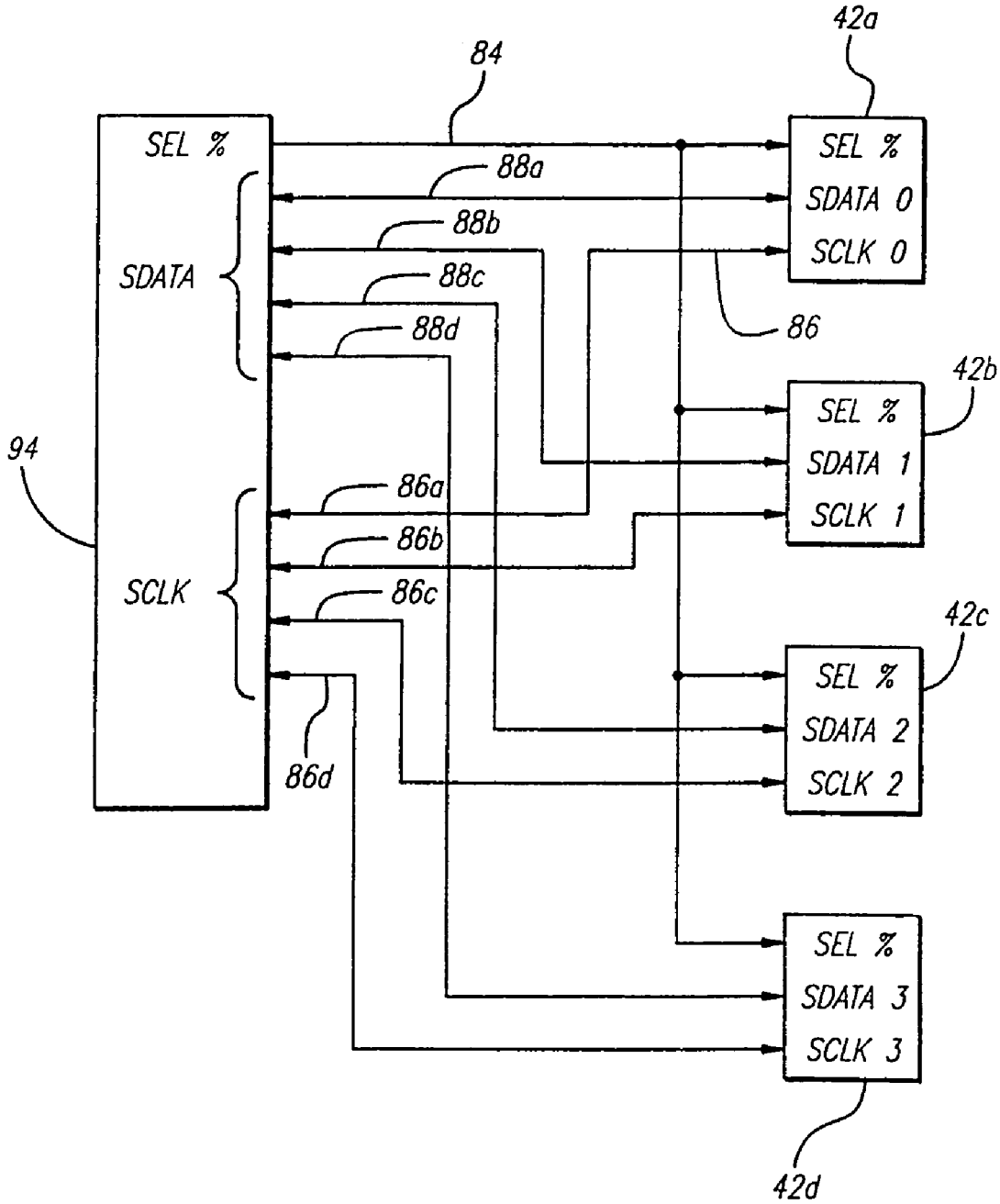
FIG. 7 is a schematic diagram, primarily in block form, showing the details of a plurality of signal lines connecting the pads to the central station.

Referring now to FIG. 7, the interface between the microcontroller 94 of the central station 64 and the pads 42*a*, 42*b*, 42*c* and 42*d* is shown in more detail. As described previously, all of the data and control signals passing between the microcontroller 94 of the central station 64 and the pads 42*a*, 42*b*, 42*c* and 42*d* is conveyed over three lines.

In a preferred embodiment, the microcontroller 94 has nine input/output (I/O) lines 84, 86*a*, 86*b*, 86*c*, 86*d*, 88*a*, 88*b*, 88*c* and 88*d* devoted to determining the status of the switch closures of the switches in switch matrix 43 of the pads 42*a*, 42*b*, 42*c* and 42*d* and for modifying the status of the light emitting diodes 93 of the pads (FIG. 2). Line SEL% 84 is a common line connected to a corresponding input/output port on each of the pads 42*a*, 42*b*, 42*c* and 42*d*. There are four SCLK I/O lines 86*a* 86*b*, 86*c* and 86*d* connected to corresponding I/O ports on the pads 42*a*, 42*b*, 42*c* and 42*d*. Specifically, SCLK line 86*a* is connected to I/O port SCLK0 on pad 42*a*, SCLK line 86*b* is connected to I/O port SCLK1 on pad 42*b*, SCLK line 86*c* is connected to I/O port SCLK2 on pad 42*c* and SCLK line 86*d* is connected to I/O port SCLK3 on pad 42*d*. Similarly, SDATA line 88*a* is connected to I/O port SDATA0 on pad 42*a*, SDATA line 88*b* is connected to I/O port SDATA1 on pad 42*b*, SDATA line 88*c* is connected to I/O port SDATA2 on pad 42*c* and SDATA line 88*d* is connected to I/O port SDATA3.

This architecture allows the microcontroller 94 to read the status of the switch closures of switch matrix 43 from all four pads 42*a*, 42*b*, 42*c* and 42*d* simultaneously in parallel fashion, or alternatively, to read the status of an individual one of the pads 42*a*, 42*b*, 42*c* and 42*d*. As will be described in more detail with reference to FIGS. 8 and 9, the microcontroller 94 may read the status of the pads 42*a*, 42*b*, 42*c* and 42*d* by sending appropriate signals over the SEL% line 84 and the SCLK lines 86*a*, 86*b*, 86*c* and 86*d*. When the microcontroller 92 sends the appropriate signal over SEL% line 84, and sends the identical appropriate signal over the SCLK lines 86*a*, 86*b*, 86*c* and 86*d*, the status of the switch closures of each of the pads 42*a*, 42*b*, 42*c* and 42*d* is read simultaneously by the microcontroller 94 over the SDATA lines 88*a*, 88*b*, 88*c* and 88*d*. Alternatively, the microcontroller 94 may provide the appropriate signal over a selected one or ones of the SCLK lines 86*a*, 86*b*, 86*c* and 86*d*. Thus, the microcontroller 94 reads the status of the switch closures only of the pads 42*a*, 42*b*, 42*c* and 42*d* receiving the signal over the selected one or ones of the SCLK lines 86*a*, 86*b*, 86*c* and 86*d*. In like manner, the microcontroller may provide the appropriate signals over the SEL% line 84 and the SCLK lines 86*a*, 86*b*, 86*c* and 86*d* to enable the pads 42*a*, 42*b*, 42*c* and 42*d* to receive signals to update the status of the light emitting diodes 93 (FIG. 2) over the SDATA lines 88*a*, 88*b*, 88*c* and 88*d* either simultaneously or selectively.

One advantage to using a common SEL% line connecting all of the pads 42*a*, 42*b*, 42*c* and 42*d* is that it eliminates three input/output lines, allowing the use of a less expensive microcontroller 94. A further advantage is that the pads 42*a*, 42*b*, 42*c* and 42*d* are not connected in series. Thus, selected ones of the pads 42*a*, 42*b*, 42*c* and 42*d* may be either connected or disconnected from the central station without affecting the operation of microcontroller 94 or the central station 64. As mentioned previously, the microcontroller 94 is capable of detecting whether a pad is connected to the central station 64, and immediately recognize when a pad is connected or disconnected. In the event a pad is disconnected, the microcontroller 94 may discontinue sending signals over the SCLK lines 86*a*, 86*b*, 86*c* and 86*d* and the SDATA lines 88*a*, 88*b*, 86*c* and 88*d* associated with the disconnected pad to read the status of the pad or to update the status of the light emitting diodes 93 of the pad. When a pad is connected to a central station 64 that is already in use, the microcontroller 94 may immediately begin providing signals over the SCLK lines 86*a*, 86*b*, 86*c* and 86*d* and the SDATA lines 88*a*, 88*b*, 88*c* and 88*d* associated with the newly connected pad to read the status of the switch closures of the pad and to update the status of the light emitting diodes 93 of the pad.

Figure 8:
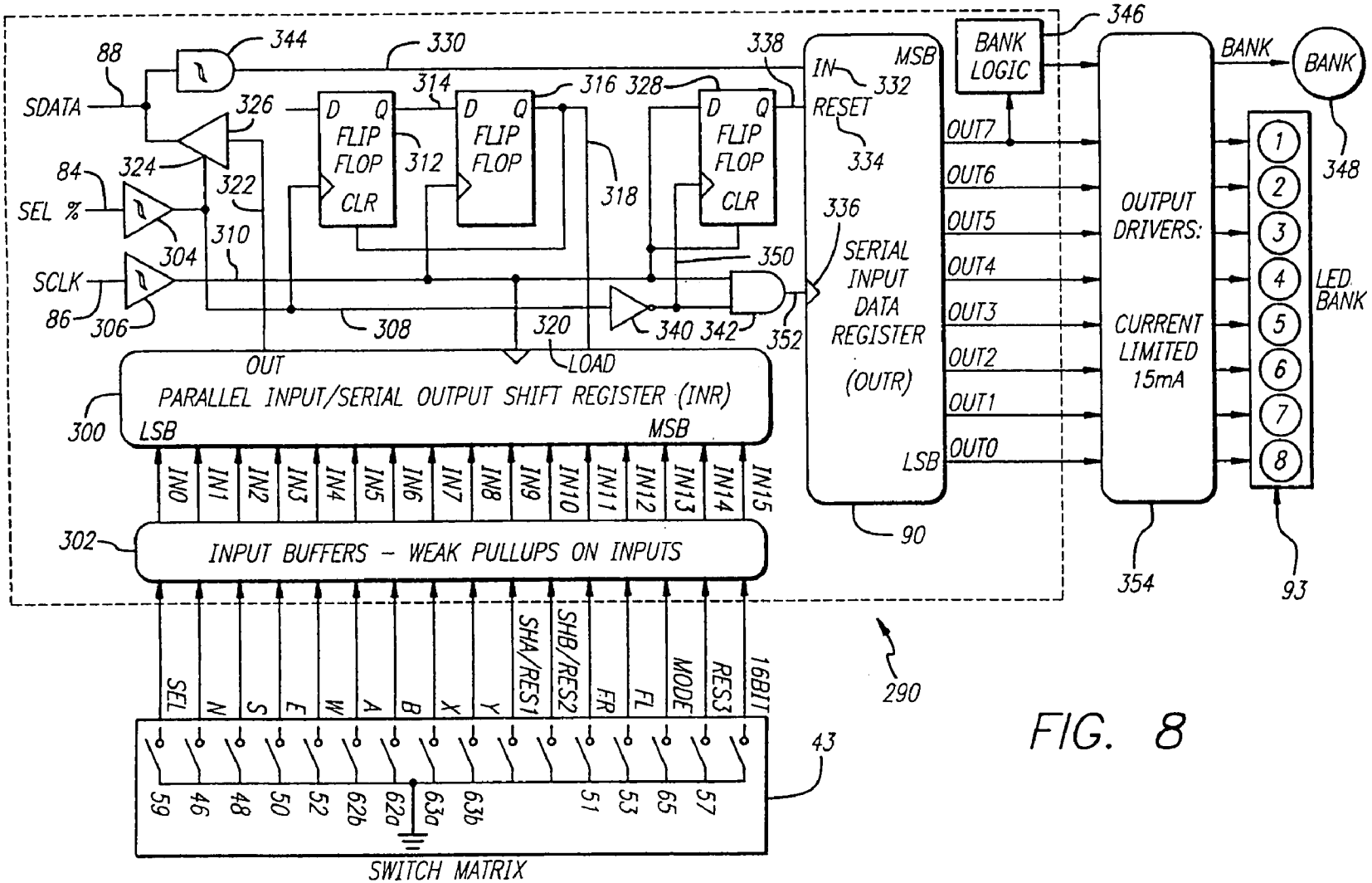
FIG. 8 is a schematic diagram, primarily in block form, of a programmable logic device in the pads.

Referring now to FIGS. 8 and 9, the operation of the logic used in each of the pads 42*a*, 42*b*, 42*c* and 42*d* to provide the status of the switch closures of the switch matrix 43 to the central station 64 will be described. In a preferred embodiment of the invention, the pads 42*a*, 42*b*, 42*c* and 42*d* include a programmable logic device, generally indicated at 290, having the components illustrated in the block diagram depicted in FIG. 8. While a programmable logic device 290 is depicted, it will be understood by those skilled in the art that the same functions may be carried out by a microcontroller 76 as shown in FIG. 4.

As described previously, the switch matrix 43 comprises a plurality of switches, such as switches 46, 48, 50, 52, 62*a*, 62*b*, 63*a*, 63*b*, 51, 53, 57, 59 and 65. As depicted in FIG. 8, the switch matrix 43 may also contain additional switches that may be used to provide additional functions. Each of the switches in the switch matrix 43 is coupled to an input line of an input shift register 300. An input buffer 302 is disposed between each switch of the switch matrix 43 and the corresponding input line of the input shift register 300.

The input shift register 300 may be a parallel input/serial output shift register. In the embodiment of the invention depicted in FIG. 8, the input shift register 300 has sixteen input lines labeled IN0 to IN15. The state of each of the input lines IN0-IN15 determines the value of a single bit of the input shift register 300. For example, closure of switch 59 results in the output of the input buffer 302 connected to switch 59 having a voltage increase that causes a binary 1 to be stored in the bit connected to input line IN0 when the shift register 300 is triggered to load. Similarly, when switch 59 is open, the output of the input buffer 302 connected to input line IN0 is low, resulting in a binary 0 being stored in the bit connected to input line IN0 when the input shift register 300 is triggered to load. Since each switch of the switch matrix 43 is connected to a corresponding one of the input lines IN0-IN15 of the input shift register 300, the state of each of the switches of the switch matrix 43 may be captured simultaneously, or on a parallel basis, with the state of the other switches, by the input shift register 300.

The SDATA line 88 may be driven by either the microcontroller 94 in the central station 64 or the programmable logic device 290 of the pad 42*a*, 42*b*, 42*c* and 42*d*. When the SEL% 84 line is driven by the microcontroller 94 of the central station 64, it is driven with a signal that may be an alternating signal. This alternating signal is input into a Schmidt trigger 304 which results in a signal on line 308 having high and low states, as depicted in FIG. 9. Similarly, the SCLK signal on line 86 is input into a Schmidt trigger 306 resulting in a signal on line 310 having alternating high and low states. While Schmidt triggers 304, 306 are described, any input buffer may be used. The SDATA line 88 is enabled to be driven by the pad whenever the SEL% signal on line 308 is high (the read state); thus, the microcontroller 94 stops sending data signals over line SDATA 88 before providing a signal over line SEL% 84 to set line SEL% 308 high.

The sequence of operations comprising the determination of the status of the switch closures of the switch matrix 43 will now be described with reference to the block diagram of the programmable logic device depicted in FIG. 8 and the timing diagram generally indicated at 400 in FIG. 9. As depicted on timing diagram line 402 of FIG. 9, the signal on line SEL% 308 is driven high while the signal on SCLK line 310 is low (timing diagram line 406, FIG. 9). The transition from low to high on line 308 is input into a clock-in line of a flip flop 312 that is responsive to line 310 being driven high to drive the prime signal on line 314 high. This transition is depicted at 420 in FIG. 9. The high prime signal on line 314 is input to flip flop 316 which also receives a clock-in signal from SCLK line 310. When the SCLK signal on line 310 is driven high (FIG.

9, timing diagram line 406), the flip flop 316 causes the signal on the loadreg line 318 to go high (FIG. 9, transition 424), asserting the loadreg signal to the shift register 300. The signal on the loadreg line 318 is also input into the CLR input line of the flip flop 312. The high level of the signal on the loadreg line 318 resets flip flop 312, causing the signal on the prime line 314 to go low (FIG. 9, transition 426).

The combination of a low signal on the prime line 314 and the next transition of the SCLK signal on line 310 from low to high causes the flip flop 316 to reset the signal on the loadreg line 318 to low (FIG. 9, transition 430). The assertion of SCLK while loadreg is high causes the input shift register to capture the signals on the input lines IN0-IN15 representative of the state of the switch closures of the switch matrix 43 in a parallel fashion. Each subsequent transition of the signal on the SCLK line 310 from low to high (FIG. 9, timing diagram line 406) while the signal on the loadreg line 318 is low (FIG. 9, timing diagram line 408) drives the shift register 300 to serially shift the one of the bits of data stored in the shift register 300 out of the shift register 300 through an output line 322 and an output enableable driver 326 onto the SDATA line 88. As can be seen in FIG. 8, the SEL% line 308 is also connected to the enabler input 324 of the output enable driver 326. When the signal on the SEL% line 308 is high the output enable driver 326 allows the signal on line 324 to pass through the output enableable driver 326 onto SDATA line 88, which is being monitored by the microcontroller 94 of the central station 64. The data signal on line 88 also passes through a Schmidt trigger input buffer 344 onto line 330 which is connected to the in line 332 of the shift register 90. In this arrangement, the signal that is present on the SDATA line 88, whether driven by the pad 42*a* or the central station 64, is present on line 330 and at the in line 332 of the shift register 90.

When the microcontroller 94 of the central station 64 has completed the interrogation cycle to read the status of the switch closures of the pads 42*a*, 42*b*, 42*c* and 42*d*, the microcontroller 94 sends a signal on line SEL% 84 to set the signal on line 308 low (FIG. 9, timing diagram line 454). Setting the signal on line 308 low turns off the output enable driver 326, halting the flow of data onto the SDATA line 88 from line 322. SDATA line 88 may now be driven by microcontroller 94 of the central station to send signals to the pad to update the status of the light emitting diodes 93 on the pad (FIG. 2).

The operation of the programmed logic device 290 to update the status of the light emitting diodes 93 (FIG. 2) of the pads will now be described with reference to FIG. 8 and the timing diagram generally indicated at 450 in FIG. 9. As shown in FIG. 8, the SCLK signal on line 310 is used to drive the input and CLR lines of the flip flop 328. The SEL% signal on line 308 is used to drive the output of an invertor 340 to provide a clock signal to the clock-in port of the flip flop 328. In this manner, when the SEL% signal on line 308 is high, the signal on line 350 will be low, and when the SEL% signal on line 308 is low, the signal on line 350 will be high.

The SEL% and SCLK signals on lines 350 and 310 are used to drive the output of an and gate 342 to provide a signal on line 352 to the clock-in port 336 of the shift register 90. In this arrangement, the signal on line 352 is high when the SCLK signal on line 310 is high and the inverted SEL% signal on line 350 is high. In this way, the signal on line 352 is high only when the microcontroller 94 in the central station 64 is not interrogating the pad to capture data from the input shift register 300.

When the SCLK signal on line 310 is driven high when the signal on line 350 is high (SEL% line 84 being low), the flip flop 328 drives the signal on the outres line 338 high (FIG. 9, transition 472). When the signal on line 310 transitions from high to low, the signal on the outres line 338 is driven low and is asserted to the reset line 334 of the shift register 90 (FIG. 9, transition 476). Since the signal on line 350 is high as a result of the inversion of the low signal on line 308 by invertor 340, each subsequent transition of the SCLK signal on line 310 from low to high satisfies the condition of the and gate 342 and is asserted to the clock-in line 336 of the shift register 90. Each subsequent clock signal on line 352 while the signal on outres line 338 is low shifts the value of the SDATA signal on line 330 at in line 332 of the shift register 90 to be shifted into the output line out0 of the shift register 90. Each successive clocking of the shift register 90 by a transition of the signal on line 352 from low to high shifts the data in each of the registers of the shift register 90 to the next higher output line. For example, the next clock signal on line 352 will shift the value on the out0 line to the out1 line and so forth. The output of the output lines of the shift register 90 are then utilized by the output drivers 354 to light the selected LED of the LED bank 93 (FIG. 9, timing diagram lines 452, 458).

It will be understood that the flow of data on line 88 is sequenced with the signals provided on the SEL% line 84 and the SCLK line 86. For example, when a vehicle identified by the Arabian numeral "4" has been selected by the operator of pad 42*a*, the microcontroller 94 will drive the signal on the SEL% line 84 low while the signal on the SCLK line 86 is high, causing the flip flop 338 to drive the signal on the outres line 338. Setting outres line 338 asserts a reset signal to the reset line 334 of the shift register 90, and also disables the flow of data from the pad to the central station 64.

When the signal on the SCLK line next transitions from high to low (FIG. 9, transition 476), the signal on the outres line is driven low, enabling the shift register 90 to accept data on line 330 from the microcontroller 94 of the central station 64. The microcontroller 94 sets the signal line SEL% 84 low. The next time the SCLK signal on line 86 is driven high by the microcontroller 94, shift register 90 will shift the value of the SDATA line 330 (which is high) to the out0 register of the shift register 90 (FIG. 9, timing diagram lines 452, 458). The microcontroller 94 then drives the signal on the SDATA line 88 low, which drives the signal at the in line of the shift register 90 low. The microcontroller 94 then drives the signal on the SCLK line 86 from low to high and back to low four times, each time causing the signal on line 352 to transition from low to high and back to low, which results in the shift register 90 shifting the value of the out0 line to the out1 line, then to the out2 line and lastly to the out3 line, which results in the fourth LED in the LED bank to be lit, indicating that the user of the pad 42*a* has selected the vehicle identified with the Arabian "4". Because the signal on the SDATA line has been driven low, there is no data present at the in port 332 of the shift register 90 to shift into the output register out0 as the data in the output register out0 is shifted in the out1 register. Thus, each of the registers out0, out1 and out2 are set to binary 0, and the LED's associated with those registers are not lit.

The system and method described above have certain important advantages. They provide for the operation of a plurality of vehicles by a plurality of users, either on a competitive or a co-operative basis. Furthermore, the vehicles can be operated on a flexible basis in that a vehicle can be initially selected for operation by one user and can then be selected for operation by another user after the one user has failed to operate the vehicle for a particular period of time. The vehicles being operated at each instant are also visible by the illumination of the lights 134 on the vehicle. The apparatus and method of this invention are also advantageous in that the vehicles are operated by the central station 64 on a wireless basis without any physical or cable connection between the central station and the vehicles.

Furthermore, the central station 64 is able to communicate with the vehicles in the plurality through a single carrier frequency. The system and method of this invention are also advantageous in that the vehicles can selectively perform a number of different functions including movements forwardly and rearwardly and to the left and the right and including movements of a container or bin or platform on the vehicle upwardly and downwardly or to the left or the right. Different movements can also be provided simultaneously on a coordinated basis.

There are also other significant advantages in the system and method of this invention. Two or more systems can be combined to increase the number of pads 42 controlling the operation of the vehicles 12, 14, 16 and 17. In effect, this increases the number of users capable of operating the system. This combination of systems can be provided so that one of the systems is a master and the other is a slave. This prevents any confusion from occurring in the operation of the system. The system is also able to recharge the batteries in the vehicles so that use of the vehicles can be resumed after the batteries have been charged.

The system and method of this invention are also advantageous in the provision of the pads and the provision of the button and switches in the pads. As will be appreciated, the pads are able to select vehicles and/or stationary accessories through operation of a minimal number of buttons and to provide for the operation of a considerable number of different functions in the vehicles with a minimal number of buttons. In cooperating with the central station, the pads are able to communicate the selection of vehicles to the central station without indicating to the station, other than on a time shared basis, the identities of the vehicles being selected. After selecting a vehicle, each pad does not thereafter have to indicate the identity of the vehicle as long as the pad operates the vehicle through the central station within a particular period of time from the last operation of the vehicle by the pad through the central station.

While several forms of the invention have been illustrated and described, it will also be apparent that various modifications can be made without departing from the spirit and scope of the invention. Accordingly, it is not intended that the invention be limited, except by the appended claims.

What is claimed is:

1. In combination for use in a system including a plurality of vehicles each responsive to an individual address and to a plurality of commands for providing individual operations of such vehicles in accordance with such commands, a plurality of pads, each individual one of the pads including a plurality of switches having first and second states of operation for providing an address to select any individual one of the vehicles and for providing commands to such individual one of the vehicles for operating such individual one of the vehicles in accordance with such commands, a central station responsive to the operation of the switches in each individual one of the pads in the second state for sending the address and the commands from the individual one of the pads to the individual one of the vehicles, there being an additional switch on each individual one of the pads with first and second states of operation, the additional switch in each individual one of the pads providing in the first state for the operation of the individual one of the vehicles only by such individual one of the pads and providing in the second state for the operation of the individual one of the vehicles by at least another one of the pads in addition to the individual one of the pads, and means in the central station for providing for the operation of the vehicle by the individual one of the pads and the at least additional one of the pads when the additional switch in the individual one of the pads is in the second state.

2. In a combination as set forth in claim 1, each of the pads including, in the plurality of switches, first switches for controlling the movements of the individual one of the vehicles and including, in the plurality of switches, second switches for controlling other operations of the vehicles than the movements of the vehicles, and means responsive in the central station to the operation of the first switches in the individual one of the pads for providing movements of the individual one of the vehicles and responsive in the central station to the operation of the second switches in the individual one of the pads for providing operations of the individual one of the vehicles other than the movements of such vehicle.

3. In a combination as set forth in claim 2, means responsive in the central station to the operation of the additional one of the switches in the individual one of the pads in the second state and to the operation of the first switches in the individual one of the pads and the at least additional one of the pads for providing movements of the individual one of the vehicles in accordance with the operation of the first switches in the individual one of the pads and the additional one of the pads and responsive in the central station to the operation of the second switches in the individual one of the pads and the additional one of the pads for providing operations of the individual one of the vehicles other than the movements of such vehicle in accordance with the operation of the second switches in the individual one of the pads and the additional one of the pads.

4. In combination in a central station for use with a plurality of pads and a plurality of vehicles wherein each of the pads includes a plurality of switches for controlling the operation of an individual one of the vehicles, first means responsive in the central station to an operation of first switches in the plurality in an individual one of the pads in a pattern for producing first signals providing an address identifying any individual one of the vehicles, second means responsive in the central station to an operation of second switches in the plurality in the individual one of the pads for producing second signals providing for an operation of the individual one of the vehicles in accordance with such switch operations, and third means responsive in the central station to the operation of a third switch in the plurality in the individual one of the pads for providing for an operation of the individual one of the vehicles by at least a second one of the pads simultaneously with the operation of the individual one of the vehicles by the individual one of the pads, the at least second one of the pads having first and second switches respectively corresponding to the first and second switches in the individual one of the pads, and fourth means in the central station for sending to the individual one of the vehicles the first signals providing, in the individual one of the pads and the at least second one of the pads, the address identifying the individual one of the vehicles and the second signals providing commands for obtaining the operation of the vehicle in accordance with the pattern of closure of the second switches in the individual one of the pads and in the at least additional one of the pads.

5. In a combination as set forth in claim 4, the first means being responsive in the central station to the operation of the first switches in the at least second one of the pads in the pattern for producing in the at least second one of the pads third signals providing an address identifying the individual one of the vehicles at substantially the same time that the first signals are provided in the individual one of the pads to provide the address identifying the individual one of the vehicles, the second means being responsive in the central station to the operation of the second switches in the at least additional one of the pads for producing fourth signals providing for the operation of the individual one of the vehicles in accordance with such switch operations, the fourth means being operative in the central station to send to the individual one of the vehicles from the at least additional one of the pads, at substantially the same time as the sending to the individual one of the vehicles from the individual one of the pads, the third signals providing the address identifying the individual one of the vehicles and the fourth signals providing commands for obtaining the operation of the vehicle in accordance with the pattern of operation of the second switches in the second one of the pads.

6. In combination for controlling the operation of an individual one of a plurality of vehicles, a first pad included in a plurality of pads and including a first switch operable in a pattern providing an address of the individual one of the plurality of vehicles and including a plurality of switches individually operable in a pattern providing for operations of the individual one of the vehicles in accordance with the pattern of operations of such switches, means in the first pad for providing a plurality of light indications each for a particular one of the vehicles in the plurality, means in the first pad for providing first light indications for the vehicles in the plurality when such first pad has not provided an address for any of the vehicles in the plurality, means in the first pad for providing a second illumination for the individual one of the vehicles when the first pad provides the address for such individual one of the vehicles, and the first pad including an additional switch having first and second states of operation and operative in the first state to provide for the operation of the individual one of the vehicles only by the first pad and operative in the second state to provide for the operation of the individual one of the vehicles only by another one of the pads in the plurality in addition to the first pad.

7. In a combination as set forth in claim 6, each of the pads, other than the first pads, including a switch corresponding to the first switch in the first pad and sequentially operative to select successive ones of the vehicles in the plurality, and means responsive in each of the pads to the sequential operations of the switch in the pad for skipping the addressing by the pad of a vehicle in the plurality which has already been addressed by another one of the pads in the plurality.

8. In a combination as set forth in claim 6, the first light indications constituting a sequential activation of the light indications in the plurality on a cyclic basis, and means in the first pad for discontinuing the sequential activation of the light indications in the first pad and for providing a continuous activation of an individual one of the light indications in such pad when such pad is operated to address the vehicle represented by such individual one of the light indications.

9. In combination for operating a vehicle in accordance with addresses and commands provided by a pair of pads and transmitted by a central station to the vehicle, means in the vehicle for receiving the addresses and commands provided by the pads and transmitted by the central station, means in the vehicle for identifying the addresses received from the pads as those of the vehicle, means responsive in the vehicle to the identification of the addresses received from the pads as those of the vehicle for executing the received commands from the the pads when the received commands from the pair of the pads are complementary, and means responsive in the vehicle to the identification of the addresses received from the pair of the pads as those of the vehicle for ignoring the commands received from the pads when the received commands are contradictory.

10. In a combination as set forth in claim 9, means responsive in the vehicle to the discontinuance of one of the pads in the pair in addressing the vehicle for continuing the response of the vehicle to the addresses and commands from the other one of the pads in the pair.

11. In combination for use in a system including a plurality of vehicles each responsive to an individual address and to a plurality of commands for providing individual operations of such vehicle in accordance with such commands, a plurality of pads each operative to provide an address for selecting any individual one of the vehicles and to provide commands to such individual one of the vehicles for operating such individual one of the vehicles in accordance with such commands, a central station connected to individual ones of the pads and responsive to the address and the commands from each of the connected pads for sending the address and the commands from such pad to the vehicle selected by such pad to obtain an operation of such vehicle in accordance with such commands, each of the pads including a switch having first and second states of operation and operative in the first state to provide an operation of an individual one of the vehicles in the plurality only by such pad and operative in the second state to provide for the operation of such individual one of the vehicles simultaneously by such pad and at least another one of the pads, and means in the central station for obtaining the interrogation at each instant of only the individual ones of the pads in the plurality that are connected to the central station.

12. In a combination as set forth in claim 11, means in the central station for transmitting the addresses and commands from the interrogated pads to the vehicles in the plurality to obtain the operation, in accordance with such commands, of the vehicles addressed by the central station.

13. In a combination as set forth in claim 12, the central station being operative to send to the vehicles only changes in the addresses and commands from the pads relative to the addresses and commands previously sent by the pads to the vehicles.

14. In combination, a plurality of vehicles, a plurality of pads, each individual one of the pads including a plurality of switches having first and second states of operation for providing an address to select any individual one of the vehicles and for providing commands to such individual one of the vehicles for operating such individual one of the vehicles in accordance with such commands, a central station responsive to the operation of the switches in the first state in such individual one of the pads for sending the commands to the individual one of the vehicles addressed by such individual one of the pads, first means including a memory in the central station for storing in the memory the identity of the individual one of the vehicles last addressed by such individual one of the pads, and an additional switch disposed in the individual one of the pads and having first and second states of operation for providing for the selection again, in the second state of operation of the additional switch, by such individual one of the pads of the individual one of the vehicles stored in the memory for such individual one of the pads after such individual one of the pads has selected any one of the vehicles other than the individual one of the vehicles or after the individual one of the pads has failed to provide a command to the individual one of the vehicles for a particular period of time.

15. In a combination as set forth in claim 14, each of the pads including a particular switch having first and second states of operation and operable to the second state on a repetitive basis for a particular number of times to select any individual one of the vehicles, each of the pads including further switches having first and second states and operable to the second state to provide the commands for operating the individual one of the vehicles, and second means responsive in the central station to the operation of the additional switch in the individual one of the pads in the second state and to the operation of any one of the further switches in the individual one of the pads to the second state, after such individual one of the pads has selected one of the vehicles other than the individual one of the vehicles or after the individual one of the pads has failed to provide a command to the individual one of the vehicles for a particular period of time, for providing for the addressing again by such individual one of the pads of such individual one of the vehicles.

16. In combination for use with a central station and a plurality of vehicles for selecting and operating individual ones of the vehicles in accordance with addresses and commands provided by the central station, a pad in a plurality of pads, a first switch in the pad, the first switch having first and second states and operable on a repetitive basis to the second state for a particular number of times to select an individual one of the vehicles to be addressed by the pad, a plurality of additional switches in the pad, the additional switches having first and second states and operable to the second state in a particular pattern to obtain the operation of the individual one of the vehicles in accordance with the pattern of operation of the additional switches in the second state, a plurality of light indications in the pad, each of the light indications being associated with a different one of the vehicles in the plurality, means for energizing the light indications in sequence in accordance with the sequential operations of the first switch in the pad to the second state to select the individual one of the vehicles in the plurality, means for continuously energizing the individual one of the light indications associated with the individual one of the vehicles when the first switch in the pad has been operated to the second state on the sequential basis for the particular number of times to select the individual one of the vehicles to be addressed by the central station, means for skipping the energizing of the light indications associated with the vehicles addressed by the pads in the plurality other than the pad when the first switch in the pad is operated on the repetitive basis to address the individual one of the vehicles, and means in the pad for providing for the addressing of the individual one of the vehicles by another one of the pads in the plurality in addition to the addressing of the individual one of the vehicles by the pad.

17. In a combination as set forth in claim 16, means for sending to the central station a first plurality of binary indications representing the repetitive operation of the first switch in the pad to the second state to provide an address by the central station for the individual one of the vehicles in the plurality and for sending to the central station a second plurality of binary indications representing the pattern of operation of the additional switches in the pad to the second state to provide the commands by the central station for operating the individual one of the vehicles.

18. In combination for use in a system including a plurality of vehicles each responsive to an individual address and to a plurality of commands for providing individual operations of the vehicles in accordance with such commands, a plurality of pads each operative to provide an address for selecting any individual one of the vehicles and to provide commands to such individual one of the vehicles for operating such individual one of the vehicles in accordance with such commands, a central station, the pads being connected to the central station, first means in the central station for interrogating the pads to determine the address and the commands provided by such pads, second means responsive in the central station to the interrogation provided by the first means in the central station concerning the address and the commands from each pad for sending the address and the commands from such pad to the vehicle addressed by such pad to obtain an operation of such vehicle in accordance with such commands, the first means in the central station being operative to interrogate any additional pad connected to the central station at the instant that such additional pad is connected to the central station, and the second means being responsive in the central station to the interrogation provided by the first means in the central station concerning the address and the commands from the pads in the plurality and from the additional pad for sending signals representing the address and the commands from each such pad to the vehicle addressed by such pad, instantaneously after the additional pad is connected to the central station, to obtain an operation of such vehicle in accordance with such commands without affecting the interrogation of the pads in the plurality by the central station.

19. In a combination as set forth in claim 18, third means in the central station for providing for the sending at each instant by the second means of only the commands from the pads which are providing changes in addresses or commands at that instant.

20. In a combination as set forth in claim 18, the first means being operative to eliminate from interrogation by the central station of any one of the pads disconnected in the plurality from the central station and to provide such elimination at the instant that the pad is disconnected from the central station and without affecting the interrogation of the other pads by the central station and to provide for the addressing by any of the pads other than the disconnected pad, of the vehicle previously addressed by the disconnected pad.

21. In combination for use in a system including a plurality of vehicles each responsive to an individual address and to a plurality of commands for providing individual operations of the vehicles in accordance with such commands, a plurality of pads each operative to provide an address for selecting any individual one of the vehicles and to provide commands to such individual one of the vehicles for operating such individual one of the vehicles in accordance with such commands, a central station, the pads being connected to the central station, first means in the central station for interrogating the pads to determine the address and the commands provided by such pads, second means responsive in the central station to the interrogation provided by the first means in the central station concerning the address and the commands from each pad for sending signals representing the address and the commands from such pad to the vehicle addressed by such pad to obtain an operation of such vehicle in accordance with such commands, the first means in the central station being operative to eliminate, from the interrogation, any one of the pads disconnected in the plurality from the central station and to provide such elimination at the instant that the pad is disconnected from the central station and to provide such elimination without affecting the interrogation of the other pads by the central station and to provide for an addressing by any pad. other than the disconnected pad, of the vehicle previously addressed by the disconnected pad, the second means being responsive in the central station to the interrogation provided by the first means in the central station concerning the address and the commands from each of the pads interrogated by the central station for sending the signals representing the address and the commands from each such pad to the vehicle addressed by such pad to obtain an operation of such vehicle in accordance with such commands.

22. In a combination as set forth in claim 21, third means in the central station for providing for the transmission at each instant by the second means only of the commands from the pads which are providing changes in addresses or commands at that instant.

23. In combination for use in a system including a plurality of vehicles each responsive to an individual address and to a plurality of commands for providing individual operations of the vehicles in accordance with such commands, a plurality of pads each including a first switch having first and second states and operative to provide an address to any individual one of the vehicles dependent upon the number of the operations of such switch in the second state and including second switches each having first and second states and operative in the second state to provide a particular operation of the individual one of the vehicles, a central station responsive to the operation of the first switch in each of the pads in the second state for providing an address to any individual one of the vehicles dependent upon the number of operations of such first switch in such pad in the second state and responsive to the operations of the second switches in such pad in the second state for providing signals representing operations to be performed by such individual one of the vehicles, and means responsive in the central station to the operations in the second state of the second switches providing in a pair of the pads contradictory commands to the individual one of the vehicles for converting such contradictory commands to signals providing specialized commands different from the commands provided by the operation of the different ones of the second switches in such pads.

24. In a combination as set forth in claim 23, means in the central station for providing at each instant only the commands from the pads which are providing changes in addresses or commands at that instant, and means in the central station for sending to the vehicles in the plurality the commands provided by the last mentioned means in the central station.

25. In combination for use with a plurality of pads each operable to provide signals representing addresses and commands, a central station responsive to the addresses and commands from the pads for providing for each of the pads a first plurality of signals representing the address of any individual one of the vehicles and a second plurality of signals representing the commands for operating such individual one of the vehicles, the first and second pluralities of signals provided at the central station for each of the pads occurring at a particular rate selected in a particular range of rates, the central station also providing a plurality of start signals at the particular rate, a plurality of vehicles each having an individual address and each including first means responsive to the signals representing the individual address for such vehicle and responsive to the second signals providing the commands for such vehicle for operating such vehicle in accordance with such commands, and means responsive in each of the vehicles to the start signals from the central station for determining the particular rate of occurrence of the start signals and for providing for the response of the first means in the vehicle, at the particular rate of occurrence of the start signals, to the first signals representing the individual address of the vehicle and to the second signals providing the commands for such vehicle.

26. In a combination as set forth in claim 25, the central station being operative in a first mode to provide for the addressing of each individual one of the vehicles by only one of the pads in the plurality and being operative in a second mode to provide for the addressing of each individual one of the vehicles by at least two (2) of the pads in the plurality.

27. In combination, a plurality of vehicles, a plurality of pads each including a first switch having first and second states and operable in the second state to address any individual one of the vehicles dependent upon the number of operations of the first switch in the second state and each including a plurality of second switches each having first and second states, the second switches for each of the pads being operable in the second state in a pattern providing an operation of the selected vehicle dependent upon such switch operations in the second state, a central station, first means in the central station for interrogating the pads in the plurality to determine the number of operations of the first switch in the second state for each of the pads and the pattern of operations of the second switches in the second state for each of the pads, second means in the central station for providing, for each of the pads, a first plurality of signals providing an address of any one of the vehicles dependent upon the number of operations of the first switch in such pad in the second state and a second plurality of signals providing commands dependent upon the pattern of operation of the second switches in such pad in the second state, the first and second signals for each of the pads occurring at a particular rate, third means in the central station for providing a plurality of start signals at the particular rate, fourth means responsive in each of the vehicles to the start signals at the particular rate for operating upon the first plurality of signals in each of the pad's at the particular rate to identify the address individual to such vehicle and for operating upon the second plurality of signals at the particular rate to identify the commands related to the address individual to such vehicle, and fifth means for operating each vehicle in accordance with the commands provided for such vehicle.

28. In a combination as set forth in claim 27, sixth means associated in the central station with the second means for providing for the transmittal to the vehicles by the second means at each instant only of the signals representing changes in addresses or commands from the pads at that instant.

29. In a combination as set forth in claim 27, each of the pads including an additional switch having first and second states of operation and providing in the first state of operation for the addressing by such pad of one of the vehicles not addressed at that time by any of the other pads and providing in the second state of operation for the addressing of the one of the vehicles by the pad and by at least another one of the pads.

30. In combination for use with a plurality of vehicles, a plurality of pads each operative to address any individual one of the vehicles and to provide a plurality of binary indications providing commands for operating the addressed vehicle, a central station, first means operatively coupled in the central station to the pads in the plurality for providing packets of signals identifying for each pad the individual one of the vehicles addressed by such pad and the commands for operating the individual one of the vehicles, and second means responsive in each vehicle to the same identity of the signals providing the commands in two (2) successive packets addressed to such vehicle by the first means in the central station for operating such vehicle in accordance with the pattern of the signals in such packets.

31. In a combination as set forth in claim 30, means in the central station for interrogating the pads on a cyclic basis to obtain binary indications from each of the pads, on the cyclic basis with the other pads, of the individual one of the vehicles addressed by such pad and the binary indications providing commands for operating the individual one of the vehicles addressed by such pad.

32. In a combination as set forth in claim 30, means in the central station for transmitting to the vehicles at each instant only the binary indications from the pads which are providing changes in addresses or commands at that instant.

33. In a combination as set forth in claim 32, means in the central station for simultaneously interrogating the pads to obtain simultaneous binary indications from the pads of the individual ones of the vehicles addressed by such pads and the binary indications providing the commands for operating the individual ones of the vehicles.

34. In combination for use in a vehicle for moving the vehicle in accordance with commands which are provided by a pad to control the movements of the vehicle and which are converted by a central station to commands addressed by the central station to the vehicle to obtain the movements of the vehicle, a pair of left wheels in the vehicle, the left wheels being spaced from each other in a longitudinal direction, a pair of right wheels in the vehicle, the right wheels having the same spacing in the vehicle in the longitudinal direction as the left wheels, first means in the vehicle for receiving the commands addressed to the vehicle from the central station, a first motor in the vehicle for moving the left wheels in the vehicle in the longitudinal direction, a second motor in the vehicle for moving the right wheels in the vehicle in the longitudinal direction, the commands addressed to the vehicle from the central station including first signals for operating the first motor and second signals for operating the second motor, second means responsive in the vehicle to the first and second signals received by the vehicle from the central station for accelerating the first and second motors in progressive increments to the speeds commanded by the central station to such motors for movement of the vehicle in the longitudinal direction, and third means responsive in the vehicle to the first and second signals received by the vehicle from the central station for operating the first and second motors at the same speed, without any progressive increments in speed, for movement of the vehicle in the longitudinal direction when one of the motors has been previously operated at a different speed than the other motor, the same speed constituting the higher of the speeds provided by the first and second motors.

35. In a combination as recited in claim 34, fourth means responsive in the vehicle to the first and second signals received by the vehicle from the central station for converting the first and second signals to pulse width modulations in progressive periods of time, the pulse width modulations for each of the first and second motors at each instant having duty cycles dependent upon the speed at which such motor is to be operated at that instant, the operation of the second and third means at each instant being dependent upon such pulse width modulations at that instant and the duty cycles of such pulse width modulations at that instant.

36. In a combination as set forth in claim 34, fourth means responsive in the vehicle to the failure of the vehicle to receive the first and second signals for a particular period of time for maintaining the same operation of the first and second motors for such particular period of time as the operation of such motors upon the last reception by the vehicle of the first and second signals from the central station.

37. In combination for use in a vehicle for moving the vehicle in accordance with commands which are provided by a pad to control the movements of the vehicle and which are converted by a central station to commands addressed by the central station to the vehicle to obtain the movements of the vehicle, a pair of left wheels in the vehicle, the left wheels being spaced from each other in a longitudinal direction, a pair of right wheels in the vehicle, the right wheels having the same spacing in the longitudinal direction as the left wheels, a first motor in the vehicle for moving the left wheels in the vehicle in the longitudinal direction, a second motor in the vehicle for moving the right wheels in the vehicle in the longitudinal direction, the commands addressed to the vehicle from the central station including first signals for operating the first motor and second signals for operating the second motor, first means in the vehicle for receiving the commands addressed to the vehicle from the central station, second means responsive in the vehicle to the first and second signals received by the vehicle from the central station for operating the first and second motors in accordance with such signals, and third means responsive in the vehicle to the failure of the vehicle to receive the first and second signals for a particular period of time for maintaining the same operation of the first and second motors for such particular period of time as the operation of the motors upon the last reception by the vehicle of the first and second signals from the central station.

38. In a combination as set forth in claim 37, fourth means responsive in the vehicle to the first and second signals received by the vehicle from the central station for accelerating the first and second motors in progressive increments to the speeds commanded by the central station to such motors for movement of the vehicle in the longitudinal direction.

39. In combination for use in a vehicle for moving the vehicle in accordance with commands which are provided by a pad to control the movements of the vehicle and which are converted by a central station to commands addressed by the central station to the vehicle to obtain the movements of the vehicle, a pair of left wheels in the vehicle, the left wheels being spaced from each other in a longitudinal direction, a pair of right wheels in the vehicle, the right wheels having the same spacing in the longitudinal direction as the left wheels, a first motor in the vehicle for moving the left wheels in the vehicle in the longitudinal direction, a second motor in the vehicle for moving the light wheels in the vehicle in the longitudinal direction, the commands addressed to the vehicle from the central station including first signals for operating the first motor and second signals for operating the second motor, first means in the vehicle for receiving the commands addressed to the vehicle from the central station, second means responsive in the vehicle to the first and second signals received by the vehicle from the central station for operating the first and second motors in accordance with such signals, the vehicle being operative in a powered and active state and in a powered and inactive state, third means responsive in the vehicle to the failure of the vehicle in the powered and active state to receive the first and second signals for a particular period of time for maintaining the same operation of the first and second motors for such particular period of time as the operation of the motors upon the last reception by the vehicle of the first and second signals from the central station, fourth means operative at the end of the particular time period for converting the operation of the vehicle from a powered and active state to a powered but inactive state when the vehicle fails to receive the first and second signals during the particular time period, and fifth means responsive in the vehicle to the first and second signals received by the vehicle from the central station for operating the first and second motors in accordance with such first and second signals only when the first means has received the same first and second signals from the central station a plurality of successive times.

40. In combination, a plurality of pads, a plurality of vehicles, each of the pads providing first binary indications representing an address of any individual one of the vehicles and second binary indications representing individual operations to be provided by such vehicle, a central station responsive to the first and second binary indications from the different pads for producing for each of the pads first signals providing an individual address for the individual one of the vehicles addressed by such pad and second signals providing commands for moving such vehicle in a particular direction and for operating such vehicle, means responsive in each of the vehicles to the first signals addressing such vehicle from the central station and to the second signals from the central station for such vehicle for moving such vehicle and operating such vehicle in accordance with the commands provided by the central station to such vehicle, means operative in each of the vehicles for continuing to provide a movement of such vehicle for a particular period of time in accordance with the last commands addressed to such vehicle by the central station when the vehicle fails to receive any commands addressed to such vehicle during such particular period of time, and means in the central station for providing for the transmittal to the vehicles from the central station only of changes in the address or commands in each of the pads from the address or commands previously provided in the pad.

41. In a combination as set forth in claim 40, means in each of the vehicles for converting the vehicle to an inactive but powered state when the vehicle fails to receive any commands from the central station for the particular period of time, and means in each of the vehicles for providing for a change in such vehicle from the inactive but powered state to a depowered state at the end of a second particular period of time when such vehicle fails to receive any commands addressed to such vehicle from the central station for any of the pads during such second particular period of time.

42. In a combination as set forth in claim 40, means responsive in each of the vehicles to the commands addressed to the vehicle relating to movements of the vehicle at a particular speed for accelerating the vehicle in progressive increments to the particular speed.

43. In combination, a plurality of pads, a plurality of vehicles, each of the pads providing first binary indications representing a selection of any individual one of the vehicles and second binary indications representing individual operations to be provided by such vehicle, a central station responsive to the first and second binary indications from the different pads for producing for each of the pads first signals providing an individual address for any individual one of the vehicles selected by such pad, the pads being connected to the central station, each of the vehicles including a pair of left wheels spaced from each other in a longitudinal direction and a pair of right wheels spaced from each other in the longitudinal direction and including a first motor for moving the left wheels and a second motor for moving the right wheels, the commands addressed to the vehicle from the central station including second signals for operating the first motor and third signals for operating the second motor, first means in each of the vehicles for receiving the first, second and third signals addressed to such vehicle from the central station, second means responsive in each of the vehicles to the second and third signals received by the vehicle from the central station for accelerating the first and second motors in progressive increments to the speeds commanded by the central station to such motors for movement of such vehicle in the longitudinal direction, and third means responsive in each of the vehicles to the second and third signals received by such vehicle from the central station for operating the first and second motors at the same speed without any increment in speed when one of the motors in such vehicle has been previously operated at a different speed then the other motor in such vehicle, the same speed constituting the higher of the speeds provided by the first and second motors in such vehicle.

44. In a combination as recited in claim 43, third means responsive in each of the vehicles to the second and third signals received by such vehicle from the central station for movement of such vehicle in the longitudinal direction for operating the first and second motors at the same speed, without any progressive increments in speed, when one of the motors in such vehicle has been previously operated at a different speed than the other motor in such vehicle, the same speed constituting the higher of the speeds provided by the first and second motors in such vehicle.

45. In a combination as set forth in claim 44, means operative in each of the vehicles for continuing to operate the first and second motors for a particular period of time in accordance with the last ones of the second and third signals received by such vehicle from the central station when such vehicle fails to receive the second and third signals addressed to such vehicle during such particular period of time.

46. In combination, a plurality of pads, a plurality of vehicles, each of the pads providing first binary indications representing a selection of any individual one of the vehicles and second binary indications representing individual operations to be provided by such vehicles, a central station responsive to the first and second binary indications from the different pads for producing for each of the pads first signals providing an individual address for any individual one of the vehicles selected by such pad and second signals providing commands for moving such vehicle in a particular direction and for operating such vehicle, first means in each of the vehicles for receiving the first and second signals from each of the pads, second means responsive in each of the vehicles to the second signals addressed to such vehicle for determining whether successive ones of the second signals addressed to such vehicle are identical, and third means in each of the vehicles for operating such vehicle in accordance with the second signals addressed to such vehicle when the second means in such vehicle determines that the successive ones of the second signals addressed to such vehicle are identical.

47. In a combination as set forth in claim 46, the third means in each of the vehicles being operative to operate such vehicle in accordance with the second signals addressed to such vehicle in the second of the successive ones of the second signals addressed to such vehicle when the second means in such vehicle determines that the successive ones of the second signals addressed to such vehicle are identical.

48. In a combination as set forth in claim 46, the first and second signals for each of the vehicles being in the form of successive packets each having a first particular number of the first signals and a second particular number of the second signals, fourth means for determining whether at least a particular percentage of the packets addressed to each of the vehicles has the first particular number of the first signals and the second particular number of the second signals in such packets during a particular period of time, and fifth means for operating each of the vehicles in accordance with the second signals in the packets addressed to such vehicle when the fourth means in such vehicle determines that at least the particular percentage of the packets addressed to such vehicle during the particular period of time has the first particular number of the first signals and the second particular number of the second signals in the packets.

49. In combination, a plurality of pads, a plurality of vehicles, each of the pads providing first binary indications representing an addressing of any individual one of the vehicles and second binary indications representing individual operations to be provided by such addressed vehicle, a central station responsive to the first and second binary indications from the different pads for producing for each of the pads first signals providing an individual address for any individual one of the vehicles selected by such pad and second signals providing commands for moving such vehicle in a particular direction and for operating such vehicle, first means in each of the vehicles for receiving the first and second signals from each of the pads, the first and second signals for each of the vehicles being in the form of packets each having a first particular number of the first signals and a second particular number of the second signals, second means for determining whether at least a particular percentage of the successive packets addressed to each of the vehicles during a particular period of time has the first particular number of the second signals in each packet, and third means for operating each of the vehicles in accordance with the second signals in the successive packets addressed to such vehicle when the second means in each vehicle determines that at least the particular percentage of the packets addressed to such vehicle during the particular period of time has the second particular number of the second signals in the packets.

50. In a combination as set forth in claim 49, the central station being operative to interrogate each of the pads to determine the first and second binary indications from such pad, and means in the central station for sending to the vehicles at each instant only the binary indications representing changes in the addresses or commands from the pads at that instant.

51. In combination in a vehicle for use with a central station operative to receive, from a plurality of pads, first binary indications representing the address of the vehicle and second binary indications representing operations to be performed by the vehicle and operative to send to the vehicle first signals in accordance with the first binary indications and second signals in accordance with the second binary indications, first means in the vehicle for receiving the first and second signals from the central station for each of the pads, second means in the vehicle for determining whether successive ones of the second signals addressed to such vehicle are identical, and third means in each of the vehicles for operating such vehicle in accordance with the second signals addressed to such vehicle when the second means in such vehicle determines that the successive ones of the second signals addressed to such vehicle on the cyclic basis are identical.

52. In a combination as set forth in claim 51 wherein the successive ones of the second signals are addressed to the vehicle on a cyclic basis and wherein the third means in each of the vehicles is operative to operate such vehicle in accordance with the second ones of the second signals addressed to such vehicle when the second means in such vehicle determines that the successive ones of the second signals addressed to such vehicle are identical.

53. In a combination as set forth in claims including, fourth means responsive to first ones of the second signals addressed to such vehicle for moving the vehicle, and fifth means responsive to second ones of the second signals addressed to such vehicle for providing operations of the vehicle other than moving the vehicle.

54. In a combination as set forth in claim 51.

the first and second signals for the vehicle being in the form of packets each having a first particular number of the first signals and a second particular number of the second signals, sixth means for determining whether at least a particular percentage of the packets addressed to the vehicle during a particular period of time has the second particular number of the second signals in such packets, and seventh means for operating the vehicle in accordance with the second signals in the packets addressed to such vehicle when the sixth means in such vehicle determines that at least the particular percentage of the packets addressed to such vehicle during the particular period of time has the second particular number of the second signals in the packets.

55. In combination in a vehicle for use with a central station operative to receive, from a plurality of pads, first binary indications representing the address of the vehicle and second binary indications representing operations to be performed by the vehicle and for sending first signals in accordance with the first binary indications and second signals in accordance with the second binary indications, first means in the vehicle for receiving the first and second signals from the central station in representation of the binary indications from each of the pads, the first and second signals for the vehicle being in the form of packets each having a first particular number of the first signals and a second particular number of the second signals, second means in the vehicle for determining whether at least a particular percentage of the packets addressed to the vehicle during a particular period of time has the second particular number of the second signals in such packets, and third means in the vehicle for operating the vehicle in accordance with the second signals in the packets addressed to such vehicle when the second means in such vehicle determines that at least the particular percentage of the packets addressed to such vehicle during the particular period of time has the second particular number of the second signals in the packets.

56. In a combination as set forth in claim 55, the vehicle including wheels and motors for rotating the wheels and including at least one member movable on the vehicle to perform selective functions, the third means being responsive in the vehicle to the second signals for rotating the wheels in the vehicle to obtain a movement of the vehicle in accordance with such wheel rotations and for moving the member to perform the selective functions.

57. In combination for use in a system including a central station and a plurality of vehicles and a plurality of pads each operable to provide first binary indications providing an address to any individual one of the vehicles and second binary indications providing commands for operating the individual one of the vehicles and each operable to provide the first and second binary indications to the central station for the transmission by the central station to the vehicles of signals indicating the first and second binary indications from each of the pads, a microcontroller in the central station, a first line extending between the microcontroller and the pads in the plurality to provide an interrogation by the central station of such pads with respect to the first and second binary indications from such pads, a second plurality of lines each extending between the microcontroller and an individual one of the pads for providing clock signals from the central station to the individual one of the pads for controlling the time of the interrogation of such individual one of the pads by the central station, and a third plurality of lines each extending between the microcontroller and an individual one of the pads for providing the first and second binary indications from the individual one of the pads to the central station in response to the interrogation by the central station to the individual one of the pads.

58. In a combination as set forth in claim 57, the lines in the second plurality introducing the clock signals in sequence to the different ones of the pads on a cyclic basis to obtain an interrogation of the pads by the central station when the pads receive the clock signals, and the lines in the third plurality providing the first and second binary indications from the pads to the central station when the pads are interrogated by the central station.

59. In a combination as set forth in claim 57, the lines in the second plurality introducing the clock signals simultaneously to the different ones of the pads to obtain a simultaneous interrogation of the different pads by the central station, and the lines in the third plurality providing the first and second binary indications from the pads when the pads are interrogated by the central station.

60. In a combination as set forth in claim 57, the clock signals having first and second polarities, the interrogation of the pads in the plurality by the central station occurring when the clock signals on the lines in the second plurality have a particular one of the first and second polarities.

61. In combination for use in a system including a central station and a plurality of vehicles and a plurality of pads each operable to provide first binary indications providing an address to any individual one of the vehicles and second binary indications providing commands for operating the individual one of the vehicles and each operable to provide the first and second binary indications to the central station for the transmission by the central station to the vehicles of the first and second binary indications from each of the pads, a first line extending between the central station and the pads in the plurality to provide an interrogation of such pads by the central station of the first and second binary indications from such pads, a second plurality of lines each extending between the central station and an individual one of the pads for providing clock signals from the central station to the individual one of the pads for controlling the time of the interrogation of such individual one of the pads by the central station, and a third plurality of lines each extending between the central station and an individual one of the pads for providing the first and second binary indications from the individual one of the pads to the central station in response to the interrogation by the central station to the individual one of the pads, the lines in the third plurality also providing binary indications from the central station to each individual one of the pads in the plurality, after the provision of the first and second binary indications from such individual one of the pads to the central station, of the particular one of the vehicles addressed by each individual one of the pads.

62. In a combination as set forth in claim 61, the lines in the second plurality introducing the clock signals in sequence to the different ones of the pads on a cyclic basis to obtain an interrogation of the pads by the central station when the pads receive the clock signals, and the lines in the third plurality providing the first and second binary indications from the pads to the central station when the pads are interrogated by the central station, each of the pads having a plurality of lights each indicating a different one of the vehicles, and means for illuminating a particular one of the lights on each of the pads in accordance with the particular one of the vehicles addressed by such pad.

63. In a combination as set forth in claim 61, the lines in the second plurality introducing the clock signals simultaneously to the different ones of the pads to obtain a simultaneous interrogation of the different pads by the central station, and the lines in the third plurality providing the first and second binary indications from the pads when the pads are interrogated by the central station, each of the pads having a plurality of lights each indicating a different one of the vehicles, and means for illuminating a particular one of the lights on each of the pads in accordance with the particular one of the vehicles addressed by such pad.

64. In a combination as set forth in claim 63, the clock signals having first and second polarities, the interrogation of the pads in the plurality by the central station occurring when the clock signals on the lines in the second plurality have a particular one of the first and second polarities, the illumination of the particular one of the lights on each of the pads by the indications from the central station to such pad through the line in the third plurality for such pad in representation of the particular one of the vehicles addressed by such pad occurring when the clock signals on the lines in the second plurality have the other one of the first and second polarities.

65. In combination for use in a system including a central station and a plurality of vehicles and a plurality of pads each operable to provide first binary indications providing an address to any individual one of the vehicles and second binary indications providing commands for operating the individual one of the vehicles and each operable to provide the first and second binary indications to the central station for the transmission by the central station to the vehicles of signals representing the first and second binary indications from each of the pads, a first line extending between the central station and the pads in the plurality to provide an interrogation by the central station of such pads with respect to the first and second binary indications from such pads, a plurality of second lines each extending between the central station and an individual one of the pads for providing clock signals from the central station to the individual one of the pads for controlling the time of interrogation of the individual one of the pads by the central station, and a plurality of third lines each providing an indication from the central station to the individual one of the pads of the vehicle addressed by such individual one of the pads.

66. In a combination as set forth in claim 65, the clock signals having first and second polarities, each of the third lines providing the first and second binary indications in an individual one of the pads to the central station in the first polarity of the clock signals and each providing an indication from the central station to the individual one of the pads, in the second polarity of the clock signals, of the vehicle addressed by such individual one of the pads.

67. In a combination as set forth in claim 66, the second lines introducing the clock signals in sequence to the different ones of the pads on a cyclic basis to obtain an interrogation of the pads by the central station when the pads receive the clock signals, and the third lines providing in sequence the indications from the central station to the individual ones of the pads of the vehicles addressed by such individual ones of the pads when the pads are interrogated by the central station.

68. In a combination as set forth in claim 65, a plurality of lights in each of the pads, each of such lights providing an indication, when illuminated, of an individual one of the vehicles, and means for illuminating an individual one of the lights in each of the pads in accordance with the indication from the central station to such pad of the vehicle addressed by such pad.

69. In a combination as set forth in claim 66, the second lines introducing the clock signals simultaneously to the different ones of the pads to obtain a simultaneous interrogation of the different pads by the central station, and the third lines providing the first and second binary indications simultaneously from the central station to the individual ones of the pads of the vehicles addressed by such individual ones of the pads when the pads are interrogated by the central station.

70. In combination for use in a system including a central station and a plurality of vehicles and a plurality of pads each operable to provide first binary indications providing an address to any individual one of the vehicles and second binary indications providing commands for operating the individual one of the vehicles and each operable to provide the first and second binary indications to the central station for the transmission by the central station to the vehicles of signals representing the first and second binary indications from each of the pads, a first line extending between the central station and the pads in the plurality to provide an interrogation of such pads of the first and second binary indications from such pads, a plurality of second lines each extending between the central station and an individual one of the pads for providing clock signals to the individual one of the pads for controlling the time of the interrogation of such individual one of the pads by the central station, and a plurality of third lines each extending between the central station and an individual one of the pads for providing the first and second binary indications from the individual one of the pads to the central station in response to the interrogation by the central station to the individual one of the pads, the extension of the third lines between the central station and the pads providing for the decoupling of any one of the pads from the central station without affecting the provision of the first and second binary indications from the other ones of the pads to the central station.

71. In a combination as set forth in claim 70, each of the third lines providing an indication from the central station to the individual one of the pads of the vehicle addressed by such individual one of the pads, the extension of the third lines between the central station and the pads providing for a decoupling of any one of the pads from the central station and for an elimination of the indication in the pad of the vehicle addressed by the pad without affecting the provision of the indications from the central station to the other pads of the vehicles addressed by such other ones of the pads and providing for the addressing of the vehicle by any of the other pads.

72. In a combination as set forth in claim 70, the extensions of the third lines between the central station and the pads providing for the extensions of additional third lines between additional pads and the central station to provide first and second binary indications from each of such additional pads to the central station in response to interrogations by the central station to the individual ones of such additional pads without affecting the provision of the first and second binary indications from the pads in the plurality to the central station and without affecting the provision of the indications from the central station to the pads in the plurality of the vehicles addressed by such pads in the plurality and to provide such binary indications at the instant that such extensions of the additional third lines are provided between the additional pads and the central station.

73. In a combination as set forth in claim 71, the extensions of the third lines between the central station and the pads providing for the extensions of additional third lines between additional pads and the central station to provide first and second binary indications from each of such additional pads to the central station in response to interrogations by the central station to the individual ones of such additional pads without affecting the provision of the first and second binary indications from the pads in the plurality to the central station and without affecting the provision of the indications from the central station to the pads in the plurality of the vehicles addressed by such pads in the plurality and to provide such binary indications at the instant that such extensions of the additional third lines are provided between the additional pads and the central station.

74. In combination for use in a system including a central station and a plurality of vehicles and a plurality of pads each operable to provide first binary indications providing an address to any individual one of the vehicles and second binary indications providing commands for operating the individual one of the vehicles and each operable to provide the first and second binary indications to the central station for the transmission by the central station to the vehicles of signals representing the first and second binary indications from each of the pads, a first line extending between the central station and the pads in the plurality to provide an interrogation of such pads of the first and second binary indications from such pads, a plurality of second lines each extending between the central station and an individual one of the pads for providing clock signals to the individual one of the pads for controlling the time of the interrogation of such individual one of the pads by the central station, and a plurality of third lines each extending between the central station and an individual one of the pads for providing the first and second binary indications from the individual one of the pads to the central station in response to the interrogation by the central station to the individual one of the pads, the extensions of the third lines between the central station and the pads providing for the extensions of additional third lines between additional pads and the central station to provide first and second binary indications from each of such additional pads to the central station in response to interrogations by the central station to the individual ones of such additional pads without affecting the provision of the first and second binary indications from the pads in the plurality to the central station and without affecting the provision of the indications from the central station to the pads in the plurality of the vehicles addressed by such pads in the plurality and to provide such binary indications at the instant that such extensions of the additional third lines are provided between the additional pads and the central station.

75. In combination for use in a system including a central station and a plurality of vehicles and a pad operable to provide first binary indications providing an address to any individual one of the vehicles and second binary indications providing commands for operating the individual one of the vehicles and operable to provide the first and second indications to the central station for the transmission by the central station to the vehicles of signals representing the first and second binary indications from the pad, a first line extending between the central station and the pad to provide an interrogation by the central station of such pad with respect to the first and second binary indications in such pad, a second line extending between the central station and the pad for providing clock signals to the individual one of the pads from the central station for controlling the time of the interrogation of such pad by the central station, a third line extending between the central station and the pad for providing the first and second binary indications from the pad to the central station in response to the interrogation by the central station to the pad, first means for storing the first and second binary indications in the pad, and second means associated with the second and third lines for providing a transfer of the binary indications in the first means to the third line in synchronism with the clock signals on the second line when an interrogation of such pad is provided on the first line.

76. In a combination as set forth in claim 75 wherein the first means stores the first and second binary indications in the pad in a parallel form and the second means transfers the binary indications in the first means to the third line in a serial form.

77. In a combination as set forth in claim 75 wherein the first line provides a first voltage to provide an interrogation of the first and second binary indications in such pad in synchronism with the clock signals on the second line and wherein the central station provides through the first line to the pad signals identifying the vehicle selected by the pad and wherein the central station provides such identifying signals to the pad in synchronism with the clock signals on the second line during the time that a second voltage different from the first voltage is produced on the first line.

78. In combination as set forth in claim 77, the pad providing a plurality of lights each indicating, when illuminated, the addressing of an individual one of the vehicles by the pad and wherein means are provided for illuminating a particular one of the lights in accordance with the signals passing through the third line from the central station to the pad.

79. In combination for use in a system including a central station and a plurality of vehicles and a pad manually operable to provide first binary indications providing an address to any individual one of the vehicles and second binary indications providing commands for operating the individual one of the vehicles and operable to provide the first and second binary indications to the central station for the transmission by the central station to the vehicles of the first and second binary indications from the pad, a first line extending between the central station and the pad and having a first voltage at first particular times and having a second voltage at second particular times different from the first particular times, a second line extending between the central station and the pad to provide a transfer of information between the central station and the pad, first means for interrogating the pad to determine the pattern of the first and second binary indications in the pad when the first line has the first voltage, second means operative during the production of the first voltage on the first line for passing the first and second binary indications in the pad to the central station for the transmission to the vehicles by the central station of signals representing such first and second binary indications, and third means operative during the production of the second voltage on the first line for transmitting to the pad through the second line from the central station signals identifying an individual one of the vehicles addressed by the first binary indications from the pad.

80. In a combination as set forth in claim 79, there being in the pad a plurality of lights each indicating, when illuminated, an individual one of the vehicles addressed by the pad, and means responsive to the signals passing through the second line from the central station to the pad during the production of the second voltage on the first line for illuminating the light identifying the individual one of the vehicles addressed by the first binary indications from the pad.

81. In combination for use with a plurality of vehicles each having an individual address and each operable when receiving the individual address, a central station, a plurality of pads each operable to address any individual one of the vehicles and each providing commands to operate the individual one the vehicles, each of the pads being connected to the central station for receiving power from the central station to provide first binary indications addressing any individual one of the vehicles and second binary indications providing commands for operating the vehicles, first means in the central station for interrogating each of the pads, separately from the interrogations of the other pads, to determine the first and second binary indications from the pad, second means in the pads for transmitting the first and second binary indications from the pads to the central station upon the interrogation of the pads by the central station, third means in the central station for transmitting to the vehicles the first and second binary indications determined from each of the pads, the central station and the pads being constructed to provide for a disconnection of any particular one of the pads from the central station and to provide for an addressing by any of the pads other than the disconnected pad of the vehicle previously being addressed by the disconnected pad, the first means being operative to interrogate the other pads, without any interrogation of the particular one of the pads, instantaneously after the disconnection of the particular one of the pads from the central station, the second means in the pads being operative to transmit the first and second binary indications from the other pads to the central station, without any transmission of any indications from the particular one of the pads to the central station, instantaneously after the disconnection of the particular one of the pads from the central station, the third means in the central station being operative to transmit the first and second binary indications from the other pads to the vehicles, without any transmission by the third means of binary indications from the particular one of the pads to the vehicles, instantaneously after the disconnection of the particular one of the pads from the central station, and fourth means responsive in the central station instantaneously to the disconnection of the particular one of the pads from the central station for freeing the vehicle addressed by the particular one of the pads to receive from the central station first binary indications provided by any one of the pads other than the disconnected pad and representing the address of such vehicle and second binary indications provided by such one of the pads and representing commands to such vehicle and for freeing the vehicle to be operated in accordance with such second binary indications.

82. In a combination as set forth in claim 81, the first means being operative to interrogate the pads in the plurality on a cyclic basis before the disconnection of the particular one of the pads from the central station and to interrogate the pads in the plurality, other than the particular one of the pads, on the cyclic basis instantaneously after the disconnection of the particular one of the pads from the central station.

83. In a combination as set forth in claim 81, the first means being operative to interrogate the pads in the plurality simultaneously before the disconnection of the particular one of the pads from the central station and to interrogate the pads in the plurality, other than the particular one of the pads, simultaneously and instantaneously after the disconnection of the particular one of the pads from the central station.

84. In a combination as set forth in claim 81, fifth means in each of the pads for providing for an illuminated indication in such pad of the individual one of the vehicles addressed by such pad, and sixth means in each of the vehicles for providing in such vehicle an illumination indicating the addressing of such vehicle, seventh means in the central station for discontinuing the illumination of vehicle addressed by the particular one of the pads when the particular one of the pads is disconnected from the central station, and eighth means in the central station for discontinuing the illuminated indication in the particular one of the pads of the vehicle addressed by the particular one of the pads when the particular one of the pads is disconnected from the central station.

85. In combination for use with a plurality of vehicles each having an individual address and each operable when receiving the individual address, a central station, a plurality of pads each operable to address any individual one of the vehicles and each providing commands to operate the individual one of the vehicles, each of the pads being connected to the central station for receiving power from the central station to provide first binary indications addressing any individual one of the vehicles and second binary indications providing commands for operating the individual one of the vehicles, first means in the central station for interrogating each of the pads, separately from the interrogations of the other pads, to determine the first and second binary indications from such pad, second means in the pads for transmitting the first and second binary indications from the pads to the central station upon the interrogation of the pads by the central station, third means in the central station for transmitting to the vehicles signals representing the first and second binary indications determined from each of the pads, the central station and the pads being constructed to provide for the connection of an additional pad to the central station, the first means in the central station being operative to interrogate the pads in the plurality and the additional pad instantaneously after the connection of the additional pad to the central station, the second means in the pads being operative to transmit the first and second binary indications from the pads in the plurality and the additional pad to the central station instantaneously after the connection of the additional pad to the central station, and the third means in the central station being operative to transmit signals representing the first and second binary indications from the pads in the plurality and the additional pad to the vehicles in the plurality instantaneously after the connection of the additional pad to the central station.

86. In a combination as set forth in claim 85, the first means being operative to interrogate the pads in the plurality on a cyclic basis before the connection of the additional pad to the central station and to interrogate the pads in the plurality and the additional pad on the cyclic basis instantaneously after the connection of the additional pad to the central station.

87. In a combination as set forth in claim 85, the first means being operative to interrogate the pads in the plurality simultaneously before the connection of the additional pad to the central station and to interrogate simultaneously the pads in the plurality and the additional pad instantaneously after the connection of the additional pad to the central station.

88. In a combination as set forth in claim 85, fourth means in each of the pads for providing for an illuminated indication in such pad of any individual one of the vehicles addressed by such pad, fifth means in the central station for providing in such pad an illumination indicating any individual one of the vehicles addressed by such pad, the fifth means in the central station being operative to continue the illumination of the vehicles addressed by the pads in the plurality and to provide an illumination of the vehicle addressed by the additional pad instantaneously after the additional pad is connected to the central station.

89. In a combination as set forth in claim 1, the pads in the plurality being connected to the central station, and means in the central station for discontinuing the operation of the vehicle by the individual one of the pads instantaneously after the individual one of the pads is disconnected from the central station and for providing for the addressing of the vehicle by any one of the pads still connected to the central station.

90. In a combination as set forth in claim 5, the pads in the plurality being connected to the central station, and means in the central station for providing for the operation of the individual one of the vehicles by any one of the pads still connected to the central station instantaneously after the individual one of the pads is disconnected from the central station.

91. In a combination as set forth in claim 60, the central station providing indications, through the third line for each of the pads, to such pad of the individual one of the vehicles addressed by such pad, and means in each of the pads for indicating the individual one of the vehicles addressed by such pad in accordance with the indications provided by the central station to such pad through the third line for such pad.

92. In a combination as set forth in claim 69, a plurality of lights in each of the pads, each of such lights providing an indication, when illuminated, of an individual one of the vehicles addressed by the pad, and means for illuminating an individual one of the lights in each of the pads in accordance with the indication from the central station to such pad of the vehicle addressed by such pad.

93. In combination for use with a plurality of vehicles, a plurality of pads each operative to provide a first plurality of binary indications addressing any individual one of the vehicles and to provide a second plurality of binary indications providing commands to such individual one of the vehicles for operating such vehicle, a central station, the pads in the plurality being connected to the central station, first means in the central station for interrogating the pads to determine the first and second binary indications from such pads, second means in the pads for transmitting the first and second binary indications from the pads to the central station, and third means responsive in the central station to the identities of the first binary indications in successive transmissions of the first and second binary indications from each individual one of the pads to the central station for transmitting to the vehicles signals representing the first and second binary indications for such pad, fourth means in the central station for providing a transmittal by the second means at each instant only of the second binary indications from the pads which are providing changes in address or commands at that instant.

94. In a combination as set forth in claim 93, an additional pad being connected to the central station, and fifth means in the central station for providing for an addressing by the additional pad of any of the vehicles not being addressed by the pads in the plurality and for providing for a transmission by the third means of the signals representing the first and second binary indications for the additional pad to the vehicles in the plurality instantaneously after the additional pad is connected to the central station.

95. In a combination as set forth in claim 93, the first means in the central station being operative to interrogate the pads on a cyclic basis to obtain the binary indications from each of the pads, on the cyclic basis with the other pads, of the individual one of the vehicles addressed by such pad and the binary indications for providing commands for operating the individual one of the vehicles.

96. In a combination as set forth in claim 93, the first means in the central station being operative to simultaneously interrogate the pads to obtain simultaneously from the pads the first binary indications providing the addresses for the individual ones of the vehicles and the second binary indications providing the commands for operating the individual ones of the vehicles.

97. In combination for operating a vehicle in accordance with addresses and commands provided by a plurality of pads and transmitted by a central station to the vehicle, first means in the vehicle for receiving the addresses and commands provided by the pads and transmitted by the central station, second means in the vehicle for identifying the received addresses as those of the vehicle, third means responsive in the central station to the identification of the addresses received from the pads as those of the vehicle for providing for an execution of the received commands by the vehicle in accordance with such commands when the identified commands are complementary, and fourth means responsive in the central station to the identification of the addresses received from the pads as those of the vehicle for providing for an execution by the vehicle of commands different from the commands provided by the pads when the commands are contradictory.

98. In a combination as set forth in claim 97, fifth means responsive in the vehicle to the discontinuance of one of the pads in the plurality in addressing the vehicle for continuing the response of the vehicle to the addresses and commands from the pads still addressing the vehicle.

99. In a combination as set forth in claim 18, the first means being operative to interrogate the pads in the plurality and the additional pad on a cyclic basis, the second means being responsive on the cyclic basis to the interrogation provided by the first means of the pads in the plurality and the additional pad for sending the addresses and commands to the addressed vehicles to obtain an operation of such vehicles in accordance with such commands.

100. In a combination as provided in claim 18, the first means being operative to interrogate the pads in the plurality and the additional pad simultaneously, the second means being responsive to the simultaneous interrogation provided by the first means of the pads in the plurality and the additional pad for sending the addresses and commands to the addressed vehicles to obtain an operation of such vehicles in accordance with such commands.

101. In combination for use in a system including a plurality of vehicles each responsive to an individual address and to a plurality of commands for providing individual operations of vehicles in accordance with such commands, a plurality of pads each operative to provide an address for selecting any individual one of the vehicles and to provide commands to such individual one of the vehicles for operating such individual one of the vehicles in accordance with such commands, a central station the pads being connected to the central station, first means in the central station for interrogating the pads to determine the address and the commands provided by such pads, second means responsive in the central station to the interrogation provided by the first means in the central station concerning the address and the commands from each pad for receiving the address and the commands from such pad and for transmitting to the vehicles signals representing the address and the commands from such pad, and third means responsive in the central station to any change in the address or commands from an individual one of the pads for transmitting the address and the commands from such pad to the vehicles in the plurality on a priority basis relative to the address and commands from the other pads in the plurality.

102. In a combination as set forth in claim 101 wherein the central station discontinues an interrogation of any pad which is disconnected from the central station instantaneously after the pad is disconnected from the central station and wherein the central station provides for the addressing by any of the pads still connected to the central station of the vehicle previously addressed by the disconnected pad.

103. In a combination as set forth in claim 101 wherein the central station transmits the address and commands from the individual one of the pads in the plurality to the vehicles in the plurality only when the central station has completed the transmission to the vehicles in the plurality of the address and commands of the pad whose address and commands the central station has been transmitting at the time that the central station receives the change in the address and the commands from the individual one of the pads in the plurality.

104. In combination for use in a system including a plurality of vehicles each responsive to an individual address and to a plurality of commands for providing individual operations of vehicles in accordance with such commands, a plurality of pads each operative to provide an address for selecting any individual one of the vehicles and to provide commands to such individual one of the vehicles for operating such individual one of the vehicles in accordance with such commands, a central station the pads being-connected to the central station, first means in the central station for interrogating the pads to determine the address and the commands provided by such pads, second means responsive in the central station to the interrogation provided by the first means in the central station concerning the address and the commands from such pads for receiving the address and the commands from such pads and for transmitting the address and the commands from such pads to the vehicles in the plurality, and third means responsive in the central station to the connection of an additional pad, other than the pads in the plurality, to the central station and to the reception by the central station of the address and commands from such additional pad for initially transmitting such address and commands from such additional pad on a priority basis relative to the transmission of the address and commands from the pads in the plurality.

105. In a combination as set forth in claim 104 wherein the central station is operative to transmit to the vehicles at each instant only the addresses and commands from the pads which are providing changes in addresses or commands at that instant.

106. In a combination as set forth in claim 104 wherein the central station transmits the address and commands from the additional pad to the vehicles in the plurality only when the central station has completed the transmission to the vehicles in the plurality of the address and commands of the pad in the plurality whose address and commands the central station has been transmitting to the vehicles at the time that the central station receives the address and the commands from the additional pad.

107. In combination for use in a system including a plurality of vehicles each responsive to an individual address and to a plurality of commands for providing individual operations of the vehicles in accordance with such commands, a plurality of pads each operative to provide an address for selecting any individual one of the vehicles and to provide commands to such individual one of the vehicles for operating such individual one of the vehicles in accordance with such commands, a central station, the pads being connected to the central station, first means in the central station for interrogating the pads to determine the address and the commands provided by such pads, second means responsive in the pads to the interrogation by the central station for transmitting the address and the commands from the pads to the central station, third means in the central station for receiving the addresses and the commands transmitted by the pads to the central station, and fourth means in the central station for transmitting to the vehicles in the plurality only the address and commands transmitted from each pad to the central station that are different from the immediately preceding address or commands transmitted from such pad to the central station.

108. In a combination as set forth in the claim 107, the first means in the central station being operative to interrogate the pads simultaneously and the pads being operative to transmit the addresses and the commands from such pads to the central station when interrogated.

109. In combination for use in a system including a plurality of vehicles each responsive to an individual address and to a plurality of commands for providing individual operations of the vehicles in accordance with such commands, a plurality of pads each operative to provide an address for selecting any individual one of the vehicles and to provide commands to such individual one of the vehicles for operating such individual one of the vehicles in accordance with such commands, a central station, the pads being connected to the central station, a plurality of first switches each included in an individual one of the pads and having first and second states of operation and operative in the first state a successive number of times to address any individual one of the vehicles, each of the pads including a plurality of lights each indicating an individual one of the vehicles when illuminated, first means in the central station for remembering at each instant the individual ones of the vehicles being addressed by the pads at that instant, a plurality of second switches each having first and second operative relationships and each disposed in an individual one of the pads and each operative in the first relationship to provide for the addressing of only one of the vehicles by such individual one of the pads and operative in the second relationship to provide for the addressing by any other one of the pads of the vehicle simultaneously being addressed by such individual one of the pads, second means responsive in each of the pads to the operation of the first means in the central station and to the operation of the second switch in each pad in the first relationship for skipping over the lights representing in such pad the vehicles being addressed by the other pads when the first switch in such pad receives successive actuations to the first state of operation, and third means responsive in the other one of the pads to the operation of the first means in the central station and to the operation of the second switch in the individual one of the pads in the second relationship for including, in the sequence of lights in such other one of the pads, the light in the vehicle addressed by such individual in the pads in the second state of operation of the second switch in such individual one of the pads even when such vehicle is simultaneously being addressed by another one of the pads.

110. In a combination as set forth in claim 109, means in the central station for transmitting the address and commands from the individual one of the pads and the other one of the pads to the vehicle addressed by such individual one of the pads when the second switch in the individual one of the pads is in the second state of operation.

111. In combination, a plurality of vehicles each having an individual address, a plurality of pads each operative to provide an address for selecting any individual one of the vehicles and to provide commands to such individual one of the vehicles for operating such individual one of the vehicles in accordance with such commands, a central station, the pads being connected to the central station, each of the pads being operative to transmit the address and the commands from such pad to the central station for transmission by the central station to the vehicles, each individual one of the vehicles having a light for illumination when such vehicle is addressed and commanded by the central station as a result of the address and commands from an individual one of the pads, first means in the central station for storing the addressing by each individual one of the pads of the individual one of the vehicles, second means in the central station for communicating a command to the individual one of the vehicles to extinguish the light in such vehicle instantaneously after the individual one of the pads providing the address and the commands to such individual one of the vehicles becomes disconnected from the central station, and third means in each individual one of the vehicles for extinguishing the light in such individual one of the vehicles in accordance with the communication from the central station.

112. In a combination as set forth in claim 111, fourth means in the central station for eliminating the storage of the addressing by each individual one of the pads of the individual one of the vehicles instantaneously after such individual one of the pads becomes disconnected from the central station.

113. In a combination as set forth in claim 112 fifth means in the central station for interrogating the pads connected to the central station to determine the address and the commands from such pad to the vehicles, sixth means for receiving in the vehicles from the central station the address and the commands provided by each of the pads upon the interrogation of such pad by the central station, and seventh means in the central station for eliminating one of the pads from the interrogation by the central station instantaneously after such pad becomes disconnected from the central station, without affecting the interrogation of the other pads by the central station and for providing for the addressing by any of the other pads of the vehicle previously addressed by the disconnected pad.

114. In combination for use with a plurality of pads each operative to provide an address and commands and a central station for transmitting at a particular frequency a carrier signal modulated with the addresses and commands from the pads, a vehicle, means in the vehicle for receiving from the central station the carrier signals modulated with the address individual to such vehicle, means for powering the vehicle in accordance with the reception by such vehicle of the modulated carrier signals individual to such vehicle, means in the vehicle for demodulating the modulated carrier signals to recover the commands individual to such vehicle, the vehicle including wheels for moving the vehicle and including motors for rotating the wheels, means in the receiving means for providing pulse width modulations for energizing the motors in the vehicle to move the vehicle, successive ones of the pulse width modulations providing progressive increments of time in the pulse widths for energizing the motors to accelerate the vehicle, and means in the receiving means for energizing the motors with the successive ones of the pulse width modulations for the progressive increments of time in the pulse widths to accelerate the motors.

115. In a combination as set forth in claim 114, the widths of the pulse widths being progressively incremented for the progressive increments of time from a zero time in the pulse widths to accelerate the motors in the vehicle.

116. In combination, a plurality of vehicles each responsive to an individual address provided to such vehicle and each operative in accordance with commands provided to such vehicle after the reception by such vehicle of such individual address, a plurality of pads each operative to provide addresses individual to any one of such vehicles and to provide commands for operating such vehicle, a central station operatively coupled to the pads for receiving the addresses and the commands from the pads and for transmitting to the vehicles addresses and commands in packets each composed of a plurality of binary indications representing the address and the commands for any individual one of the vehicles and each having start bits at the beginning of the packet and having the address and commands following the start bits with no time separation between successive ones of the packets, means in the central station for transmitting the packets of the binary indications to the vehicles, means in the vehicles for receiving the packets of the binary indications transmitted by the central station, means responsive in each of the vehicles to the address individual to such vehicle for operating the vehicle in accordance with the commands following such address, and means in the central station for regulating the rate of transmitting the bits in the packets to the vehicles in accordance with the time between the start bits in the successive packets of the binary information.

117. In a combination as set forth in claim 116, each of the vehicles having wheels, each of the vehicles having an operating member different from the wheels, and each of the packets including first commands for providing for a rotation of the wheels in an individual one of the vehicles in accordance with the binary indications representing in such packet such individual one of the vehicles and including second commands for providing an operation of the member in such individual one of the packets, means in each of the vehicles for rotating the wheels in such vehicle in accordance with the first commands in the packets addressed to such vehicle, and means in each of the vehicles for operating the operating member in such vehicle in accordance with the second commands in the packets addressed to such vehicle.

118. In a combination as set forth in claim 60, the third lines providing the first and second binary indications when the clock signals on the third lines have the other one of the first and second polarities.

119. In a combination as set forth in claim 97, a memory in the vehicle for storing the contradictory commands and for storing a special command to be executed by the vehicle when the commands provided by the pads are contradictory, and means responsive in the vehicle to the special command in the memory for providing an execution by the vehicle of the special command when the commands in the vehicle are contradictory.

120. In a combination as set forth in claim 101 wherein the central station initiates an interrogation of any pad which is connected to the central station, instantaneously after the pad is connected to the central station, to determine if the pad has addressed any one of the vehicles not then being addressed by any of the other pads.

121. In combination for use in a system including a plurality of vehicles each responsive to an individual address and to a plurality of commands for providing individual operations of such vehicles in accordance with such commands, a plurality of pads, each individual one of the pads including a plurality of switches having first and second states of operation for providing an address to select any individual one of the vehicles and for providing commands to such individual one of the vehicles for operating such individual one of the vehicles in accordance with such commands, a central station, the pads being connected to the central station for interrogation simultaneously by the central station concerning the states of operation of the switches in the pads, first means responsive in the pads to the simultaneous interrogation by the central station of the states of operation of the switches in the pads for transmitting to the central station binary indications of such states of operation, and second means responsive in the central station to the binary indications of the states of operation of the switches in the pads for transmitting to the vehicles signals representing such binary indications.

122. In a combination as set forth in claim 121, the first means being responsive in the pads to the simultaneous interrogations by the central station of the states of operation of the switches in the pads for simultaneously transmitting to the central station the binary indications of the states of operation of the switches in the pads in the plurality.

123. In a combination as set forth in claim 121, the second means being responsive in the central station to the simultaneous transmission to the central station of the binary indications of the states of operation of the switches in the pads in the plurality for transmitting to the vehicles in sequence the signals representing such binary indications for the different pads in the plurality.

124. In combination at a central station for controlling the operation of a plurality of vehicles in accordance with the addressing of the vehicles by pads in a plurality and in accordance with the operation in the pads of controls to obtain the performance of functions in the vehicles, first means for simultaneously interrogating the pads in the plurality to determine from the pads the addressing of the vehicles and the functions to be performed in the addressed vehicles, second means for receiving from the pads binary indications of the vehicles addressed by the pads and the functions to be performed in the addressed vehicles, third means responsive to the binary indications from the pads for providing signals representing the binary indications, and fourth means for transmitting to the vehicles the signals representing the binary indications from the pads.

125. In a combination as set forth in claim 124, the third means being simultaneously responsive to the binary indications from the pads in the plurality to simultaneously provide the signals representing the binary indications.

126. In a combination as set forth in claim 125, the fourth means being operative to transmit in sequence to the vehicles in the plurality the signals representing the binary indications from each individual one of the pads.

* * * * *